US012426752B2

(12) United States Patent
Conrad et al.

(10) Patent No.: US 12,426,752 B2
(45) Date of Patent: Sep. 30, 2025

(54) SURFACE CLEANING APPARATUS

(71) Applicant: Omachron Intellectual Property Inc., Hampton (CA)

(72) Inventors: Wayne Ernest Conrad, Hampton (CA); Jason Thorne, Dover, MA (US)

(73) Assignee: Omachron Intellectual Property Inc., Hampton (CA)

( * ) Notice: Subject to any disclaimer, the term of this patent is extended or adjusted under 35 U.S.C. 154(b) by 364 days.

(21) Appl. No.: 17/571,310

(22) Filed: Jan. 7, 2022

(65) Prior Publication Data

US 2022/0125257 A1 Apr. 28, 2022

Related U.S. Application Data

(60) Continuation of application No. 17/158,914, filed on Jan. 26, 2021, now Pat. No. 11,771,278, which is a (Continued)

(30) Foreign Application Priority Data

| | | |
|---|---|---|
| Mar. 13, 2009 | (CA) | CA 2658402 |
| Jul. 28, 2009 | (CA) | CA 2674056 |
| Sep. 8, 2009 | (CA) | CA 2678220 |

(51) Int. Cl.
*A47L 5/24* (2006.01)
*A47L 5/22* (2006.01)
(Continued)

(52) U.S. Cl.
CPC ..... *A47L 9/0686* (2013.01); *A47L 5/225* (2013.01); *A47L 5/24* (2013.01); *A47L 5/26* (2013.01);
(Continued)

(58) Field of Classification Search
CPC ... A47L 5/225; A47L 5/24; A47L 5/30; A47L 5/365; A47L 9/1608; A47L 9/22
(Continued)

(56) References Cited

U.S. PATENT DOCUMENTS

| | | | |
|---|---|---|---|
| 1,759,947 | A | 5/1930 | Lee |
| 3,451,495 | A | 6/1969 | Bayless et al. |

(Continued)

FOREIGN PATENT DOCUMENTS

| | | | |
|---|---|---|---|
| CA | 2275675 | A1 | 12/1999 |
| CA | 2288544 | A1 | 5/2000 |

(Continued)

OTHER PUBLICATIONS

U.S. Appl. No. 09/343,479, filed Jun. 30, 1999.

*Primary Examiner* — Brian D Keller
*Assistant Examiner* — Aaron R McConnell
(74) *Attorney, Agent, or Firm* — Philip C. Mendes da Costa; SMART & BIGGAR LP

(57) ABSTRACT

A reconfigurable upright surface cleaning apparatus comprises a surface cleaning head and a support structure moveably mounted to the surface cleaning head. The support structure comprises a lower portion having a lower longitudinal axis and an upper portion having an upper longitudinal axis, the lower portion having a lower end moveably coupled to the surface cleaning head and an upper end that is rotatably coupled to the upper portion about a rotational axis that is generally transverse to the forward direction, wherein, the support structure is reconfigurable between a first configuration in which the lower portion and the upper portion are generally aligned with each other and an operating position in which the lower portion is rotated rearward with respect to the surface cleaning head and the upper portion is rotated in the forward direction with respect to the
(Continued)

lower portion. A hand vacuum cleaner comprising a suction motor and an air treatment member is removably mounted to the support structure. An air flow path comprises a flexible hose.

20 Claims, 47 Drawing Sheets

Related U.S. Application Data continuation of application No. 16/378,053, filed on Apr. 8, 2019, now Pat. No. 11,612,288, which is a continuation of application No. 15/280,764, filed on Sep. 29, 2016, now abandoned, which is a continuation of application No. 14/290,817, filed on May 29, 2014, now Pat. No. 9,480,373, which is a continuation-in-part of application No. 13/781,441, filed on Feb. 28, 2013, now Pat. No. 9,198,551, and a continuation-in-part of application No. 13/541,745, filed on Jul. 4, 2012, now Pat. No. 9,386,895, which is a division of application No. 12/720,570, filed on Mar. 9, 2010, now Pat. No. 9,138,114.

(51) Int. Cl.

| | |
|---|---|
| ***A47L 5/26*** | (2006.01) |
| ***A47L 5/30*** | (2006.01) |
| ***A47L 5/32*** | (2006.01) |
| ***A47L 5/36*** | (2006.01) |
| ***A47L 7/00*** | (2006.01) |
| ***A47L 9/06*** | (2006.01) |
| ***A47L 9/16*** | (2006.01) |
| ***A47L 9/22*** | (2006.01) |
| ***A47L 9/24*** | (2006.01) |
| ***A47L 11/40*** | (2006.01) |

(52) U.S. Cl.
CPC ..... *A47L 5/30* (2013.01); *A47L 5/32* (2013.01); *A47L 5/365* (2013.01); *A47L 7/0004* (2013.01); *A47L 7/0095* (2013.01); *A47L 9/0673* (2013.01); *A47L 9/1608* (2013.01); *A47L 9/1683* (2013.01); *A47L 9/22* (2013.01); *A47L 9/24* (2013.01); *A47L 9/248* (2013.01); *A47L 11/4086* (2013.01); *A47L 11/4094* (2013.01)

(58) Field of Classification Search
USPC ..... 15/302, 300.1, 323, 328
See application file for complete search history.

(56) References Cited

U.S. PATENT DOCUMENTS

| | | | | |
|---|---|---|---|---|
| 4,393,536 | A | 7/1983 | Tapp | |
| 5,107,567 | A | 4/1992 | Ferrari et al. | |
| 5,267,371 | A | 12/1993 | Soler et al. | |
| 5,331,715 | A * | 7/1994 | Johnson | A47L 9/0027 15/377 |
| 5,358,290 | A | 10/1994 | Fleet et al. | |
| 5,974,625 | A | 11/1999 | Garner | |
| 6,058,559 | A * | 5/2000 | Yoshimi | A47L 5/225 15/328 |
| 6,098,244 | A | 8/2000 | Conrad et al. | |
| 6,099,661 | A | 8/2000 | Conrad | |
| 6,101,672 | A | 8/2000 | Conrad et al. | |
| 6,123,779 | A | 9/2000 | Conrad et al. | |
| 6,129,775 | A | 10/2000 | Conrad et al. | |
| 6,135,708 | A | 10/2000 | Conrad et al. | |
| 6,168,716 | B1 | 1/2001 | Conrad et al. | |
| 6,170,119 | B1 | 1/2001 | Conrad et al. | |
| 6,173,474 | B1 | 1/2001 | Conrad | |
| 6,174,127 | B1 | 1/2001 | Conrad et al. | |
| 6,183,641 | B1 | 2/2001 | Conrad et al. | |
| 6,224,325 | B1 | 5/2001 | Conrad et al. | |
| 6,231,645 | B1 | 5/2001 | Conrad et al. | |
| 6,238,177 | B1 | 5/2001 | Conrad et al. | |
| 6,243,917 | B1 | 6/2001 | Conrad | |
| 6,251,296 | B1 | 6/2001 | Conrad et al. | |
| 6,261,052 | B1 | 7/2001 | Conrad et al. | |
| 6,261,379 | B1 | 7/2001 | Conrad et al. | |
| 6,280,143 | B1 | 8/2001 | Parker et al. | |
| 6,307,358 | B1 | 10/2001 | Conrad | |
| 6,312,594 | B1 | 11/2001 | Conrad et al. | |
| 6,328,527 | B1 | 12/2001 | Conrad et al. | |
| 6,334,234 | B1 | 1/2002 | Conrad et al. | |
| 6,344,064 | B1 | 2/2002 | Conrad | |
| 6,440,197 | B1 | 8/2002 | Conrad et al. | |
| 6,457,205 | B1 | 10/2002 | Conrad | |
| 6,533,834 | B2 | 3/2003 | Conrad et al. | |
| 6,599,340 | B2 | 7/2003 | Conrad et al. | |
| 6,695,352 | B2 | 2/2004 | Park et al. | |
| 6,782,585 | B1 | 8/2004 | Conrad et al. | |
| 7,329,294 | B2 | 2/2008 | Conrad | |
| 7,356,874 | B2 | 4/2008 | Skinner Macleod et al. | |
| 7,383,609 | B2 | 6/2008 | Ji | |
| 7,507,269 | B2 | 3/2009 | Murphy et al. | |
| 7,740,675 | B2 | 6/2010 | Conrad | |
| 7,749,293 | B2 | 7/2010 | Conrad | |
| 7,776,120 | B2 | 8/2010 | Conrad | |
| 7,803,207 | B2 | 9/2010 | Conrad | |
| 7,811,345 | B2 | 10/2010 | Conrad | |
| 7,832,050 | B2 | 11/2010 | Pullins et al. | |
| 7,867,308 | B2 | 1/2011 | Conrad | |
| 7,941,895 | B2 | 5/2011 | Conrad | |
| 7,979,953 | B2 | 7/2011 | Yoo | |
| 8,127,398 | B2 | 3/2012 | Conrad | |
| 8,146,201 | B2 | 4/2012 | Conrad | |
| 8,151,407 | B2 | 4/2012 | Conrad | |
| 8,176,596 | B2 | 5/2012 | Conrad | |
| 8,192,515 | B2 | 6/2012 | Conrad | |
| 8,292,979 | B2 | 10/2012 | Conrad | |
| 8,296,900 | B2 | 10/2012 | Conrad | |
| 8,349,428 | B2 | 1/2013 | Conrad | |
| 8,370,993 | B2 | 2/2013 | Conrad | |
| 8,375,508 | B2 | 2/2013 | Conrad | |
| 8,448,291 | B2 | 5/2013 | Conrad | |
| 8,479,358 | B2 | 7/2013 | Conrad | |
| 8,486,170 | B2 | 7/2013 | Conrad et al. | |
| 8,510,907 | B2 | 8/2013 | Conrad | |
| 8,533,904 | B2 | 9/2013 | Conrad | |
| 8,561,257 | B2 | 10/2013 | Conrad | |
| 8,567,005 | B2 | 10/2013 | Conrad | |
| 8,578,550 | B2 | 11/2013 | Conrad | |
| 8,578,553 | B2 | 11/2013 | Conrad | |
| 8,590,102 | B2 | 11/2013 | Conrad | |
| 8,607,407 | B2 | 12/2013 | Conrad | |
| 8,621,709 | B2 | 1/2014 | Conrad | |
| 8,640,304 | B2 | 2/2014 | Conrad | |
| 8,646,147 | B2 | 2/2014 | Conrad | |
| 8,659,184 | B2 | 2/2014 | Conrad | |
| 8,677,554 | B2 | 3/2014 | Conrad | |
| 8,677,558 | B2 | 3/2014 | Conrad | |
| 8,713,751 | B2 | 5/2014 | Conrad | |
| 8,813,305 | B2 | 8/2014 | Conrad | |
| 8,834,209 | B2 | 9/2014 | Conrad | |
| 8,869,344 | B2 | 10/2014 | Conrad | |
| 8,869,345 | B2 | 10/2014 | Conrad | |
| 8,869,348 | B2 | 10/2014 | Conrad | |
| 8,875,340 | B2 | 11/2014 | Conrad | |
| 8,875,342 | B2 | 11/2014 | Conrad | |
| 9,027,198 | B2 | 5/2015 | Conrad | |
| 9,027,203 | B2 | 5/2015 | Conrad et al. | |
| 9,066,642 | B2 | 6/2015 | Conrad | |
| 9,119,513 | B2 | 9/2015 | Conrad | |
| 9,161,666 | B2 | 10/2015 | Conrad | |
| 9,167,944 | B2 | 10/2015 | Conrad | |
| 9,204,769 | B2 | 12/2015 | Conrad | |
| 9,226,633 | B2 | 1/2016 | Conrad et al. | |
| 9,232,881 | B2 | 1/2016 | Conrad | |

(56) References Cited

U.S. PATENT DOCUMENTS

| | | | | |
|---|---|---|---|---|
| 9,320,401 | B2 | 4/2016 | Conrad | |
| 9,427,122 | B2 | 8/2016 | Conrad et al. | |
| 9,433,332 | B2 | 9/2016 | Conrad | |
| 9,451,852 | B2 | 9/2016 | Conrad | |
| 9,492,045 | B2 | 11/2016 | Conrad | |
| 9,572,463 | B2 | 2/2017 | Conrad | |
| 9,591,952 | B2 | 3/2017 | Conrad | |
| 9,591,958 | B2 | 3/2017 | Conrad | |
| 9,801,513 | B2 | 10/2017 | Conrad et al. | |
| 10,537,219 | B2 | 1/2020 | Conrad et al. | |
| 11,534,043 | B2 | 12/2022 | Conrad | |
| 11,793,374 | B2 | 10/2023 | Conrad | |
| 11,857,142 | B2 | 1/2024 | Conrad | |
| 2001/0027587 | A1 | 10/2001 | Conrad et al. | |
| 2002/0162188 | A1 | 11/2002 | Harmen | |
| 2003/0201754 | A1 | 10/2003 | Conrad | |
| 2004/0134022 | A1 | 7/2004 | Murphy et al. | |
| 2004/0216266 | A1 | 11/2004 | Conrad | |
| 2004/0261212 | A1 | 12/2004 | Park et al. | |
| 2004/0261213 | A1 | 12/2004 | Park et al. | |
| 2006/0196004 | A1 | 9/2006 | Conrad | |
| 2008/0040883 | A1* | 2/2008 | Beskow | A47L 9/20 15/329 |
| 2008/0072397 | A1 | 3/2008 | Overvaag et al. | |
| 2008/0155774 | A1 | 7/2008 | Pang | |
| 2008/0172992 | A1 | 7/2008 | Conrad | |
| 2008/0178416 | A1 | 7/2008 | Conrad | |
| 2008/0178418 | A1 | 7/2008 | Conrad | |
| 2008/0179133 | A1 | 7/2008 | Conrad | |
| 2008/0196366 | A1 | 8/2008 | Conrad | |
| 2008/0216281 | A1 | 9/2008 | Conrad | |
| 2009/0133209 | A1* | 5/2009 | Ashbee | A47L 9/009 15/300.1 |
| 2010/0139030 | A1* | 6/2010 | Yoo | A47L 5/30 15/328 |
| 2010/0175217 | A1 | 7/2010 | Conrad | |
| 2010/0229323 | A1 | 9/2010 | Conrad | |
| 2010/0229325 | A1 | 9/2010 | Conrad | |
| 2010/0229326 | A1 | 9/2010 | Conrad | |
| 2010/0229334 | A1 | 9/2010 | Conrad | |
| 2010/0229335 | A1 | 9/2010 | Conrad | |
| 2010/0251507 | A1 | 10/2010 | Conrad | |
| 2011/0219567 | A1 | 9/2011 | Conrad | |
| 2011/0219579 | A1 | 9/2011 | Conrad | |
| 2022/0151446 | A1 | 5/2022 | Conrad et al. | |

FOREIGN PATENT DOCUMENTS

| | | | |
|---|---|---|---|
| CA | 2258416 | A1 | 7/2000 |
| CA | 2258419 | A1 | 7/2000 |
| CA | 2258421 | A1 | 7/2000 |
| CA | 2258422 | A1 | 7/2000 |
| CA | 2258423 | A1 | 7/2000 |
| CA | 2258426 | A1 | 7/2000 |
| CA | 2330801 | A1 | 7/2001 |
| CA | 2338193 | A1 | 7/2002 |
| CA | 2339514 | A1 | 9/2002 |
| CA | 2342673 | A1 | 9/2002 |
| CA | 2342993 | A1 | 9/2002 |
| CA | 2658014 | A1 | 9/2010 |
| CA | 2658022 | A1 | 9/2010 |
| CA | 2658160 | A1 | 9/2010 |
| CA | 2658366 | A1 | 9/2010 |
| CA | 2658397 | A1 | 9/2010 |
| CA | 2658497 | A1 | 9/2010 |
| CA | 2658643 | A1 | 9/2010 |
| CA | 2658644 | A1 | 9/2010 |
| WO | 0010718 | A1 | 3/2000 |

* cited by examiner

SURFACE CLEANING APPARATUS

CROSS-REFERENCES TO RELATED APPLICATIONS

This application claims benefit under 35 USC 120 as a continuation of co-pending U.S. patent application Ser. No. 17/158,914, filed on Jan. 26, 2021, which itself is a continuation of U.S. patent application Ser. No. 16/378,053, filed on Apr. 8, 2019; which itself is a continuation of U.S. patent application Ser. No. 15/280,764, filed on Sep. 29, 2016, now abandoned; which itself is continuation of U.S. patent application Ser. No. 14/290,817, filed on May 29, 2014 and issued as U.S. Pat. No. 9,480,373 on Nov. 1, 2016; which itself is a continuation-in-part of U.S. patent application Ser. No. 13/781,441, filed on Feb. 28, 2013 and issued as U.S. Pat. No. 9,198,551 on Dec. 1, 2015, and is also a continuation-in-part of U.S. patent application Ser. No. 13/541,745, filed on Jul. 4, 2012 and issued as U.S. Pat. No. 9,386,895 on Jul. 12, 2016; which is a divisional application of U.S. patent application Ser. No. 12/720,570, filed on Mar. 9, 2010 and issued as U.S. Pat. No. 9,138,114 on Sep. 22, 2015; which itself claims the benefit of foreign priority under 35 CFR 155 from Canadian Patent Application No. 2,658,402, filed on Mar. 13, 2009, Canadian Patent Application No. 2,674,056, filed on Jul. 28, 2009 and Canadian Patent Application No. 2,678,220 filed Sep. 8, 2009, entitled SURFACE CLEANING APPARATUS, the specifications of each of which are incorporated herein by reference in their entirety.

FIELD OF THE INVENTION

This specification relates to a surface cleaning apparatus. In one embodiment, the surface cleaning apparatus has an above floor cleaning wand, which preferably comprises, consists essentially of or consists of the handle assembly, wherein the above floor cleaning wand is removable for above floor cleaning by using a wand release actuator which is provided on the above floor cleaning wand and is removable with the above floor cleaning wand. In some embodiments, the surface cleaning apparatus is an upright surface cleaning apparatus which also comprises a portable surface cleaning unit, such as a hand vacuum cleaner or a pod, which is selectively detachable from the upper portion. The above floor cleaning wand may be removable by itself and/or with the portable surface cleaning unit.

BACKGROUND OF THE INVENTION

The following is not an admission that anything discussed below is part of the prior art or part of the common general knowledge of a person skilled in the art.

Various types of surface cleaning apparatus are known. Typically, an upright vacuum cleaner includes an upper portion or upper section, including an air treatment member such as one or more cyclones and/or filters, drivingly mounted to a surface cleaning head. An up flow conduit is typically provided between the surface cleaning head and the upper portion. In some such vacuum cleaners, a spine, casing or backbone extends between the surface cleaning head and the upper portion for supporting the air treatment member. The suction motor may be provided in the upper portion or in the surface cleaning head.

Surface cleaning apparatus having a portable cleaning module that is removably mounted to an upright vacuum cleaner are known. See for example U.S. Pat. Nos. 5,309,600, 4,635,315 and US 2011/0314629. US 2011/0314629 discloses an upright vacuum cleaner having a surface cleaning head and an upright section pivotally mounted thereto. A hand vacuum cleaner or a pod is removably mounted on the upper portion and is connected in airflow communication with the surface cleaning head via a flexible hose. A portion of the upper portion is bendable so as to allow the surface cleaning head to extend under furniture. This bendable portion is external to the airflow path. In use, the hand vacuum cleaner is locked on the upper portion. A user may manually unlock the hand vacuum cleaner so as to remove it for use as a hand vacuum cleaner and/or for emptying the cyclone bin assembly. In addition, an above floor cleaning wand may be provided and may be removable with the pod.

BRIEF SUMMARY OF THE INVENTION

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In a first aspect there is provided a surface cleaning apparatus wherein the wand is removable from the upper portion with the wand release actuator and, optionally the wand lock mechanism comprising the locking member, is removable with the wand. The wand may be removable mounted in the upper portion. An advantage of this design is that the upper portion on or in which the wand may be mounted may have a lower vertical extent, thereby simplifying the process for a user to reinsert the wand. For example, the user may have a lower target for aligning and installing the wand providing a better vantage to view the required action and permitting the user to handle the wand at a more comfortable height during the installation operation.

In accordance with this aspect, there is provided a surface cleaning apparatus comprising a surface cleaning head having a dirty air inlet, an upper portion moveably mounted to the surface cleaning head between a storage position and a floor cleaning position, a portable surface cleaning unit comprising a suction motor and an air treatment member removably mounted to the upper portion, an above floor cleaning wand removably mounted to the upper portion, a flexible air flow conduit forming at least part of an air flow path from the above floor cleaning wand to the surface cleaning unit, and a wand lock having a locked position in which the wand is secured to the upper portion and an unlocked position in which the wand is removable from the upper portion. The wand lock may include a wand release actuator which is provided on the wand and is removable with the wand from the upper portion.

In some embodiments, the wand lock may further include a locking member that is releasably engageable with the upper portion.

The surface cleaning apparatus may further include a longitudinally extending transmission member that drivingly connects the wand release actuator to the locking member. The transmission member may be translatable downwardly when the wand lock is moved to the unlocked position.

In some embodiments, the locking member may be translated laterally to a position in which it is disengaged from the upper portion when the transmission member is translated downwardly.

In some embodiments, the portable surface cleaning unit may be removably mounted on an outer surface of the upper portion.

In some embodiments, the portable surface cleaning unit and the above floor cleaning wand may each be individually removable from the upper portion.

In some embodiments, the portable surface cleaning unit and the above floor cleaning wand may each be individually removable from the upper portion.

The surface cleaning apparatus may further include a portable surface cleaning unit lock having a locked position in which the portable surface cleaning unit is secured to the upper portion and an unlocked position in which the portable surface cleaning unit is removable from the upper portion. The portable surface cleaning unit lock may include a portable surface cleaning unit release actuator which is provided on the portable surface cleaning unit and is removable with the portable surface cleaning unit from the upper portion.

In some embodiments, the portable surface cleaning unit may be removably mounted on an outer surface of the upper portion.

In some embodiments, the portable surface cleaning unit may also be removably mounted to the wand.

In some embodiments, the portable surface cleaning unit may be slidably receivable on upper mounting members that are provided on the wand.

In some embodiments, the wand may be removably received in the upper portion.

In some embodiments, the upper portion may be in air flow communication with the dirty air inlet and. When the wand is positioned in the upper portion, the wand may be in air flow communication with the dirty air inlet and part of the upper portion may extend around the wand.

The surface cleaning apparatus may further include an air flow passage from the dirty air inlet to the upper portion. An air inlet end of the wand may be aligned with an outlet end of the air flow passage when the wand is received in the upper portion.

In some embodiments, the wand may include a lower end that is received in the upper portion and an upper end. The lower end may include a wand air inlet and the upper end may include a wand air outlet. A handle may be provided proximate the upper end of the wand, whereby, when the wand is received in the upper portion, the wand may be drivingly connected to the surface cleaning head and the upper portion may be configured to stabilize the wand when the wand is drivingly connected to the surface cleaning head.

In some embodiments, the upper portion may be configured as an alignment member and the wand may be receivable in the upper portion in a particular alignment.

In some embodiments, the upper portion may be generally egg shaped in transverse section and a portion of an outer surface of the wand may be generally egg shaped in transverse section.

In some embodiments, the upper portion may extend upwardly to surround a sufficient portion of the wand when the wand is positioned in the upper portion whereby the wand will remain in the upper portion when the wand lock is in the unlocked position.

In a second aspect there is provided a surface cleaning apparatus wherein a portable surface cleaning unit, such as a pod or a hand vac is removable from the upper portion. The portable surface cleaning unit is mounted to the outer surface and the mounting means provides support to the portable surface cleaning unit when the portable cleaning unit is in a removable configuration (e.g., the portable cleaning unit release lock is released). Upper and lower mounting members are provided and one or both may be configured to inhibit both lateral movement and forward rotation of the surface cleaning unit. Accordingly the surface cleaning apparatus may be used as an upright vacuum cleaner in a floor cleaning mode with the portable surface cleaning unit mounted to the upper portion and the portable cleaning unit stably mounted in position as the handle is used to drive and, preferably, steer, the surface cleaning head. For example, upper portion may be provided with two laterally extending wings. The surface cleaning unit may have arms that surround the upper portion and have recesses for receiving the wings. The wings may have a sufficient height to prevent both lateral movement and forward rotation of the surface cleaning unit. This enables the portable unit to remain in position while the portable unit is in an unlocked mode. A second set of upper arms may be provided, e.g., on a removable wan to assist or prevent the surface cleaning unit rotating forward when the surface cleaning unit is unlocked.

In accordance with this aspect, there is provided a surface cleaning apparatus comprising a surface cleaning head having a dirty air inlet, an upper portion moveably mounted to the surface cleaning head between a storage position and a floor cleaning position, an above floor cleaning wand removably receivable in the upper portion and having a longitudinally extending axis, a flexible air flow conduit forming at least part of an air flow path from the above floor cleaning wand to the portable surface cleaning unit, a lower mounting member provided on an outer surface of the upper portion, an upper mounting member provided on at least one of the outer surface of the upper portion and the wand, and a portable surface cleaning unit comprising a suction motor and an air treatment member removably mounted to the upper portion.

In some embodiments, at least one of the upper and lower mounting members may inhibit rotational movement of the portable surface cleaning unit around the axis of the wand.

In some embodiments, the portable surface cleaning unit may be slidably mountable with respect to the upper and lower mounting members.

In some embodiments, the portable surface cleaning unit may be vertically removable from the upper and lower mounting members.

In some embodiments, the surface cleaning apparatus may further include a steering coupling wherein the upper portion may be steeringly coupled to the surface cleaning head.

In some embodiments, the lower mounting member may include a pair of lower wings extending laterally outwardly from the upper portion. The portable surface cleaning unit may have mating recesses provided on a lower surface thereof.

In some embodiments, the surface cleaning apparatus may further include a wand lock having a locked position in which the wand is secured to the upper portion and an unlocked position in which the wand is removable from the upper portion. The upper mounting member may be provided on the wand.

In some embodiments, the wand lock may be operable to remain in the unlocked position once moved to the unlocked position. The upper mounting member may include a pair of upper wings extending laterally outwardly from the wand. The portable surface cleaning unit may include a pair of arms that at least partially surround the upper wings, whereby the wand remains in position when the wand lock is moved to the unlocked position.

In some embodiments, the wand lock may be operable to remain in the unlocked position once moved to the unlocked position and the upper mounting member may include a pair of wings extending laterally outwardly from the wand. Each wing may have a first surface that faces towards the portable surface cleaning unit, and an opposed face. The portable surface cleaning unit may include a pair of arms wherein each arm contacts a portion of the opposed face of one of the wings, whereby the wand remains in position when the wand lock is moved to the unlocked position.

In accordance with this aspect, there is also provided another surface cleaning apparatus comprising a surface cleaning head having a dirty air inlet, an upper portion moveably mounted to the surface cleaning head between a storage position and a floor cleaning position, an above floor cleaning wand removably mounted to the upper portion, a flexible air flow conduit forming at least part of an air flow path from the above floor cleaning wand to the portable surface cleaning unit, a lower mounting member provided on an outer surface of the upper portion, an upper mounting member provided on at least one of the outer surface of the upper portion and the wand, a portable surface cleaning unit comprising a suction motor, and an air treatment member removably mounted on an outer surface of the upper portion. The portable surface cleaning unit may be slidably mountable with respect to the upper and lower mounting members.

In some embodiments, at least one of the upper and lower mounting members may inhibit rotational movement of the portable surface cleaning unit around a longitudinally extending axis of the wand.

In some embodiments, the portable surface cleaning unit may be vertically removable from the upper and lower mounting members.

In some embodiments, the surface cleaning apparatus may further include a steering coupling wherein the upper portion is steeringly coupled to the surface cleaning head.

In some embodiments, the lower mounting member may include a pair of lower wings extending laterally outwardly from the upper portion. The portable surface cleaning unit may have mating recesses provided on a lower surface thereof.

In some embodiments, the surface cleaning apparatus may further include a wand lock having a locked position in which the wand is secured to the upper portion and an unlocked position in which the wand is removable from the upper portion. The upper mounting member may be provided on the wand.

In some embodiments, the wand lock may be operable to remain in the unlocked position once moved to the unlocked position. The upper mounting member may include a pair of upper wings extending laterally outwardly from the wand. The portable surface cleaning unit may include a pair of arms that at least partially surround the upper wings, whereby the wand remains in position when the wand lock is moved to the unlocked position.

In some embodiments, the wand lock may be operable to remain in the unlocked position once moved to the unlocked position and the upper mounting member may include a pair of wings extending laterally outwardly from the wand. Each wing may have a first surface that faces towards the portable surface cleaning unit and an opposed face. The portable surface cleaning unit may include a pair of arms wherein each arm contacts a portion of the opposed face of one of the wings, whereby the wand remains in position when the wand lock is moved to the unlocked position.

In a third aspect there is provided a surface cleaning apparatus having an upper portion wherein an above floor cleaning wand is removably receivable in the upper portion and the upper portion and wand are configured to permit the wand to be driving connected to the surface cleaning head when the wand is installed in the upper portion. A portable surface cleaning unit may be removably mounted, e.g., to an outer surface of the upper portion.

For example, the upper portion may surround the up flow duct from the surface cleaning head and may be non-circular, e.g., egg shaped, and the inlet end of the wand may have a mating shape. Accordingly, the wand may be dynamically stably mounted when inserted into the upper portion. For example, the upper portion provides lateral support for the wand when the wand is inserted into the upper portion. This supports the mechanical stresses imposed when the wand is used to steer the surface cleaning head. In addition a keyed slot may also be provided in the upper housing to assist in aligning the wand during insertion.

In accordance with this aspect, there is provided a surface cleaning apparatus comprising a surface cleaning head having a dirty air inlet, an upper portion moveably mounted to the surface cleaning head between a storage position and a floor cleaning position, a portable surface cleaning unit comprising a suction motor and an air treatment member removably mounted to the upper portion, an above floor cleaning wand removably receivable in the upper portion, a wand lock having a locked position in which the wand is secured to the upper portion and an unlocked position in which the wand is removable from the upper portion, and a flexible air flow conduit forming at least part of an air flow path from the above floor cleaning wand to the surface cleaning unit. The wand may include a lower end and an upper end. The lower end may be received in the upper portion and include a wand air inlet. The upper end may include a wand air outlet. A handle may be provided proximate the upper end of the wand, whereby, when the wand is received in the upper portion, the wand may be drivingly connected to the surface cleaning head. The upper portion may be configured to stabilize the wand when the wand is drivingly connected to the surface cleaning head.

In some embodiments, the upper portion may be in air flow communication with the dirty air inlet and, when the wand is positioned in the upper portion, the wand may be in air flow communication with the dirty air inlet and part of the upper portion may extend around the wand.

In some embodiments, the surface cleaning apparatus may further include an air flow passage from the dirty air inlet to the upper portion and an air inlet end of the wand may be aligned with an outlet end of the air flow passage when the wand is received in the upper portion.

In some embodiments, the upper portion may be configured as an alignment member and the wand may be receivable in the upper portion in a particular alignment.

In some embodiments, the upper portion may be generally egg shaped in transverse section and a portion of an outer surface of the wand may be generally egg shaped in transverse section.

In some embodiments, the upper portion may extend upwardly to surround a sufficient portion of the wand when the wand is positioned in the upper portion whereby the wand will remain in the upper portion when the wand lock is in the unlocked position.

In some embodiments, the portable surface cleaning unit may be removably mounted on an outer surface of the upper portion.

In some embodiments, the portable surface cleaning unit may also be removably mounted to the wand.

In some embodiments, the portable surface cleaning unit may be slidably receivable on upper mounting members that are provided on the wand.

In some embodiments, the upper portion may terminate below an upper end of the portable surface cleaning unit.

In some embodiments, the flexible air flow conduit may include an electrified flexible air flow conduit having a wand electrical engagement member. The upper portion may have an interior in which the wand may be received. The interior may include a cleaning head electrical engagement member and the electrical engagement members may be electrically connected when the electrified flexible air flow conduit is received in the upper portion whereby the electrified flexible air flow conduit is electrically connected to the surface cleaning head.

In some embodiments, the surface cleaning apparatus may further include an air flow passage from the dirty air inlet to the upper portion and an air inlet end of the wand may be aligned with an outlet end of the air flow passage when the wand is received in the upper portion.

In some embodiments, the outlet end of the air flow passage and the cleaning head electrical engagement member may be positioned at a lower end of the interior.

In accordance with this aspect, there is also provided surface cleaning apparatus comprising a surface cleaning head having a dirty air inlet and an electrically operated component, an upper portion moveably mounted to the surface cleaning head between a storage position and a floor cleaning position, the upper portion having an interior, an air flow passage extends from the dirty air inlet to the upper portion and an outlet of the air flow passage is located in the interior, a portable surface cleaning unit comprising a suction motor and an air treatment member removably mounted to the upper portion, an above floor cleaning wand removably receivable in the upper portion, the wand comprising a lower end having an air inlet and an upper end having an air outlet, a wand lock having a locked position in which the wand is secured to the upper portion and an unlocked position in which the wand is removable from the upper portion, and an electrified flexible air flow conduit forming at least part of an air flow path from the above floor cleaning wand to the surface cleaning unit and electrically connecting the surface cleaning head to the surface cleaning unit at a location on in the interior when the wand is received in the upper portion.

In some embodiments, the upper portion may be configured as a first alignment member, and the wand may be receivable in the upper portion in a particular alignment.

In some embodiments, the surface cleaning apparatus may further include a cleaning head electrical engagement member located in the interior that is electrically connectable with a wand electrical engagement member provided on the wand when the wand is received in the upper portion. A second alignment member may be associated with the cleaning head electrical engagement member.

In some embodiments, the upper portion may be generally egg shaped in transverse section and a portion of an outer surface of the wand may be generally egg shaped in transverse section.

In some embodiments, the upper portion may extend upwardly to surround a sufficient portion of the wand when the wand is positioned in the upper portion whereby the wand will remain in the upper portion when the wand lock is in the unlocked position.

In accordance with this aspect, there is also provided a surface cleaning apparatus comprising a surface cleaning head having a dirty air inlet, an upper portion moveably mounted to the surface cleaning head between a storage position and a floor cleaning position, a portable surface cleaning unit comprising a suction motor and an air treatment member removably mounted to the upper portion, an above floor cleaning wand removably receivable in the upper portion, a wand lock having a locked position in which the wand is secured to the upper portion and an unlocked position in which the wand is removable from the upper portion, and a flexible air flow conduit forming at least part of an air flow path from the above floor cleaning wand to the surface cleaning unit. The upper portion may extend upwardly to surround a sufficient portion of the wand when the wand is positioned in the upper portion whereby the wand will remain in the upper portion when the wand lock is in the unlocked position.

In some embodiments, the upper portion may be configured as a first alignment member, and the wand may be receivable in the upper portion in a particular alignment.

In some embodiments, the flexible air flow conduit is electrified and the surface cleaning apparatus further comprises a power tool that is powered by a circuit that includes the flexible electrified air flow conduit.

In some embodiments, the surface cleaning head is adapted to removable receive a hard floor cleaning member.

In some embodiments, the upper portion is steeringly coupled to the surface cleaning head.

It will be appreciated by a person skilled in the art that a surface cleaning apparatus may embody any one or more of the features contained herein and that the features may be used in any particular combination or sub-combination.

The drawings included herewith are for illustrating various examples of articles, methods, and apparatuses of the teaching of the present specification and are not intended to limit the scope of what is taught in any way.

DETAILED DESCRIPTION OF VARIOUS EMBODIMENTS

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

General Description of an Upright Vacuum Cleaner

Figure 1:
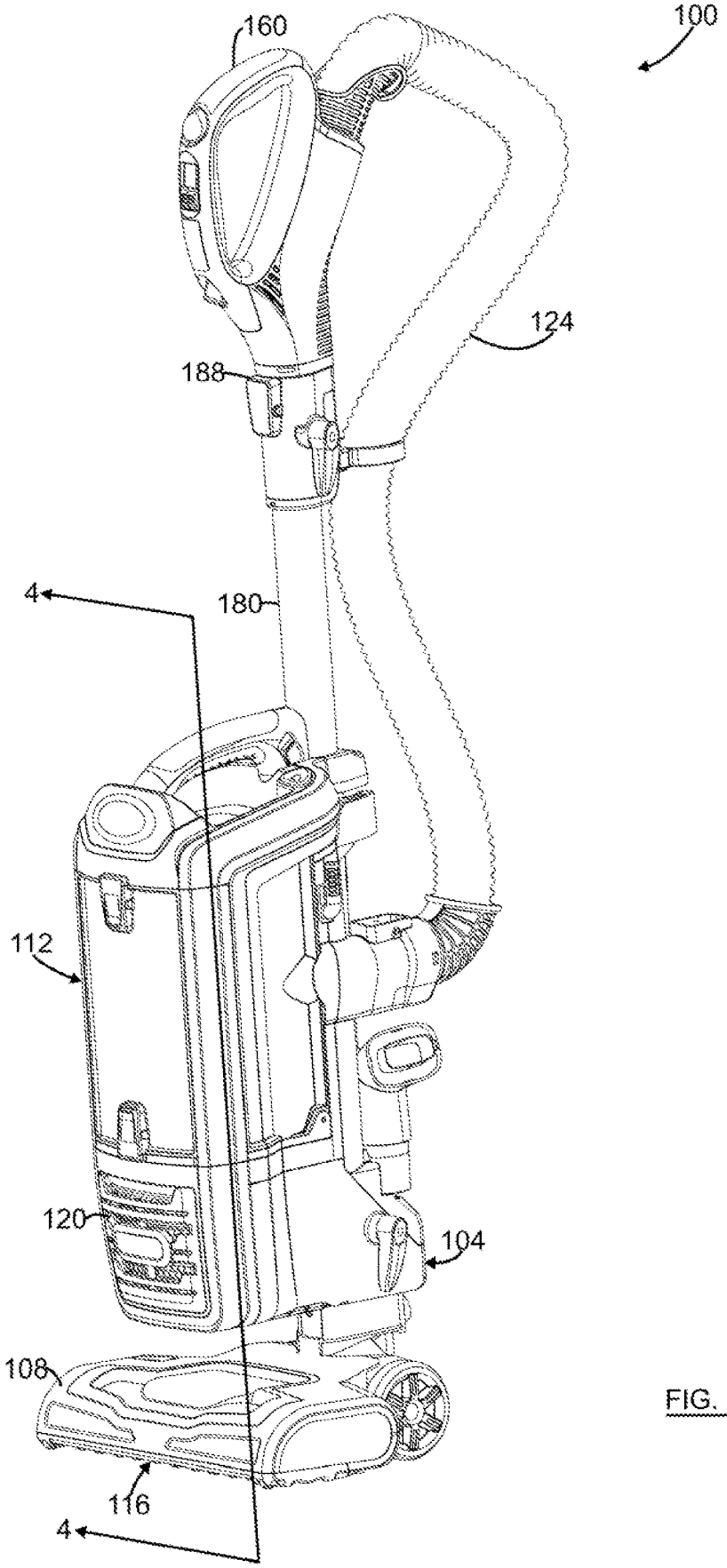
FIG. 1 is a front perspective view of a surface cleaning apparatus in a storage position.
Figure 2:
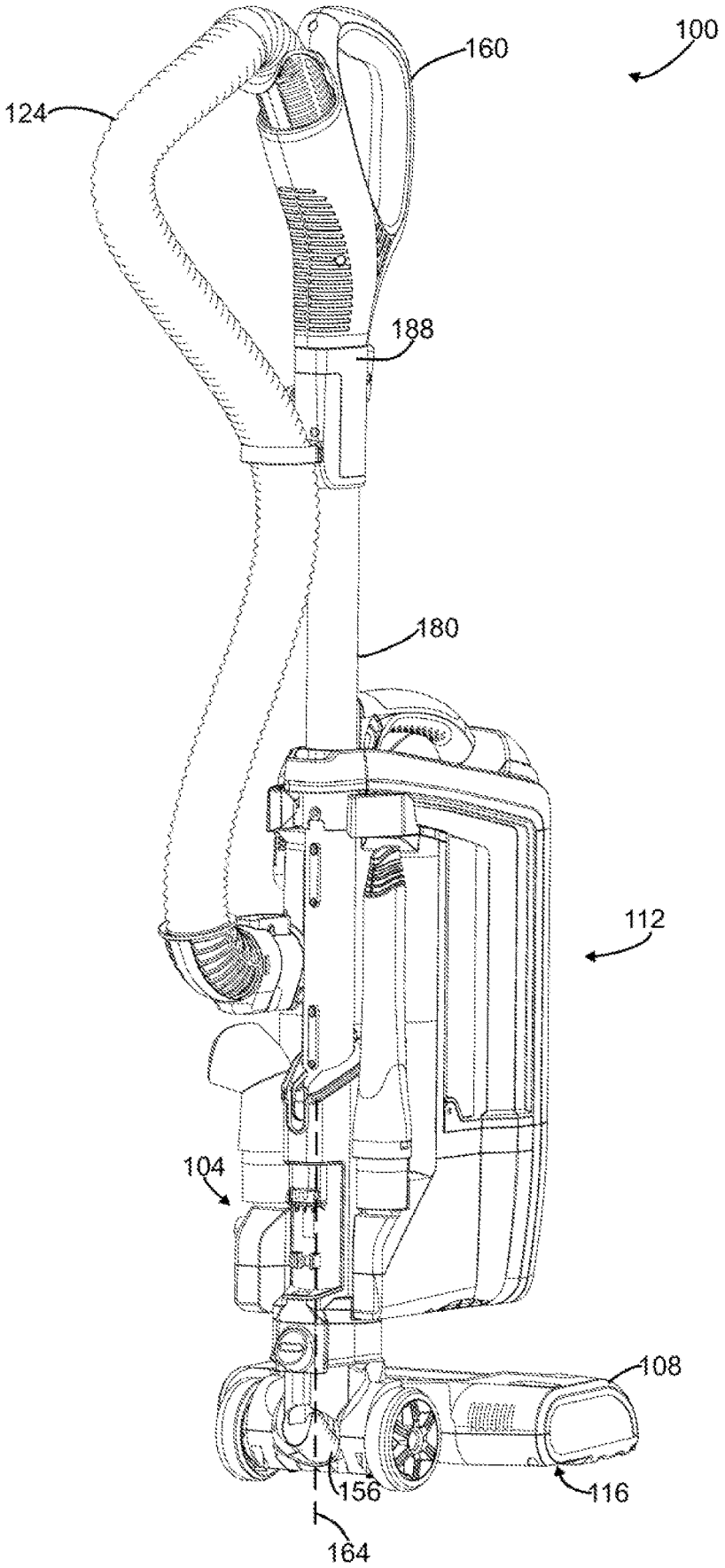
FIG. 2 is a rear perspective view of the surface cleaning apparatus of FIG. 1, in the storage position.
Figure 3:
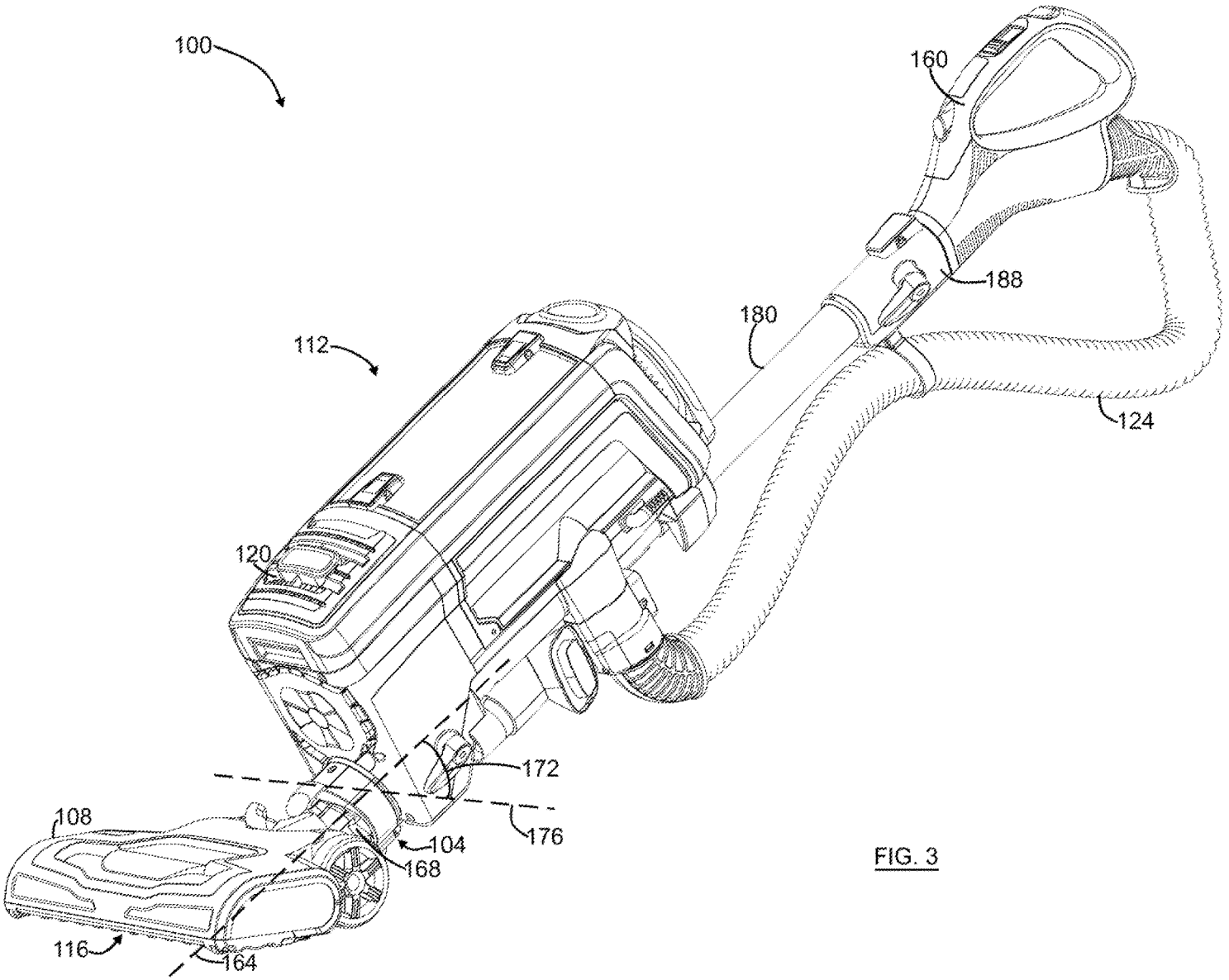
FIG. 3 is a front perspective view of the surface cleaning apparatus of FIG. 1, in a floor cleaning position.

Referring to FIGS. 1-3, a first embodiment of a surface cleaning apparatus 100 is shown. In the embodiment shown, the surface cleaning apparatus 100 is an upright vacuum cleaner. In alternate embodiments, the surface cleaning apparatus may be another suitable type of surface cleaning apparatus, such as a stick vac, a wet-dry type vacuum cleaner or a carpet extractor.

In the illustrated example, the surface cleaning apparatus 100 includes an upper portion or support structure 104 that is movably and drivingly connected to a surface cleaning head 108. A surface cleaning unit 112 is mounted on the upper portion 104. The surface cleaning apparatus 100 also has at least one dirty air inlet 116, at least one clean air outlet 120, and an air flow path or passage extending therebetween. In the illustrated example, the air flow path includes at least one flexible air flow conduit member (such as a hose 124 or other flexible conduit). Alternatively, the air flow path may be formed from rigid members.

At least one suction motor and at least one air treatment member are positioned in the air flow path to separate dirt and other debris from the airflow. The suction motor and the air treatment member may be provided in the upper portion and/or the surface cleaning head of an upright surface cleaning apparatus. Preferably, the suction motor and the air treatment member are provided in a removable surface cleaning unit. The air treatment member may be any suitable air treatment member, including, for example, one or more cyclones, filters, and bags, and preferably the at least one air treatment member is provided upstream from the suction motor. Preferably, as exemplified in FIG. 4, the portable surface cleaning unit 112 includes both the suction motor 128, which may be in a motor housing 132, and an air treatment member, which may be in the form of a cyclone bin assembly 136. Accordingly, surface cleaning unit 112 may be a hand vacuum cleaner, a pod or the like. The motor housing 132 can include at least one removable or openable door 140 which may allow a user to access the interior of the motor housing 132, for example to access the motor 128, a filter or any other component within the housing 132. The cyclone bin assembly 136 includes a cyclone chamber 144 and a dirt collection chamber 148.

In the embodiment shown, the surface cleaning head 108 includes the dirty air inlet 116 in the form of a slot or opening 152 (FIG. 4) formed in a generally downward facing surface of the surface cleaning head 108. From the dirty air inlet 116, the air flow path extends through the surface cleaning head 108, and through an up flow conduit 156 (FIG. 2) in the upper portion 104 to the surface cleaning unit 112. In the illustrated example, the clean air outlet 120 is provided in the front of the surface cleaning unit 112, and is configured to direct the clear air in a generally lateral direction, toward the front of the apparatus 100.

Figure 3A:
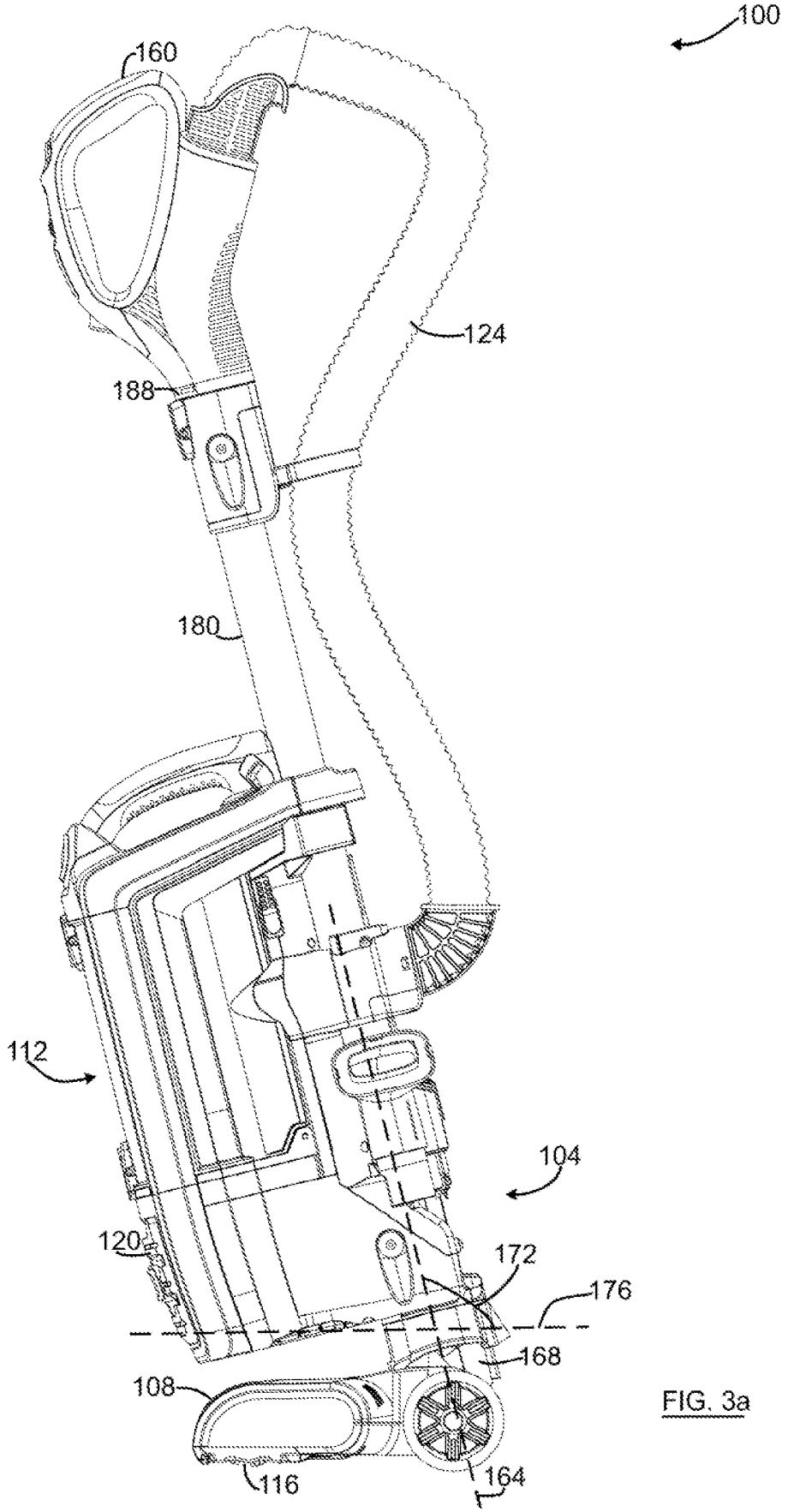
FIG. 3*a* is a side elevation view of the surface cleaning apparatus of FIG. 1, in a storage position.

A handle 160 is provided on the upper portion 104 to allow a user to manipulate the surface cleaning apparatus 100. Referring to FIGS. 2, 3, and 3*a*, the upper portion extends along an upper axis 164 and is moveably mounted to the surface cleaning head 108. In the illustrated example, the upper portion 104 is pivotally mounted to the surface cleaning head via a pivot joint 168. The pivot joint 168 may be any suitable pivot joint. In this embodiment, the upper portion 104 is movable, relative to the surface cleaning head 108, between a storage position (FIG. 1), and a use or floor cleaning position (FIG. 3). In the floor cleaning position, the upper portion 104 may be inclined relative to the surface being cleaned, and an angle 172 between a plane 176 parallel to the surface and the upper axis 164 may be between about 20° and about 85°. In the storage position (FIG. 3*a*), the upper portion 104 may be inclined relative to the surface being cleaned, and the angle 172 between the plane 176 parallel to the surface and the upper axis 164 may be between about 85° and 135°.

Alternatively, or in addition to being pivotally coupled to the surface cleaning head 108, the upper portion 104 may also be rotatably mounted to surface cleaning head 108. In this configuration, the upper portion 104, and the surface cleaning unit 112 supported thereon, may be rotatable about the upper axis 164. In this configuration, rotation of the upper portion 104 about the upper axis 164 may help steer the surface cleaning head 108 across the floor (or other surface being cleaned). Alternately, the upper portion 104 may be pivotally mounted to the surface cleaning head about a second pivot axis, or otherwise moveable mounted with respect to the surface cleaning head, to provide steering.

It will be appreciated that the forgoing discussion is exemplary and that an upright vacuum cleaner may use a surface cleaning head and upper portion of any design and they may be moveably connected together by any means known in the art.

Cleaning Modes

The following is a description of the components of the surface cleaning apparatus that are configured to be disconnectable that may be used by itself in any surface cleaning apparatus or in any combination or sub-combination with any other feature or features disclosed herein.

Accordingly, in one aspect, the upright vacuum cleaner 100 may be operable in a variety of different functional configurations or operating modes. The versatility of operating in different operating modes may be achieved by permitting the surface cleaning unit 112 to be detachable, e.g., from the upper portion 104. Alternatively, or in addition, further versatility may be achieved by permitting portions of the vacuum cleaner (e.g., one or more of a surface cleaning head, an above floor cleaning wand, a handle assembly, a hose) to be detachable from each other at a plurality of locations, and re-connectable to each other in a variety of combinations and configurations.

In the examples illustrated, mounting the surface cleaning unit 112 on the upper portion 104 increases the weight of the upper portion 104 and can affect the maneuverability and ease of use of the surface cleaning apparatus 100. With the surface cleaning unit 112 attached, the vacuum cleaner 100 may be operated like a traditional upright style vacuum cleaner, as illustrated in FIGS. 1-3 and 25.

Alternatively, in some cleaning situations the user may preferably detach the surface cleaning unit 112 from the upper portion 104 and choose to carry the surface cleaning unit 112 (e.g. by hand or by a strap) separately from the upper portion 104, while still using the upper portion 104 to drivingly maneuver the surface cleaning head 108. When the surface cleaning unit 112 is detached, a user may more easily maneuver the surface cleaning head 108 around or under obstacles, like furniture and stairs (e.g., FIG. 28).

Figure 6:
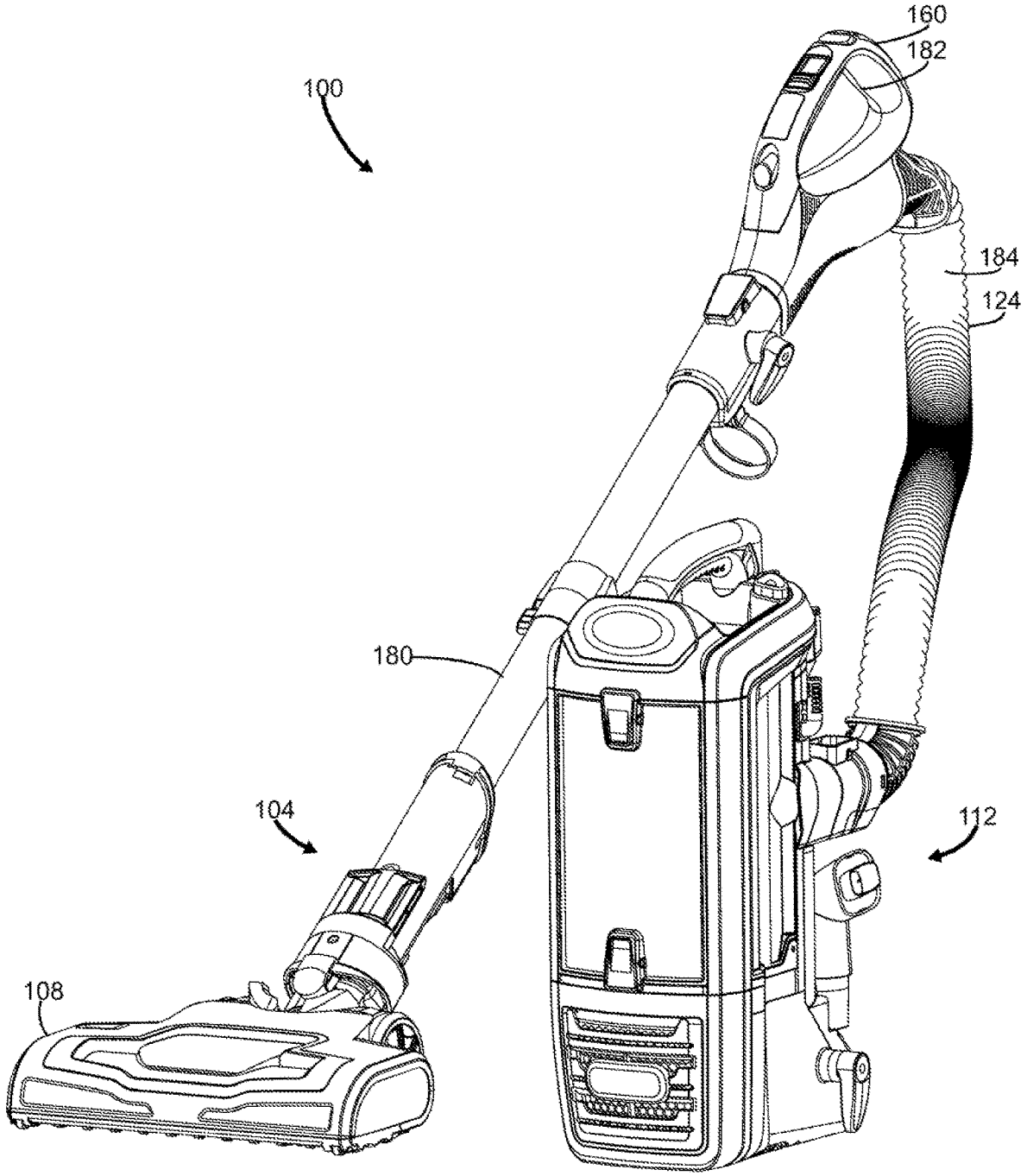
FIG. 6 is a front perspective view of the surface cleaning apparatus of FIG. 1, with the pod removed but still in air flow communication with the surface cleaning head.

To enable the vacuum suction generated by the surface cleaning unit 112 to remain in airflow communication with the surface cleaning head 108 when the surface cleaning unit 112 is detached from the support structure 104, the airflow connection between the surface cleaning head 108 and the cleaning unit 112 is preferably at least partially formed by a flexible conduit, such as flexible hose 124, which may be an electrified hose. Preferably, the hose 124 is extensible and more preferably is elastically or resiliently extensible. The use of a flexible conduit allows a user to detach the surface cleaning unit 112 and maintain a flow connection between the portable surface cleaning unit 112 and the surface cleaning head 108 without having to reconfigure or reconnect any portions of the airflow conduit 184 (FIG. 6).

In the example shown, the airflow path between the surface cleaning head 108 and the cleaning unit 112 further includes an above floor cleaning wand 180. Wand 180 may be positioned upstream of hose 124 and downstream of surface cleaning head 108. Preferably, wand 180 may be drivingly connected to upper portion 104 so that wand 108 may be used to direct surface cleaning head 108 (e.g., forwardly and rearwardly) and, optionally, for also steering surface cleaning head 108. Accordingly, wand 180 comprises a rigid airflow conduit having any suitable shape. For example, wand 180 may be straight as shown or it may be curved or bent. In some embodiments, wand 180 may be reconfigurable. For example, wand 108 may have upper and lower sections that are moveably mounted with respect to each other (e.g., pivotally connected) so that wand 180 may be converted from a straight configuration to a bent configuration. Further, wand 180 may have any suitable cross-sectional shape, such as a circular cross-section as shown, or another cross-sectional shape such as square, triangular, or another regular or irregular shape.

Wand 180 may be telescopic so that it is extendable.

In order to enable a user to use wand 180 to remotely maneuver surface cleaning head 108, wand 180 may be provided with a handle assembly. Preferably, handle assembly or handle 160 is positioned proximate an upper (i.e. downstream) end 188 of wand 180. For example, handle 160 may be connected to one or both of wand 180 and hose 124. Optionally, handle 160 may form part of the airflow path between wand 180 and hose 124. Alternatively, handle 160 may be peripherally attached to one or both of wand 180 and hose 124 without participating in the airflow communication between wand 180 and hose 124.

A user may grasp a hand grip portion 182 of handle 160 to manipulate wand 180 (e.g. for moving upper portion 104 and steering surface cleaning head 108). In alternative embodiments, surface cleaning apparatus 100 may not include a handle 160 and instead a user may grasp wand 180 directly.

Figure 5:
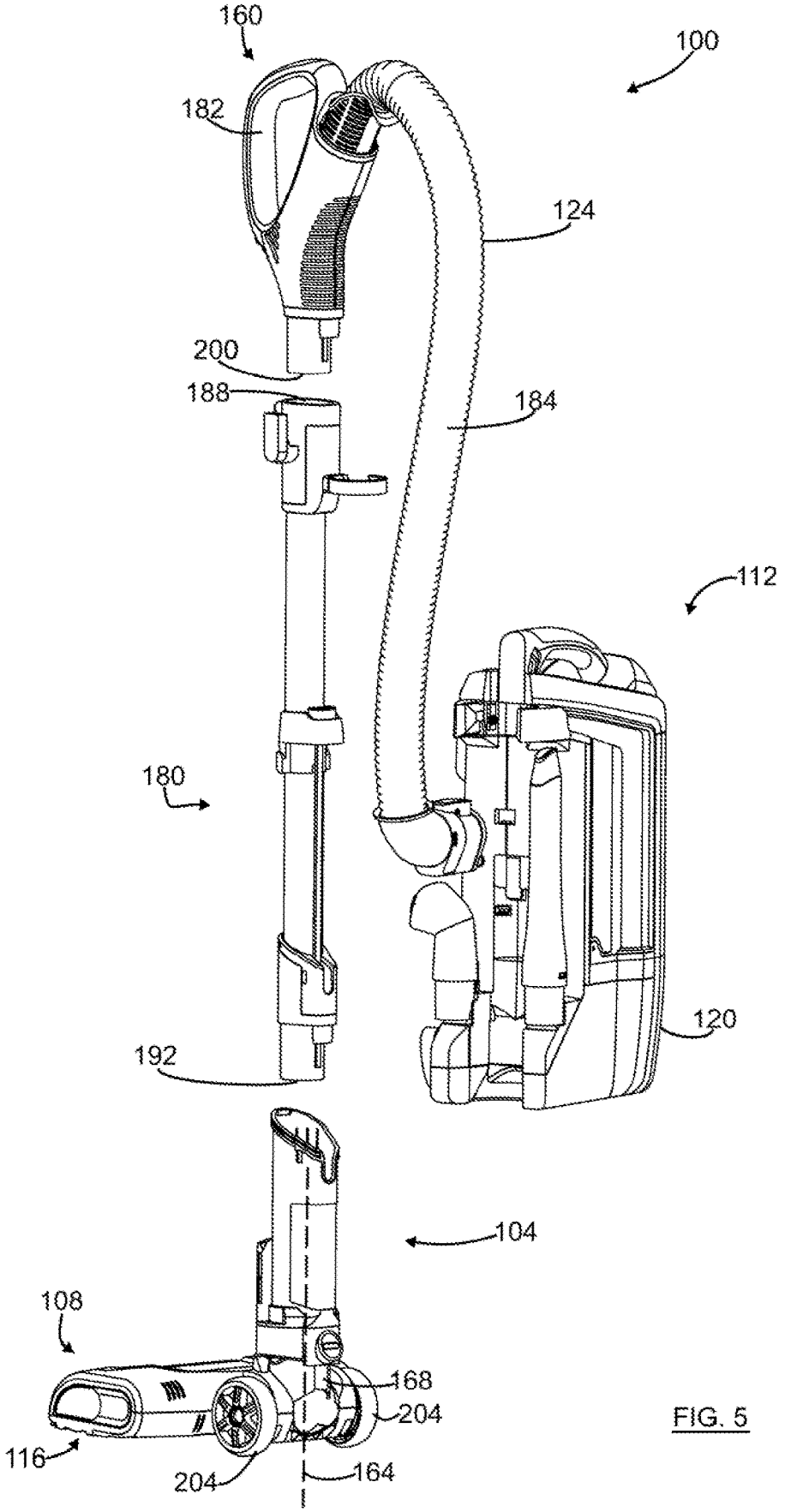
FIG. 5 is a rear perspective view of the surface cleaning apparatus of FIG. 1, in a partially disassembled configuration.

Reference is now made to FIG. 5. As shown, upper portion 104 is moveably mounted with respect to surface cleaning head 108. Upper portion 104 may be connected to surface cleaning head 108 by any means known in the art, (e.g., it may be pivotally mounted, rotationally mounted or the like). As exemplified, pivot joint 168 permits upper portion 104 to tilt and/or pivot with respect to surface cleaning head 108.

One or both of wand 180 and surface cleaning unit 112 may be selectively attached or detached from upper portion 104. As exemplified, each of wand 180 and surface cleaning unit 112 is selectively attachable or detachable from upper portion 104. An advantage of this design is that a user may convert the vacuum cleaner to a surface cleaning mode by removing the wand without having to remove surface cleaning unit 112. Preferably, each of wand 180 and surface cleaning unit 112 may be selectively connected or disconnected from upper portion 104 independently of the other. For example, wand 180 and surface cleaning unit 112 may be connected or disconnected from upper portion 104 in any order, sequentially or simultaneously. This may simplify the reconfiguration of surface cleaning apparatus 100 into different cleaning modes without requiring disruption to the operation of surface cleaning apparatus 100.

Figure 25:
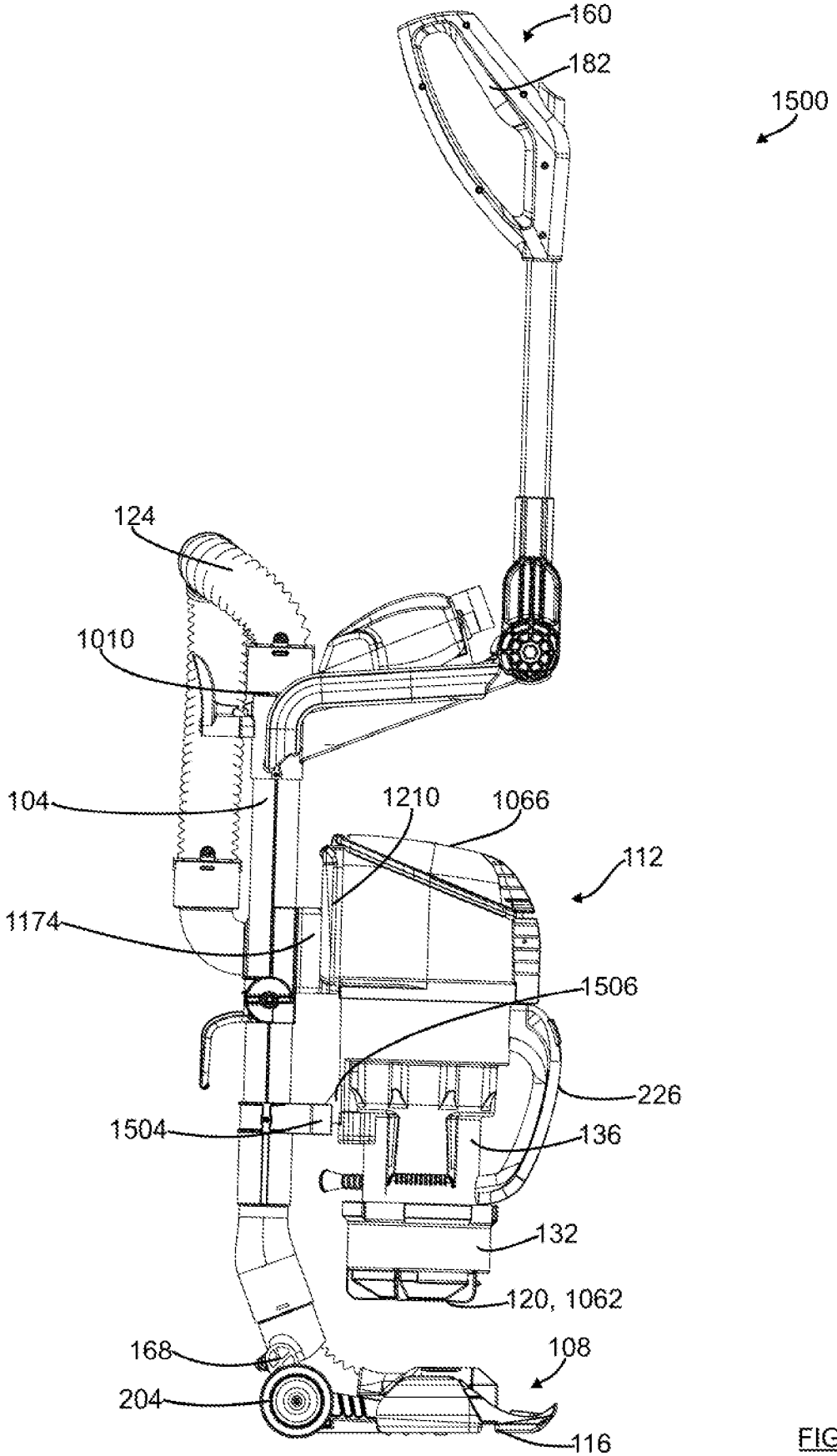
FIG. 25 is a side elevation view of the surface cleaning apparatus of FIG. 24.
Figure 26:
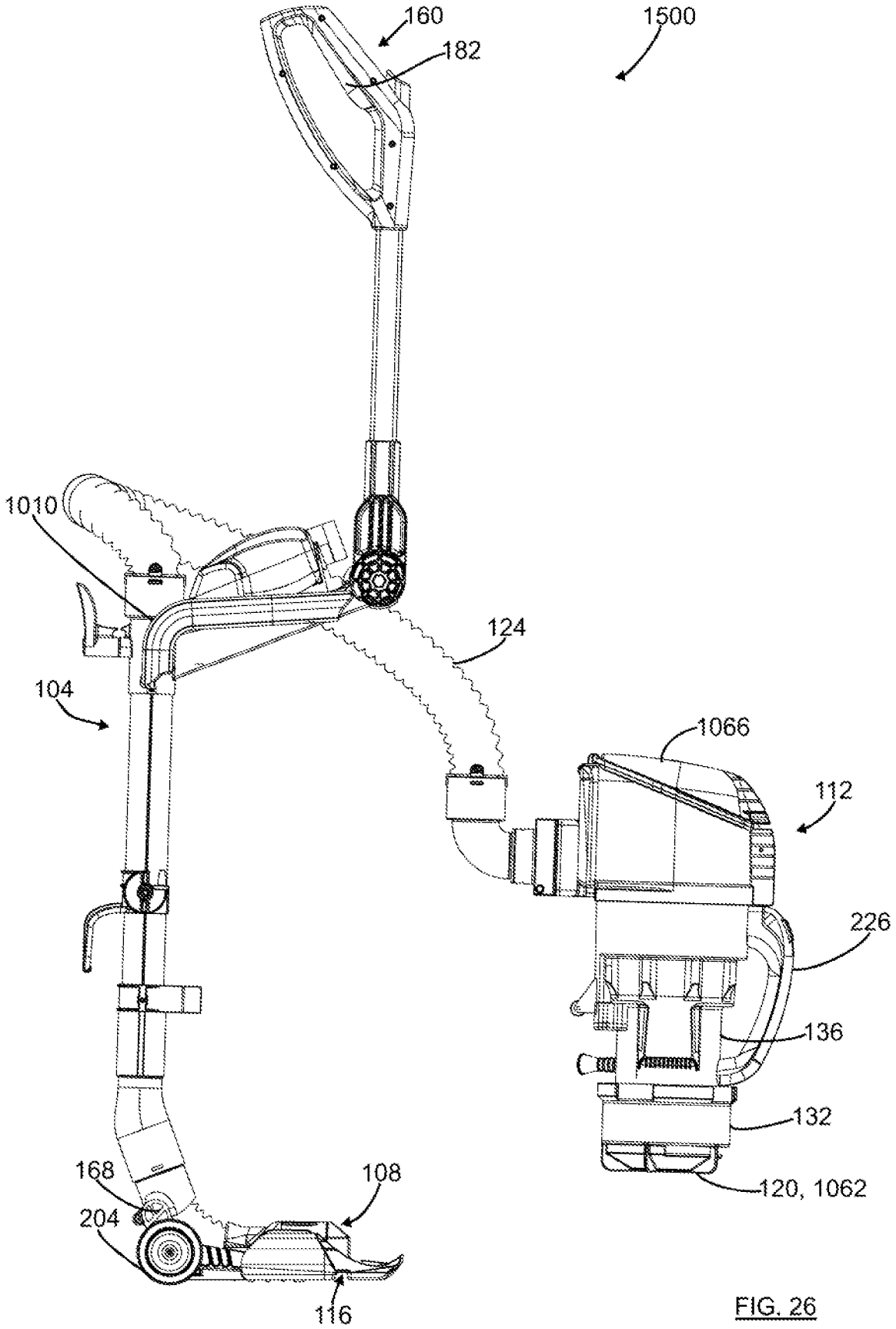
FIG. 26 is a side elevation view of the surface cleaning apparatus of FIG. 24 with the cleaning unit removed from the upper portion.
Figure 28:
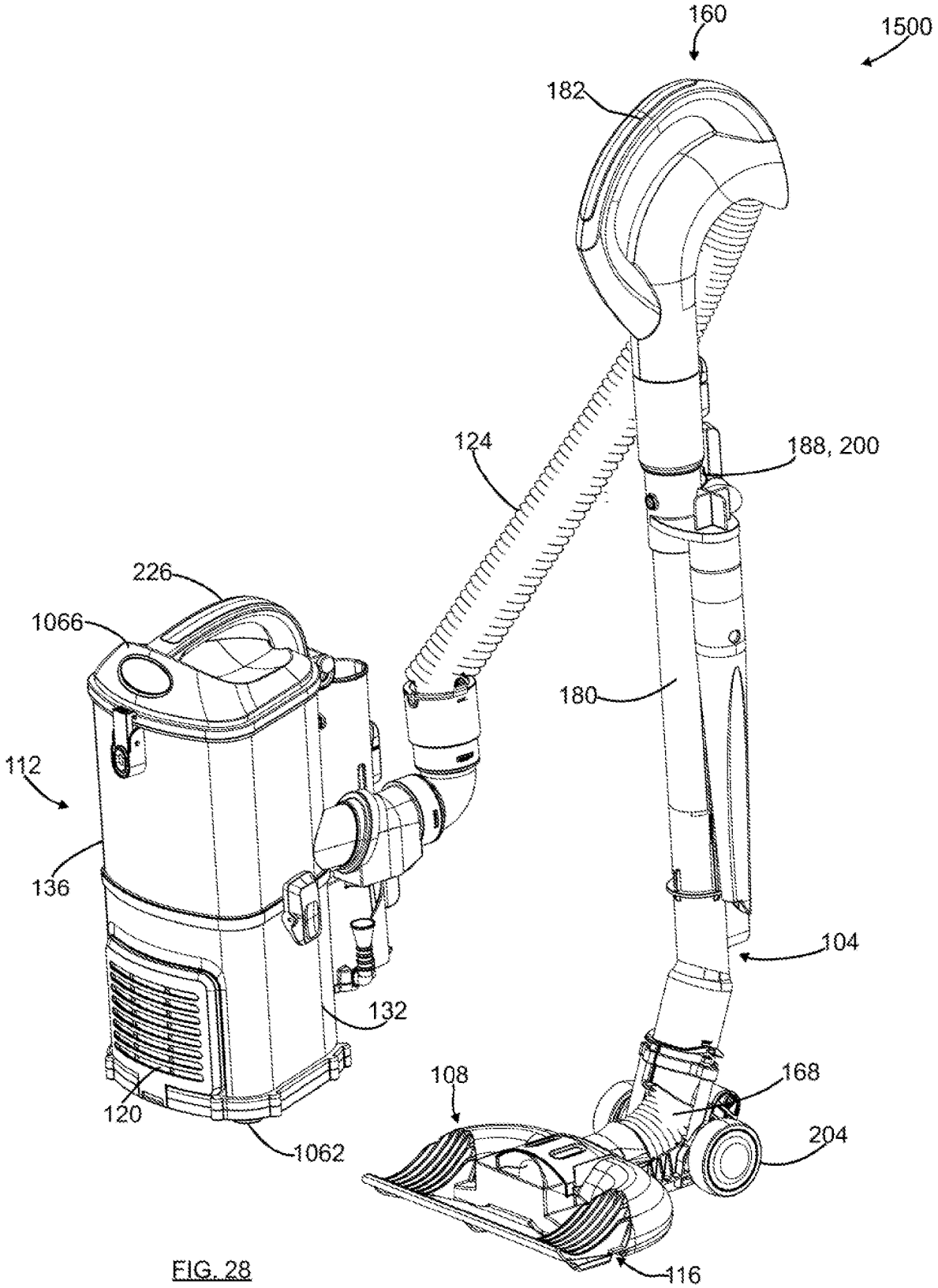
FIG. 28 is a front perspective view of a further alternate example of a upright surface cleaning apparatus with a removable surface cleaning unit mounted thereto.

As exemplified, when upstream end 192 of wand 180 is connected to upper portion 104, the surface cleaning head 108 participates in the airflow path in a floor cleaning mode, e.g., for cleaning floors, stairs, and the like. In such a case, the surface cleaning unit 112 may be mounted on upper portion 104, for supporting the weight of surface cleaning unit on upper portion 104 (e.g., as shown in FIGS. 3 and 25 which exemplifies a traditional floor cleaning mode for an upright vacuum cleaner). Alternately, surface cleaning unit 112 may be dismounted from upper portion 104 and carried by hand, worn as a backpack, or placed on the floor for example while wand 180 is connected to surface cleaning head 108 (e.g., as shown in FIGS. 6 and 28 which exemplifies an alternate floor cleaning mode for an upright vacuum cleaner).

Figure 7:
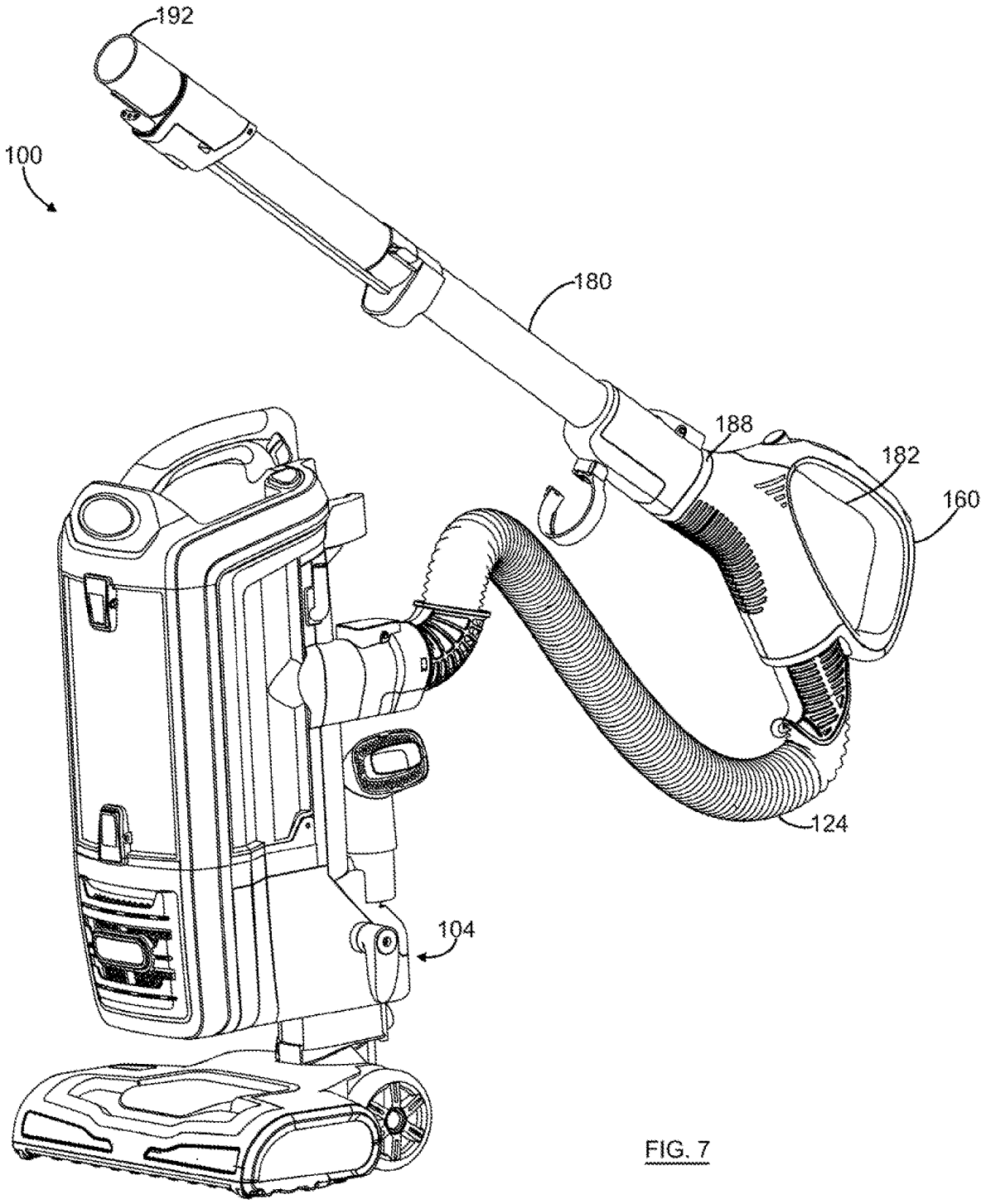
FIG. 7 is a front perspective view of the surface cleaning apparatus of FIG. 1, in an above-floor cleaning configuration.
Figure 24:
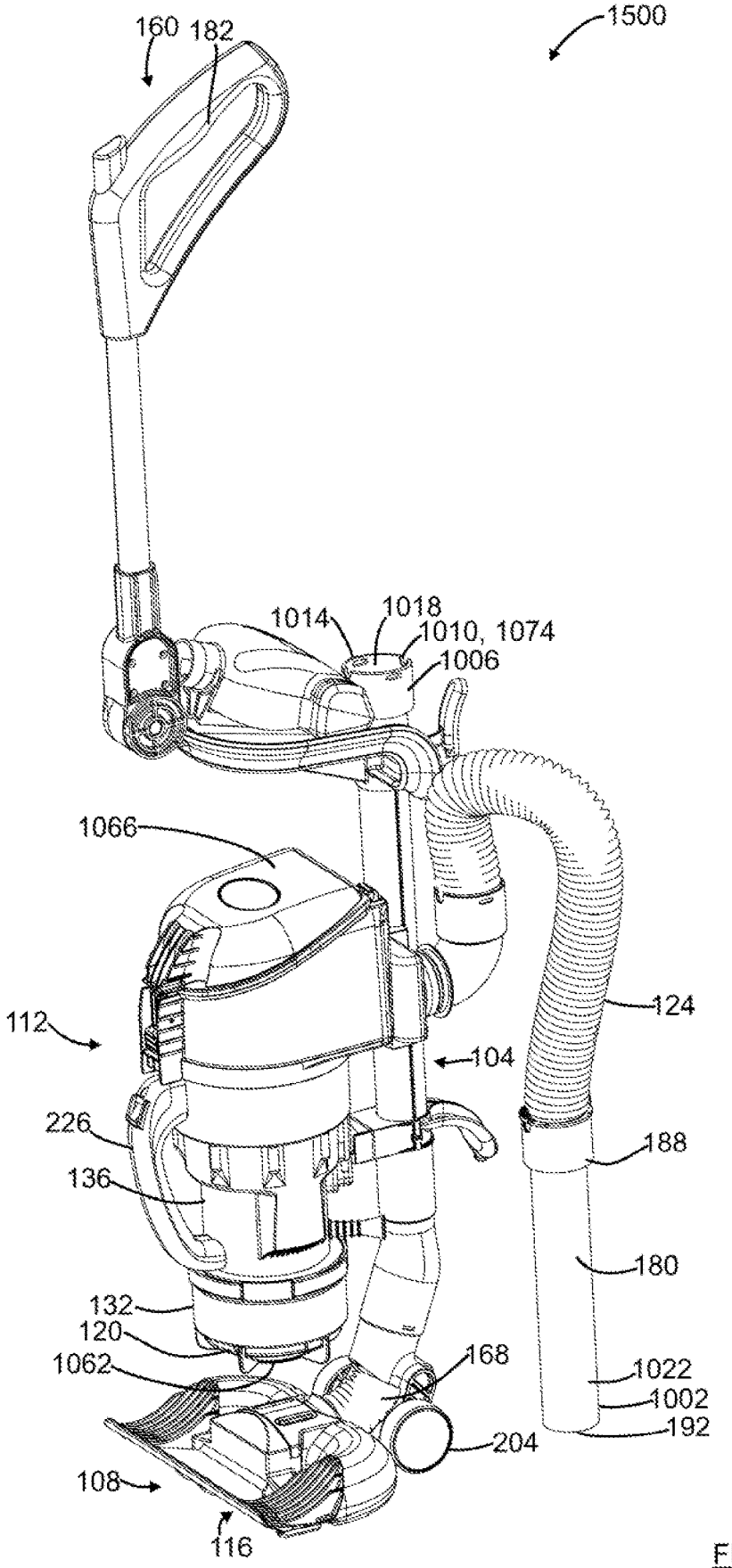
FIG. 24 is a front perspective view of an alternate example of a upright surface cleaning apparatus with a removable surface cleaning unit mounted thereto.

As exemplified, wand 180 may be disconnected from upper portion 104 for use in an above-floor cleaning mode. In one embodiment, surface cleaning unit 112 may be mounted on upper portion 104, for supporting the weight of surface cleaning unit on upper portion 104 while wand 180 is used in the above floor cleaning mode (e.g., as shown in FIGS. 7 and 24). Alternately, in another optional embodiment, surface cleaning unit 112 may also be dismounted from upper portion 104 and carried by hand, worn as a backpack, or placed on the floor for example while wand 180 is used in the above floor cleaning mode. Wand 180 may be selectively connected or disconnected from the airflow path, such as when the extension in reach it provides is not required. For example, downstream end 188 of wand 180 may be separated from handle 160. The reduced reach provided by this configuration may be advantageous where the user may wish to manipulate the cleaning surface by hand (e.g. separate cushions in a couch) while cleaning, or where the user may require fine control (e.g. to avoid sucking up objects on the cleaning surface).

If Wand 180 and surface cleaning unit 112 are each individually removable, then they may each be independently mounted to upper portion 104. Wand 180 and surface cleaning unit 112 may connect to upper portion 104 in any suitable fashion. In the example shown, wand 180 is inserted into upper portion 104, and surface cleaning unit 112 is mounted to an exterior of upper portion 104. In such a case, upper portion 104 may provide part or all of the air flow path from surface cleaning head 108 to wand 180. In other embodiments, upper portion 104 need not be part of the air flow path. For example, wand 180 may be mounted to the exterior of upper portion 104 and the inlet end may seat on an outlet end of a duct provided on the outer surface of the upper portion 104.

Referring to FIG. 6, when the surface cleaning apparatus 100 is in use, a user may detach the surface cleaning unit 112 from the upper portion 104 without interrupting the airflow communication between the cleaning unit 112 and the surface cleaning head 108. This allows a user to selectively detach and re-attach the cleaning unit 112 to the support structure 104 during use without having to stop and reconfigure the connecting hose 124 or other portions of the airflow conduit 184. As exemplified, wand 180 is attached to upper portion 104 and surface cleaning unit 112 is detached from upper portion 104.

FIG. 6 illustrates a configuration in which the vacuum cleaner 100 can be operated with the surface cleaning unit 112 detached from the upper portion 104 and the air flow path between the surface cleaning unit 112 and the surface cleaning head 108 remains intact. In this configuration, upper portion 104 may provide a connection between wand 180 and surface cleaning head 108, which may permit surface cleaning head 108 to be driven by manipulating wand 180.

In addition to being operable to clean floors or surfaces, the vacuum cleaner may be operated in a variety of cleaning modes that do not include use of the surface cleaning head, and may be generally described as above floor cleaning modes. This can generally include cleaning furniture, walls, drapes and other objects as opposed to cleaning a large, planar surface.

In one example of an above floor cleaning mode, as exemplified in FIG. 7, the surface cleaning unit 112 can remain mounted on the upper portion 104. This eliminates the need for the user to separately support the weight of the surface cleaning unit 112 in an above floor cleaning mode. In the illustrated configuration, the surface cleaning unit 112 may remain mounted on the upper portion 104 and the wand 180 may be detached from upper portion 104 to provide an extended reach for above floor cleaning. Optionally, additional accessory tools may be coupled to the upstream end 192 of wand 180, including for example a crevice tool, a cleaning brush (optionally an electrically powered brush or an air driven turbo brush) and any other type of accessory including a power tool such as a sander.

Further, as illustrated in FIG. 5, the upstream end 200 of the handle 160 may be separated from the downstream end 188 of wand 180. In this configuration the upstream end 200 of the handle 160 can function as the dirty air inlet for the vacuum cleaner 100. Optionally, accessory tools, such as wands, crevasse tools, turbo brushes, hoses or other devices may be coupled to the upstream end 200 of the handle 160.

In another example of an above floor cleaning mode, as exemplified in FIG. 5, the surface cleaning unit 112 and wand 180 can both be detached from the upper portion 104. The upstream end 200 of handle 160 may be selectively connected or disconnected from downstream end 188 of wand 180 as desired. This configuration may be advantageous when surface cleaning unit 112 must be held above the floor (e.g. while the user is standing on a ladder). In this case, the upper portion 104 and surface cleaning head 108 may add unnecessary weight to the surface cleaning unit 112.

This configuration may also be advantageous when the surface cleaning unit 112 is to be rested on a sloped surface. In this case, the rear wheels 204 and the front wheels or glides (not shown) of surface cleaning head 108 may allow surface cleaning unit 112 to roll away. By detaching surface cleaning unit 112 from surface cleaning head 108, surface cleaning unit 112 may be placed directly on the sloped surface. Optionally, additional accessory tools may be coupled to the upstream end 192 of the wand 180.

Optionally, one or more auxiliary support members, including for example a wheel and a roller, can be provided on the rear of the surface cleaning apparatus and/or the upper portion and configured to contact the floor (or other surface) when the upper portion is inclined or placed close to the surface. Providing an auxiliary support member may help carry some of the weight of the surface cleaning unit and/or upper portion when in a generally horizontal configuration. The auxiliary support member may also help the upper portion 104 and/or surface cleaning unit 112 to roll relatively easily over the floor when in a generally horizontal position. This may help a user to more easily maneuver the upper portion and/or surface cleaning unit under obstacles, such as a bed, cabinet or other piece of furniture.

Reference is now made to FIGS. 24-27, in which like part numbers refer to like parts in the other figures, where a surface cleaning apparatus 1500 is shown in accordance with another embodiment. As shown, surface cleaning apparatus 1500 includes a support structure 104 having an upper portion 194 and a lower portion 196. The lower portion 196 is connected by a joint 168 to a surface cleaning head 108 having a dirty air inlet 116. Optionally, the lower portion 196 may be moveably, e.g., hingedly or pivotally, attached to the surface cleaning head 108, so that the lower portion 196 can move relative to the surface cleaning head 108 during use. The upper portion 194 and lower portion 196 are preferably pivotally connected by a hinge 198. Any type of hinge, pivot or bending mechanism known in the vacuum cleaner art may be used provided that grip 182 of handle 160 may be moved forwardly with respect to the upper end of lower portion 196. This may enable the user to move the surface cleaning head 108 beneath cabinets, furniture or other obstacles. A downstream end 1010 of lower portion 196 of support structure 104 may define an opening 1014 for an air outlet 1074. A wand 180 (FIG. 24) is shown including an upstream end 192, and a downstream end 188 in air flow communication with a hose 124. Hose 124 is shown in air flow communication with a surface cleaning unit 112 having a cyclone bin assembly 136, a motor housing 132, and a clean air outlet 120.

Figure 27:
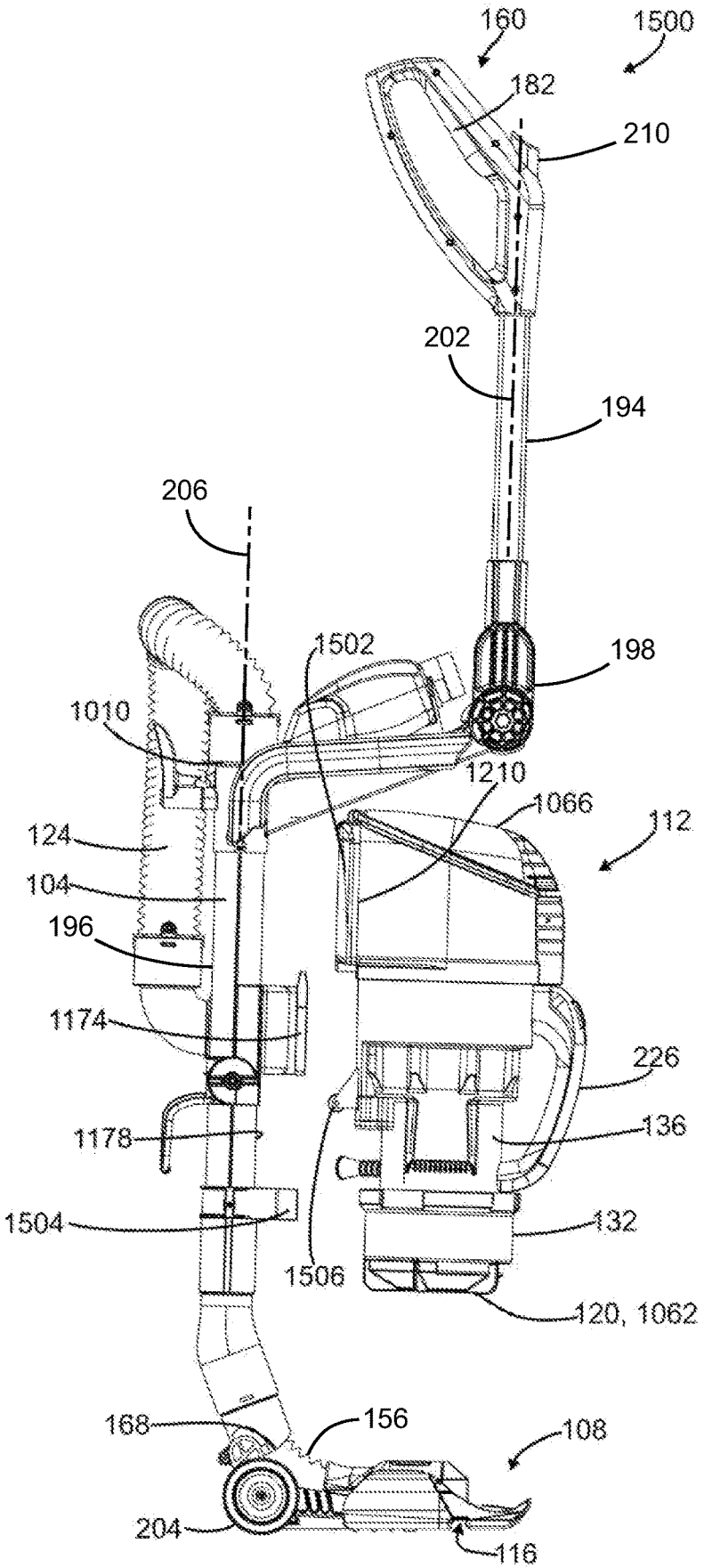
FIG. 27 is a side elevation view of the surface cleaning apparatus of FIG. 24 with the cleaning unit separated from the flexible hose.

When the hinge 198 is in a first position, as shown in FIG. 27, the upper and lower portions 196, 194 are generally aligned with each other, e.g., they each have a respective longitudinal axis 206, 202 and the axis are generally parallel. As exemplified, the axis 202 of the upper portion 194 may be located forward of the axis 206 of the lower portion 196. The hinge 198 is preferably retained in this first position by a biasing or locking means so that the upper portion 194 preferably remains at a fixed angular position with lower portion 196 when the lock is engaged so that forward and rearward movements applied to grip 182 of the upper portion 194 can be translated to the lower portion 196 as is known conventionally. In use, the hinge 198 can be unlocked, or released from the first position and upper portion 194 may be moved into one or more second fixed positions, wherein the grip 182 is preferably rotated forwardly. Optionally, the lock may remain in the unlocked position such that upper portion 194 may freely rotate with respect to the lower portion 196 while it is used to move the cleaning head 108.

As exemplified in FIG. 27, the grip 182 preferably comprises an actuator 210 for releasing or unlocking the releasable lock or hinge 198, for example a button or hinge release that can be activated by a user during use of vacuum cleaner 1500 to unlock the hinge 198. It will be appreciated that the actuator 210 may be of any type and may be located at any location and is preferably provided on the upper portion 194 and is preferably adjacent the grip 182. When a user activates the hinge release 210, the retaining or locking means used to secure the hinge 198 in the first position is disengaged, allowing the hinge 198 to rotate or pivot. As the hinge 198 rotates, the upper portion 194 can be moved into a plurality of angular positions relative to the lower portion 196. Optionally, the hinge 198 may rotate between, and lock into, one or a given number of set or indexed angular positions. Alternatively, the rotation of the hinge 198 may be continuously variable, after being initially unlocked, allowing for the upper portion 194 to be moved into an indefinite number of angular positions relative to the lower portion 196 (e.g., freely rotatable).

Figure 27A:
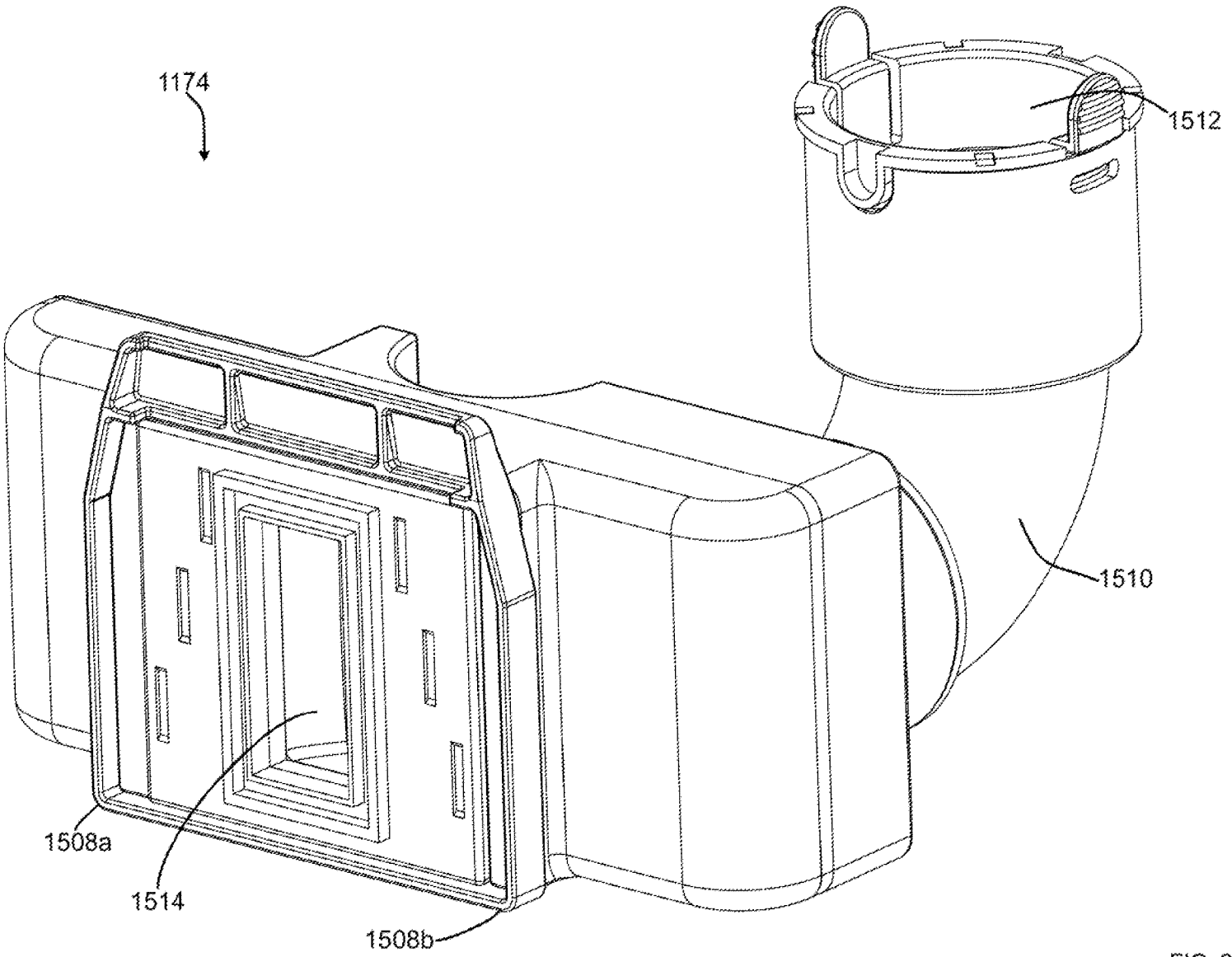
FIG. 27*a* is a front perspective view of a mounting member for the portable surface cleaning unit of FIGS. 24-27.

FIG. 27*a* shows an enlargement of mounting apparatus 1174 of support structure 104. As shown, mounting apparatus 1174 includes first and second wings 1508*a* and 1508*b*. Wings 1508*a* and 1508*b* may be sized and positioned to be removably receivable in recesses of mounting member 1502. In some examples, mounting apparatus 1174 may also provide a conduit 1510 for connecting surface cleaning unit 112 in air flow communication with hose 124. As shown, conduit 1510 includes an air inlet 1512 that may be connected, and optionally removably connected, to a downstream end of hose 124, and an air outlet 1514 that may be connected to surface cleaning unit 112 (e.g. when surface cleaning unit is mounted to mounted apparatus 1174).

In FIG. 24, an air flow pathway extends from upstream end 192 of wand 180 through wand 180 to downstream end 188 of wand 180, through hose 124 into surface cleaning unit 112 through cyclone bin assembly 136 and motor housing 132, and then to outlet 120. In some examples, wand 180 may be shaped so that it can be received within or in air flow communication with upper opening 1014 of upper pertien support structure 104. In these examples, when wand 180 is not in use it can be received within, and thereby stored within the support structure 104 or mounted to downstream end 1014 of support structure 104 (see for example FIGS. 25-27). For example, upstream portion 1002 of wand 180 may be received in downstream portion 1006 of support structure 104 such that outer walls 1022 of upstream portion 1022 and inner walls 1018 of downstream portion 1016 are in facing relationship. The air flow pathway may then extend from dirty air inlet 116 through surface cleaning head 108 to support structure 104, through air outlet 1074 into wand 180 and downstream to clean air outlet 120 as described above.

As shown, the apparatus 1500 may further include a handle 160 having a hand grip portion 182. Handle 160 may be drivingly connected to surface cleaning head 108, such as by way of support structure 104 and joint 168 for steering apparatus 1500. In some examples, wand 180 may be connected to handle 160, such as shown in FIG. 28. For example, upstream end 200 of handle 160 may be connected to downstream end 188 of wand 180.

Removable Cyclone

The following is a description of a removable cyclone that may be used by itself in any surface cleaning apparatus or in any combination or sub-combination with any other feature or features disclosed herein.

Figure 8:
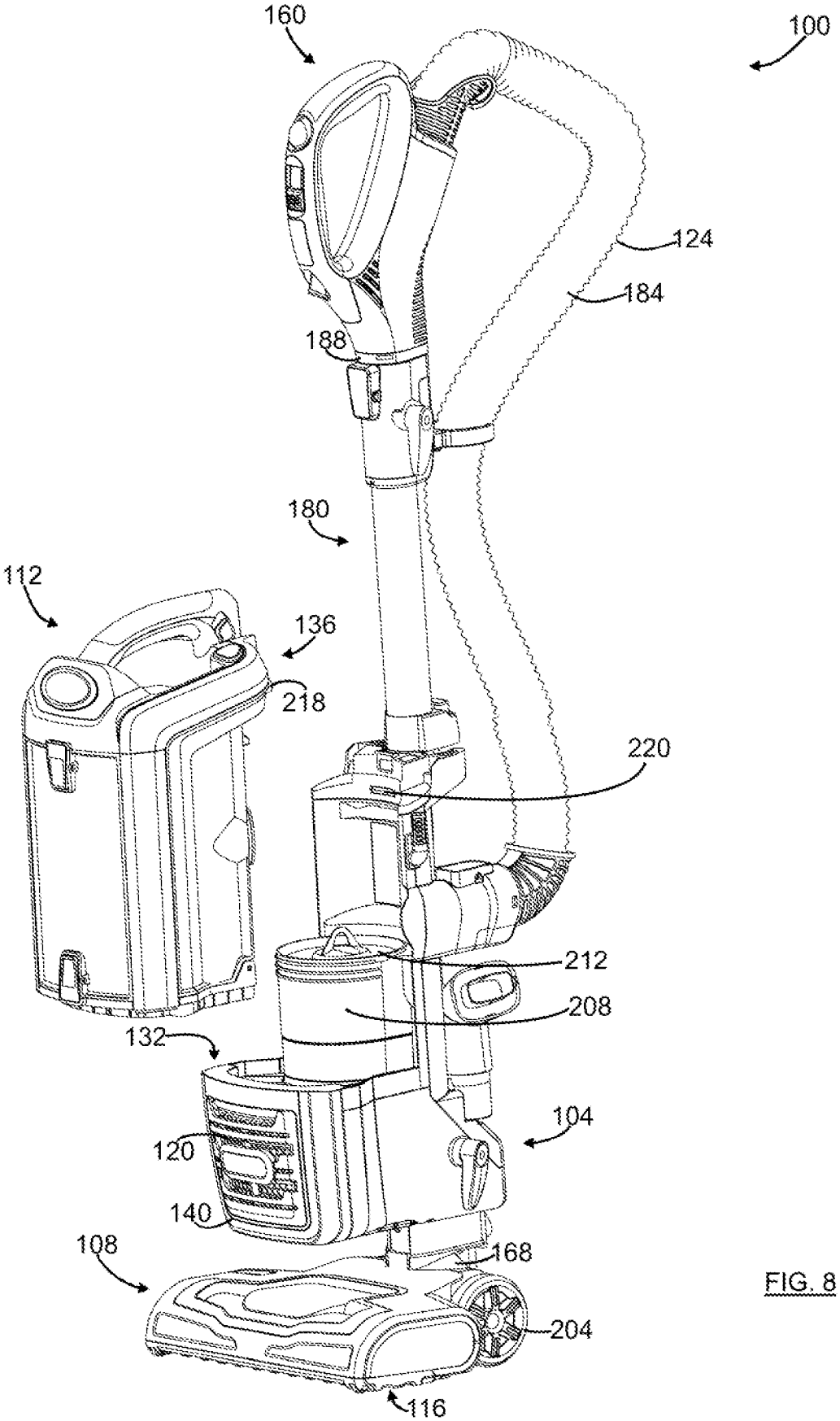
FIG. 8 is a front perspective view of the surface cleaning apparatus of FIG. 1 wherein the cyclone bin assembly has been removed.
Figure 9:
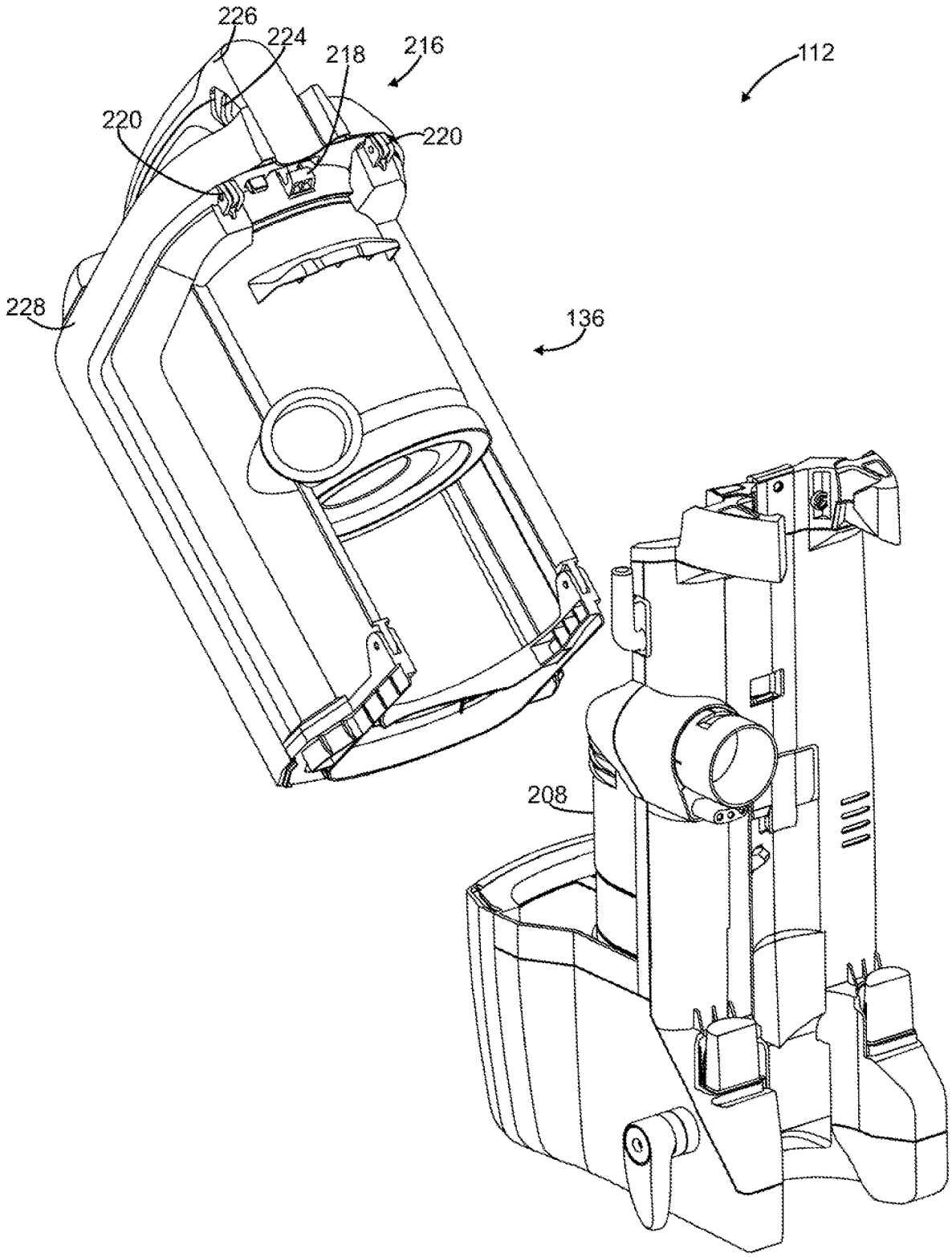
FIG. 9 is a rear perspective view of the portable surface cleaning unit with the cyclone bin assembly removed.

Reference is now made to FIGS. 8 and 9. Optionally, the cyclone bin assembly 136 may be detachable from the motor housing 132. Providing a detachable cyclone bin assembly 136 may allow a user to carry the cyclone bin assembly 136 to a garbage can for emptying, without needing to carry or move the rest of the surface cleaning apparatus 100 or the surface cleaning unit 112. Preferably, the cyclone bin assembly 136 can be separated from the motor housing 132 while the surface cleaning unit 112 is mounted on the upper portion 104 and also when the surface cleaning unit 112 is separated from the upper portion 104. FIG. 8 illustrates an embodiment where the cyclone bin assembly 136 is removable as a closed module, which may help prevent dirt and debris from spilling out of the cyclone bin assembly 136 during transport.

Optionally, as exemplified, removing the cyclone bin assembly 136 reveals a pre-motor filter chamber 208 that is positioned in the air flow path between the cyclone bin assembly 136 and the suction motor 128. One or more filters may be provided in the pre-motor filter chamber 208 to filter the air exiting the cyclone bin assembly 136 before it reaches the motor 128. In the illustrated example, the pre-motor filter includes at least a foam filter 212 positioned within the pre-motor filter chamber 208. Preferably, filter 212 is removable to allow a user to clean and/or replace the filter 212 when it is dirty. Optionally, part or all of the sidewalls of the pre-motor filter chamber or housing 208 can be at least partially transparent so that a user can visually inspect the condition of the filter 212 without having to remove the cyclone bin assembly 136.

In some embodiments, cyclone bin assembly 136 may extend below and partially surround pre-motor filter chamber 208. In the illustrated embodiment, cyclone bin assembly 136 includes a cyclone chamber 144 aligned above pre-motor filter chamber 208 and a dirt collection chamber 148 extending below and forward of pre-motor filter chamber 208. This may provide an enlarged dirt collection chamber 148 in a compact arrangement. In turn, the capacity of dirt collection chamber 148 may be increased which may permit surface cleaning apparatus 100 to be emptied less frequently. Still, in alternative embodiments, cyclone bin assembly 136 may be wholly positioned to one side of pre-motor filter chamber 208 (e.g. above pre-motor filter chamber 208).

Preferably, cyclone bin assembly 136 may be releasably connected to surface cleaning unit 112. For example, surface cleaning unit 112 may include a locking mechanism having a locked position, in which cyclone bin assembly 136 may be inhibited from separating from surface cleaning unit 112, and an unlocked position, in which cyclone bin assembly 136 may be freely removed from surface cleaning unit 112. As exemplified, cyclone bin assembly 136 includes a locking mechanism 216 for releasably securing cyclone bin assembly 136 to surface cleaning unit 112. In the example shown, locking mechanism 216 includes a locking member (or latch) 218 which may releasably engage a mating recess 220 in surface cleaning unit 112. Recess 220 may be sized and positioned to receive locking mechanism 216 when cyclone bin assembly 136 is positioned in place on surface cleaning unit 112. Locking mechanism 216 may interfere with the removal of cyclone bin assembly 136 from surface cleaning unit 112 by the interaction of locking member 218 with recess 220. For example, a groove provided on latch 218 may engage the wall in which recess 220 is located.

Locking mechanism 216 may also include a lock-release actuator 224 which may be activated to move locking mechanism 216 to the unlocked position. Preferably, lock-release actuator 224 may be located on or proximate to handle 226 of cyclone bin assembly 136 so it may be actuated by a user using the same had as is used to hold handle 226. This may permit a user to simultaneously grasp handle 226 and activate lock-release actuator 224. As exemplified, a rear portion of handle 226 includes a lock-release actuator 224. Activating lock-release actuator 224 may retract locking member 218 from recess 220 (e.g., by pivoting or rotating or translating latch 218 towards cyclone bin assembly 136) to place locking mechanism 216 in the unlocked position in which cyclone bin assembly 136 may be removed from surface cleaning unit 112.

Figure 10:
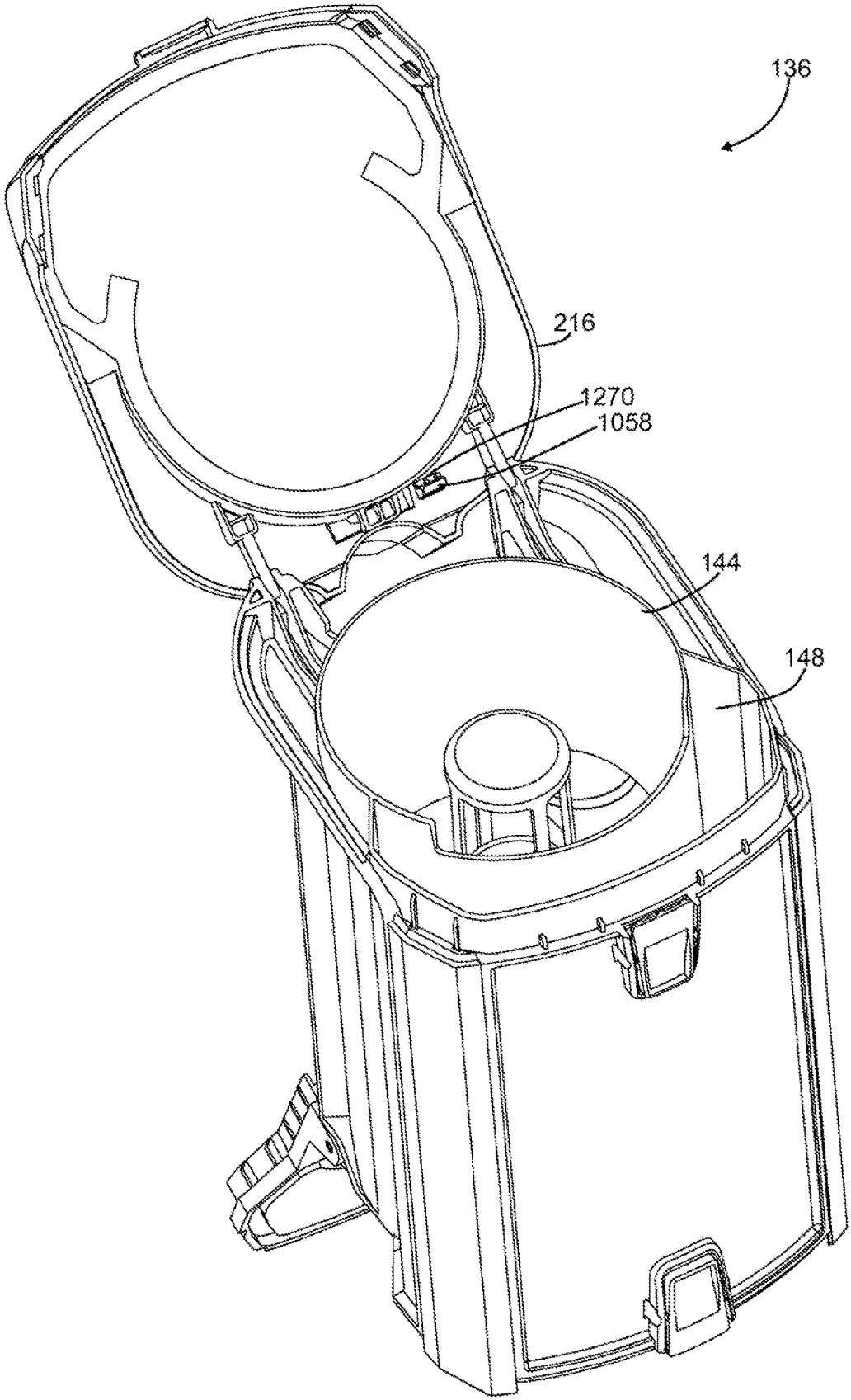
FIG. 10 is a front perspective view of a cyclone bin assembly with the lid in an open position.

Referring now to FIGS. 9 and 10, cyclone bin assembly 136 may include one or more of an openable lid or bottom. This may provide access to empty dirt collection chamber 148 and/or cyclone chamber 144. As exemplified, cyclone bin assembly 136 includes an openable lid 228. Lid 228 may be movable between a closed position (FIG. 9) in which lid 228 closes an upper end of cyclone bin assembly 136, and an open position (FIG. 10) in the upper end of cyclone bin assembly 136 is open.

Lid 228 of cyclone bin assembly 136 may be completely removed from cyclone bin assembly 136 in the open position. Alternatively, lid 228 may remain attached to cyclone bin assembly 136 in the open position. As exemplified, cyclone bin assembly 136 may include hinges 232 that pivotally connect lid 228 to cyclone bin assembly 136.

This may permit lid 228 to pivot to an open position while conveniently remaining connected to cyclone bin assembly 136.

Wand Alignment

The following is a description of the wand alignment mechanism to assist in aligning the wand during insertion of the wand into the upper portion that may be used by itself in any surface cleaning apparatus or in any combination or sub-combination with any other feature or features disclosed herein.

Referring to FIG. 5, wand 180 may be removably mounted to upper portion 104 using any suitable mounting apparatus. Wand 180 and upper portion 104 may be configured to provide support and/or positioning or alignment of the wand 180 relative to the upper portion 104. When connected to upper portion 104, wand 180 may be stabilized to provide a driving connection between wand 180 and upper portion 104.

In the example shown, upper portion 104 may be configured to receive an upstream end of wand 180 to connect wand 180 to upper portion 104. When inserted, the outer wall of wand 180 and the inner wall of upper portion 104 may contact each other over a sufficient length to stabilize wand 180 so that upper portion 104 may provide a driving connection between wand 180 and surface cleaning head 108. This may permit upper portion 104 to transmit forces applied to wand 180 (e.g. via handle 160 or directly to wand 180) to surface cleaning head 108 by way of, e.g., pivot joint 168. For example, upper portion 104 may be rigidly connected to wand 180 to reduce or eliminate play between upper portion 104 and wand 180. This may improve the handling of surface cleaning head 108 and thereby improve the user experience of apparatus 100.

Figure 11:
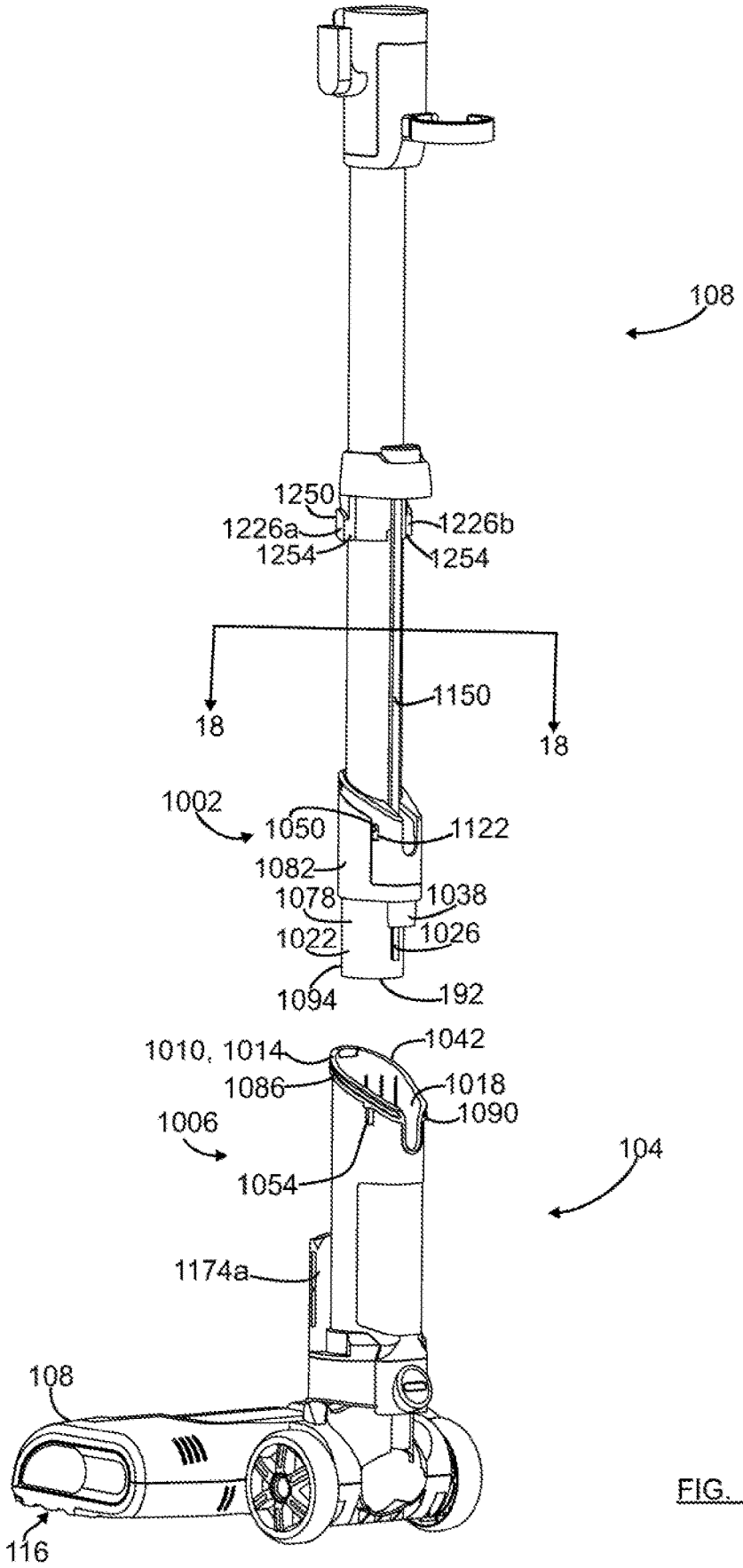
FIG. 11 is a rear perspective view of the above floor cleaning wand disconnected from an upper portion for use in above floor cleaning, the remaining parts have been removed for clarity.

Reference is now to FIG. 11. As exemplified, wand 180 includes an upstream portion 1002 bordered by upstream end 192. Upstream end 192 may define a wand air inlet for receiving dirty air to be communicated downstream through wand 180 to downstream end 188 (FIG. 5). Further, upper portion 104 is shown including a downstream portion 1006 bordered by downstream end 1010. As shown, downstream portion 1006 may include or surround an air outlet for discharging air received from surface cleaning head 108, downstream (e.g. to wand 180).For example, downstream portion 1006 may comprise a cowl that surrounds and extends upwardly from the outlet of an air flow path extending through the surface cleaning head 108.

Wand 180 may be sized and shaped to be partially received inside upper portion 104. As exemplified, upstream portion 1002 of wand 180 may be removably receivable inside downstream portion 1006 of upper portion 104. Downstream end 1010 of upper portion 104 may define an opening 1014 for receiving upstream end 192 of wand 180.

Figure 12:
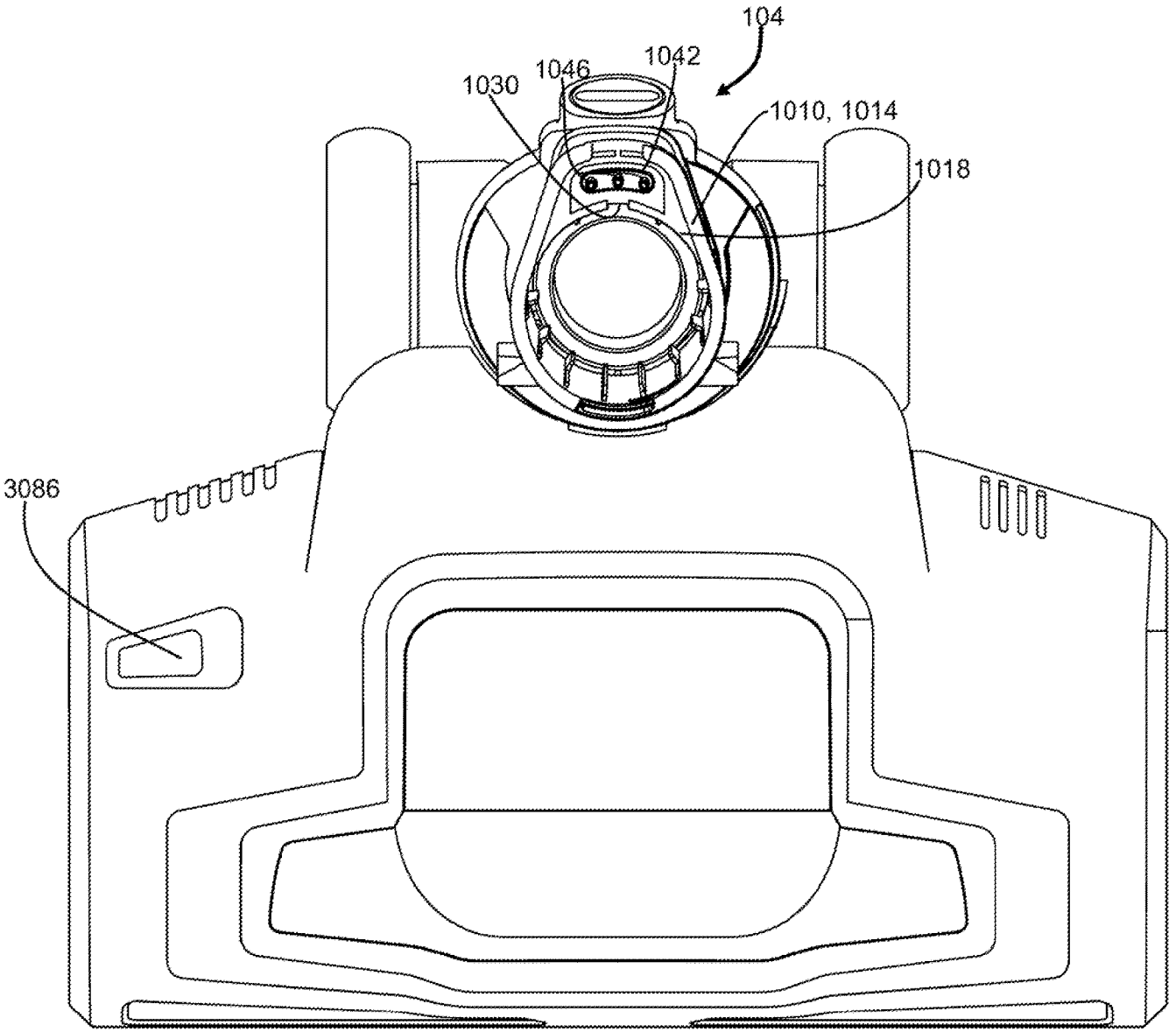
FIG. 12 is a top plan view of the upper portion and the surface cleaning head of FIG. 11.
Figure 13:
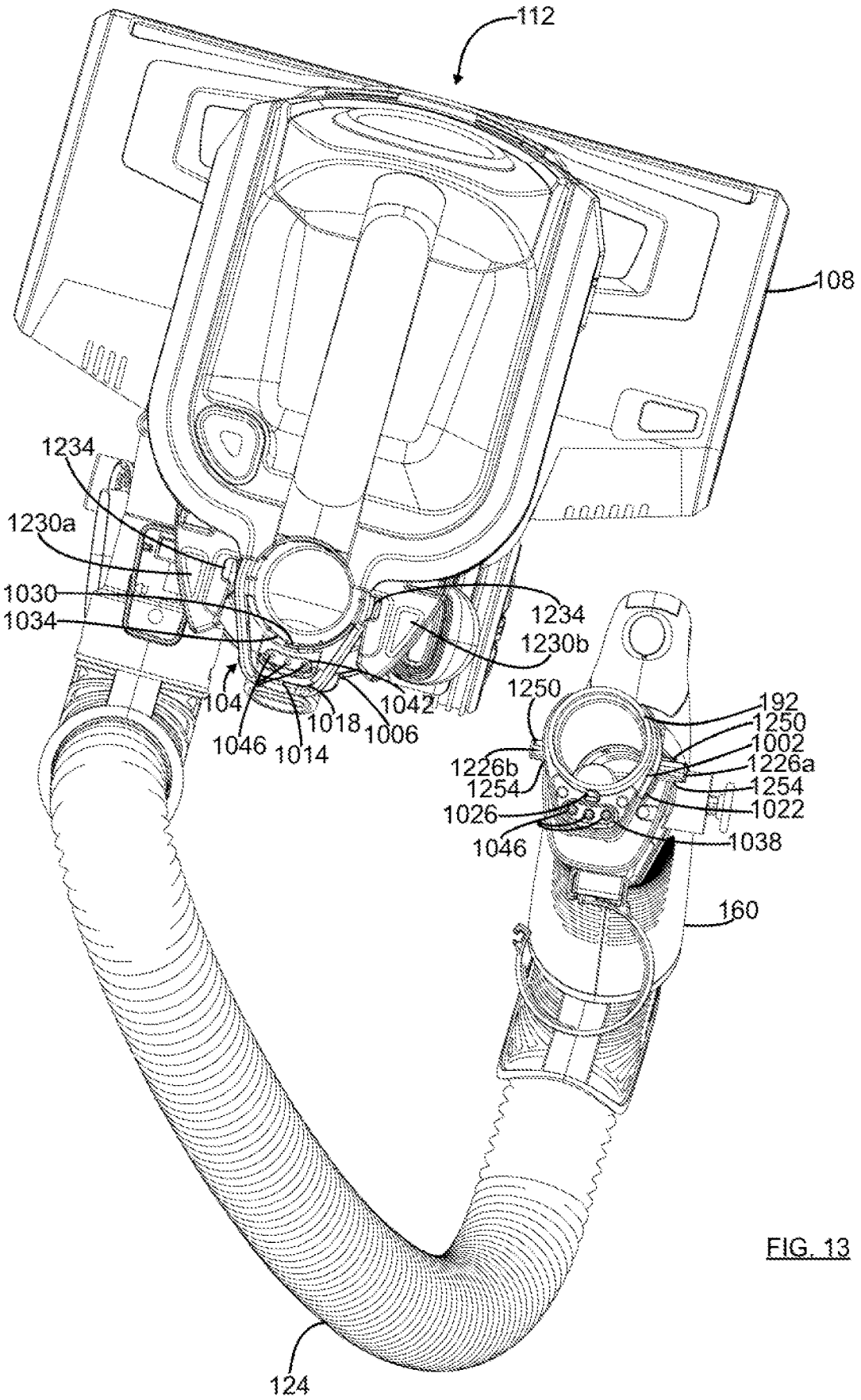
FIG. 13 is a top plan view of the surface cleaning apparatus of FIG. 1, with the above floor cleaning wand removed from the upper portion.

When wand 180 is received inside upper portion 104, wand 180 and upper portion 104 may form a connection that provides stability to wand 180. For example, mating elements of upper portion 104 and wand 180 may engage upon reception of wand 180 inside upper portion 104, whether automatically (i.e. without user action) by the insertion of wand 180 into upper portion 104 or by manual user-actuation of a retention member. Referring now to FIGS. 11-13, downstream portion 1006 may include inner walls 1018 having a transverse profile that corresponds to the transverse profile of outer walls 1022 of the upstream portion 1002 of wand 180. For example, the transverse profile of inner walls 1018 may have a substantially similar size and shape as the transverse profile of the outer walls 1022. Preferably, the transverse profile of outer walls 1022 is slightly smaller than the transverse profile of inner walls 1018 to provide a sufficient clearance to permit insertion and removal of wand 180 without play when want 180 is inserted into upper portion 104. This may permit upstream portion 1002 to be easily inserted into downstream portion 1006.

The transverse profile of inner walls 1018 and outer walls 1022 may have any suitable shape. For example, the transverse profiles may be circular, triangular, square or another regular or irregular shape. Preferably, the transverse profiles have a non-circular or irregular shape such that outer walls 1022 may fit between inner walls 1018 in only one orientation. This may force wand 180 to be specifically oriented with respect to upper portion 104 (e.g. to provide an intended orientation of handle 160 to surface cleaning head 108). In the example shown, the transverse profiles of inner walls 1018 and outer walls 1022 may be described as "egg-shaped". That is, the transverse profiles are generally rounded and taper in width from one side to the other.

Alternatively, or in addition to the correspondence in transverse profiles of inner and outer walls 1018 and 1022, wand 180 and upper portion 104 may include mating elements that limit the number of orientations in which upstream portion 1002 may be received in downstream portion 1006. For example, wand 180 and upper portion 104 may collectively include one or more mating protrusions and recesses.

In the example shown, wand 180 includes a protrusion (or key) 1026 in upstream portion 1002 that protrudes outwardly along outer wall 1022. Protrusion 1026 is configured to mate with (i.e. insert into) recess (or slot) 1030 formed in a lip 1034 of inner walls 1018 when upstream portion 1002 is received in downstream portion 1006. When wand 180 is correctly oriented with respect to upper portion 104, key 1026 will align with slot 1030 to allow upstream portion 1002 to be inserted into downstream portion 1006. However, lip 1034 of downstream portion 1006 will interfere with key 1026 if attempting to insert upstream portion 1002 into downstream portion 1006 while wand 180 is incorrectly oriented with respect to upper portion 104 such that key 1026 is misaligned with slot 1030.

Connecting wand 180 to upper portion 104 extends the airflow pathway from wand 180 upstream through surface cleaning head 108. The connection may also connect one or more other mechanical elements, such as locking members or linkages, and/or electrical elements, such as electrical power connectors. In this case, there may be limited relative orientations between wand 180 and upper portion 104 which completes the airflow, mechanical and/or electrical connections. For this reason, it may be advantageous to limit the orientations in which the upstream portion 1002 can be received in downstream portion 1006, preferably to a single orientation.

In the example shown, hose 124 is electrified and comprises part of a circuit extending from surface cleaning unit 112 to surface cleaning head. Accordingly, surface cleaning unit 112 may be provided with the electrical cord or an on board power source and an electrical component in the surface cleaning head 108 may be powered via the hose 124 and wand 180. Accordingly, wand 180 may provide an electrified air flow conduit for conducting electricity along the length of wand 180. As exemplified, upstream portion 1002 of wand 180 includes an electrical connector 1038, and downstream portion 1006 of upper portion 104 includes a mating electrical connector 1042. Electrical connectors 1038 and 1042 may be any suitable mating electrical connectors, such as for example a male connector (or plug) and a female connector (or jack). Further, electrical connectors 1038 and 1042 may connect any number of electrical conductors (e.g. from 1 to 100 conductors). As exemplified, each of connectors 1038 and 1042 connects three electrical conductors 1046. Upstream and downstream portions 1002 and 1006 may each include any number of mating electrical connectors, each of which may connect different electrical conductors.

In some cases, electrical connectors 1038 and 1042 may be somewhat fragile. For example, electrical connectors 1038 and 1042 may suffer damage if subjected to certain stresses. In one aspect, the stability provided by upper portion 104 to wand 180 may advantageously reduce stresses on electrical connectors 1038 and 1042. For example, mating elements of upper portion 104 and wand 180, other than electrical connectors 1038 and 1042 (such as key 1026 and slot 1030, and/or the corresponding transverse profiles of walls 1018 and 1022) may provide stability (such as resistance to relative rotational movement between wand 180 and upper portion 104) which might otherwise be borne by electrical connectors 1042 and 1046.

Preferably, once wand 180 is connected to upper portion 104, wand 180 remains connected to upper portion 104 until wand 180 is selectively disconnected from upper portion 104. For example, the connection between wand 180 and upper portion 104 may be maintained by friction which may be overcome by sufficient force, or may be maintained by one or more retentive elements which may be selectively disengaged. Wand 180 may include a locking mechanism that automatically engages downstream portion 1006 when upstream portion 1002 is inserted into downstream portion 1006. When the locking mechanism is engaged with downstream portion 1006, upstream portion 1002 cannot be withdrawn from downstream portion 1006 unless the locking mechanism is unlocked. This may prevent the wand from 180 from disconnecting from upper portion 104 while wand is used to maneuver surface cleaning head 108, for example.

Reference is now made to FIG. 11. As exemplified, wand 180 includes a locking member 1050 and upper portion 104 includes an opening 1054. Locking member 1050 may be sized and positioned to automatically project through opening 1054 after upstream portion 1002 is properly inserted into downstream portion 1006. Thereafter, upstream portion 1002 cannot be disconnected from downstream portion 1006 without withdrawing locking member 1050 from opening 1054. An actuator, e.g. button 1058, is provided to selectively withdraw locking member 1050 from opening 1054, and permit upstream portion 1002 to be freely separated from downstream portion 1006.

Optionally, wand 180 may remain connected with upper portion 104 even while the connection is unlocked. For example, if upstream portion 1002 is received in downstream portion 1006, then the contact between wand 180 and upper portion 104 may retain wand 180 in upper portion 104 even while the locking mechanism for locking the connection is unlocked. In this circumstance, upper portion 104 may be configured to support wand 180 in an upright position. This may permit a user to release control of wand 180 while unlocking the locking mechanism, without the risk of wand 180 toppling over. As exemplified, downstream portion 1006 of upper portion 104 surrounds upstream portion 1002 of wand 180 when upstream portion 1002 is received in downstream portion 1006. Preferably, upper portion 104 surrounds a sufficient height of wand 180 to provide support to wand 180 to rest in the upright position. For example, upper portion 104 may surround any portion of the wand and may surround the entire wand. As exemplified, upper portion may surround between 10 percent and 30 percent of the total height of wand 180 (measured from upstream end 192 to downstream end 188), and more preferably about 20 percent of the total height of wand 180.

Figure 4:
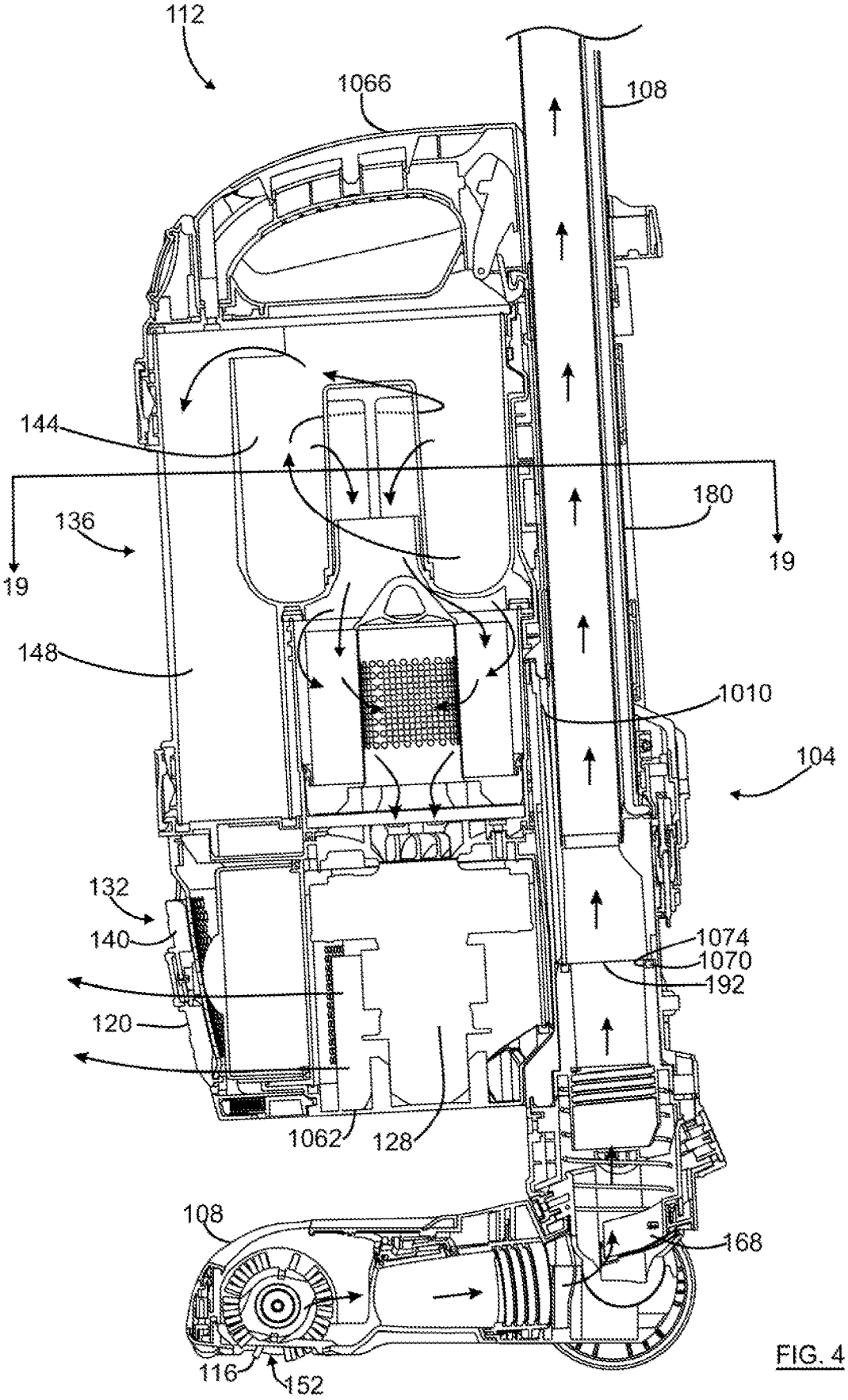
FIG. 4 is a partial cross-sectional view taken along line 4-4 in FIG. 1.

Referring now to FIG. 4, wand 180 and surface cleaning unit 112 are shown connected to upper portion 104. As shown, downstream end 1010 of upper portion 104 extends well above upstream end 192 of wand 180. As exemplified, upstream end 192 is positioned proximate a lower end 1062 of surface cleaning unit 112 and well below upper end 1066 of surface cleaning unit 112 (when both surface cleaning unit 112 and wand 180 are connected to upper portion 104). It will be appreciated that upstream end 192 may seat against or in the outlet end of pivot joint 168.

When wand 180 is connected to upper portion 104, the airflow pathway may extend from dirty air inlet 116 through surface cleaning head 108, through pivot joint 168, optionally through upper portion 104 if upstream end 192 is positioned above the outlet end of pivot joint 168, and into wand 180. Preferably, at least the portion of the airflow pathway extending between surface cleaning head 108 and wand 180 is substantially air-tight to preserve the suction generated by suction motor 128. Optionally, a bleed valve (not shown) may be provided to reduce suction for cleaning certain cleaning surfaces. In some embodiments, wand 180 may form an airtight seal with the airflow passage when connected to upper portion 104. As exemplified, upstream end 192 of wand 180 may be urged against a seal 1070 (e.g. O-ring) surrounding air outlet 1074 of upper portion 104 when wand 180 is connected to upper portion 104. Seal 1070 may prevent entry or escape of air through the interface between wand 180 and upper portion 104.

Reference is now made to FIG. 11. As exemplified, lower portion 1002 of wand 180 has a transverse cross-section that is sized and shaped to form a tight fit inside downstream portion 1006 of upper portion 104. In some cases, it may be difficult for a user to insert one element into another where the fit between those elements is tight. For example, precise alignment requiring fine motor skills may be required for those elements to be connected. In some embodiments, wand 180 and/or upper portion 104 may be configured to make inserting wand 180 into upper portion 104 easier and faster.

In the example shown, upstream portion 1002 of wand 180 includes a lower section 1078, and an upper section 1082. Lower section 1078 is bordered by upstream end 192, and upper section 1082 is downstream of lower section 1078. The transverse section of upper section 1082 may be sized and shaped to provide a tight fit with downstream portion 1006 of upper portion 104. At the same time, lower section 1078 may have a substantially smaller transverse section, which may provide a greater margin for alignment error when firstly inserting lower section 1078 into opening 1014. Accordingly, a user may insert upstream end 192 into upper portion 104. This is facilitated by the clearance between the facing walls of upstream end 192 and upper portion 104. Some or all of the weight of the wand 18-0 may then be supported by upper portion 104. The user may then rotate wand 180 to the required insertion orientation and complete the insertion of wand 180 into upper portion 104 by inserting part or all of upper section 1082. The stepwise insertion of a narrower lower section 1078 into upper portion 104 followed by a wider upper section 1082 may make inserting upstream portion 1002 into upper portion 104 easier for a user. Once lower section 1078 is inserted into opening 1014, lateral movements of wand 180 are substantially constrained, by the interaction of lower section 1078 with inner walls 1018, to positions that are in close proximity to the comparatively narrower range of positions that will allow upper section 1082 to pass through opening 1014 into downstream portion 1006. Such constraint may make finding the correct position faster and easier for a user because the constraint increases the proportion of available positions that will allow upper section 1082 to enter downstream portion 1006.

Alternatively, or in addition to a narrower lower section 1078, downstream end 1010 of upper portion 104 at opening 1014 may be transversely inclined (or "sloped"). As shown, a front side 1086 of opening 1014 extends higher (i.e. further downstream) than the rear side 1090. This may permit a user to more easily locate upstream portion 1002 into opening 1014. In use, the user may simply move front side 1094 of upstream portion 1002 against front side 1086 of opening 1014 to align upstream portion 1002 with opening 1014, and then move upstream portion 1002 downwardly through the remainder of opening 1014. In this way, front side 1086 of opening 1014 may act as a guide for directing upstream portion 1002 downwardly into the remainder of opening 1014. This may be easier to perform than having to maneuver upstream portion 1002 through a transversely uninclined (i.e. horizontal) opening, since such an opening forms a complete periphery at its uppermost edge. If upstream portion 1002 includes a narrower lower section 1078, then preferably, lower and upper sections 1078 and 1082 may be flush along front side 1094 to permit upstream portion 1002 to slide downwardly through opening 1014, as described above, without interference by an overhanging lip of upper section 1082.

Figure 14:
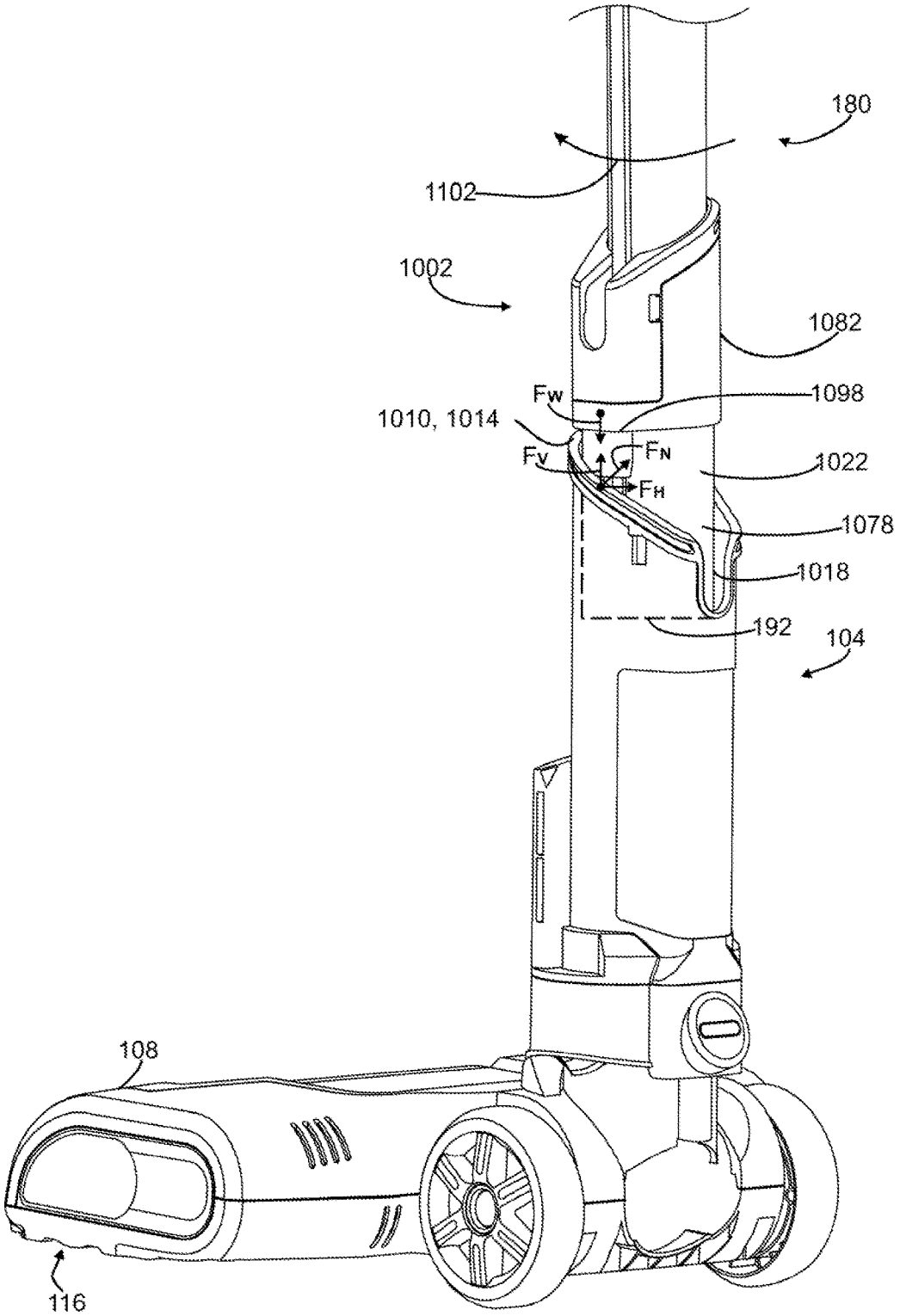
FIG. 14 is a rear perspective view of the above floor cleaning wand partially removed from the upper portion.

Reference is now made to FIG. 14. Alternately, or in addition, sloped opening 1014 may help to correct for rotational misalignment of wand 180 with respect to upper portion 104. After at least partially inserting lower section 1078 of upstream portion 1002 of wand 180 through opening 1014 of upper portion 104, if wand 180 is not properly oriented in rotation (i.e. rotationally misaligned) with opening 1014, then a lip 1098 of upper section 1082 may contact downstream end 1010 at opening 1014. In this case, the downward force Fw of wand 180, whether gravity or user applied to the point of contact between lip 1098 and downstream end 1010, is met with a reactionary force FN by sloped downstream end 1010. As shown, reactionary force FN includes a vertical component of force FV in opposition to downward for FW in addition to a horizontal component of force FH. The horizontal component of force FH urges the wand 180 to rotate back into alignment. For example, if wand 180 is rotated out of alignment in the clockwise direction 1102 then the component of force FH urges the wand 180 to rotate counter-clockwise into alignment. In this way, sloped opening 1014 interacts with upper section 1082 of upstream portion 1002 to urge wand 180 into proper alignment for insertion into opening 1014.

Wand Locking Mechanism

The following is a description of the wand locking mechanism that may be used by itself in any surface cleaning apparatus or in any combination or sub-combination with any other feature or features disclosed herein.

Reference is now made to FIG. 11. Preferably, once wand 180 is connected to upper portion 104, wand 180 remains connected to upper portion 104 until wand 180 is selectively disconnected from upper portion 104. The connection between wand 180 and upper portion 104 may be maintained by one or more retentive elements of a locking mechanism, which may be selectively disengaged. When the locking mechanism is engaged, upstream portion 1002 cannot be withdrawn from downstream portion 1006 unless the locking mechanism is unlocked. This may prevent the wand from 180 from disconnecting from upper portion 104 while wand 180 is used to maneuver surface cleaning head 108, for example.

Figure 22:
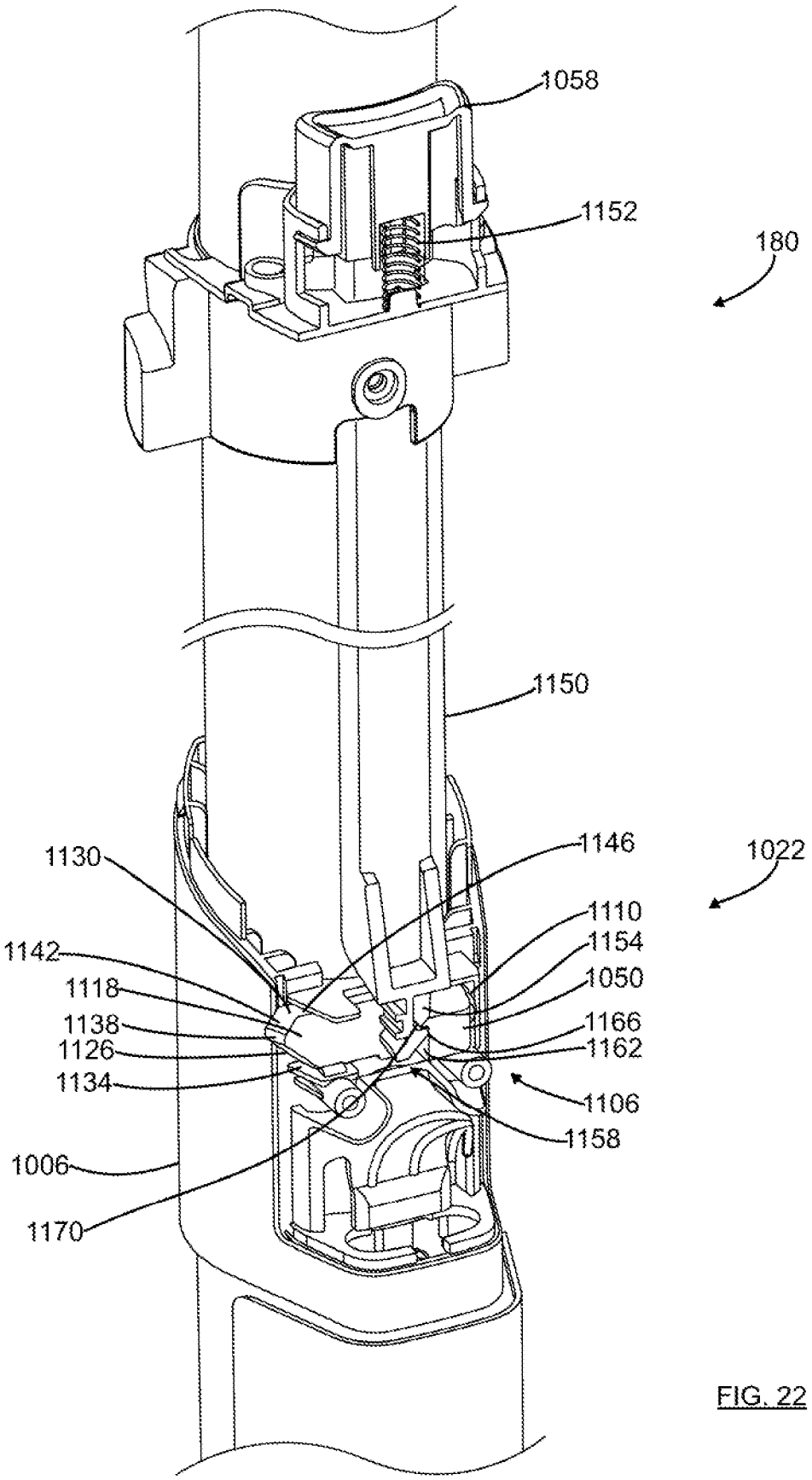
FIG. 22 is a partial rear sectional perspective view of the wand of FIG. 11.

Reference is now made to FIGS. 11 and 22. FIG. 22 shows a partial view of wand 180 including upstream portion 1002 with outer wall 1022 removed to expose the inner locking mechanism (or "wand lock") 1106. Wand lock 1106 may include a locking member that releasably engages upper portion 104 to selectively secure wand 180 to upper portion 104 in a locked position. As exemplified, wand lock 1106 includes a plunger 1050 which may extend through opening 1054 of downstream portion 1006 to obstruct the withdrawal of upstream portion 1002 from downstream portion 1006. Further, plunger 1050 may be retractable to withdraw from opening 1054 and cease obstructing the withdrawal of upstream portion 1002 from downstream portion 1006.

Figure 23A:
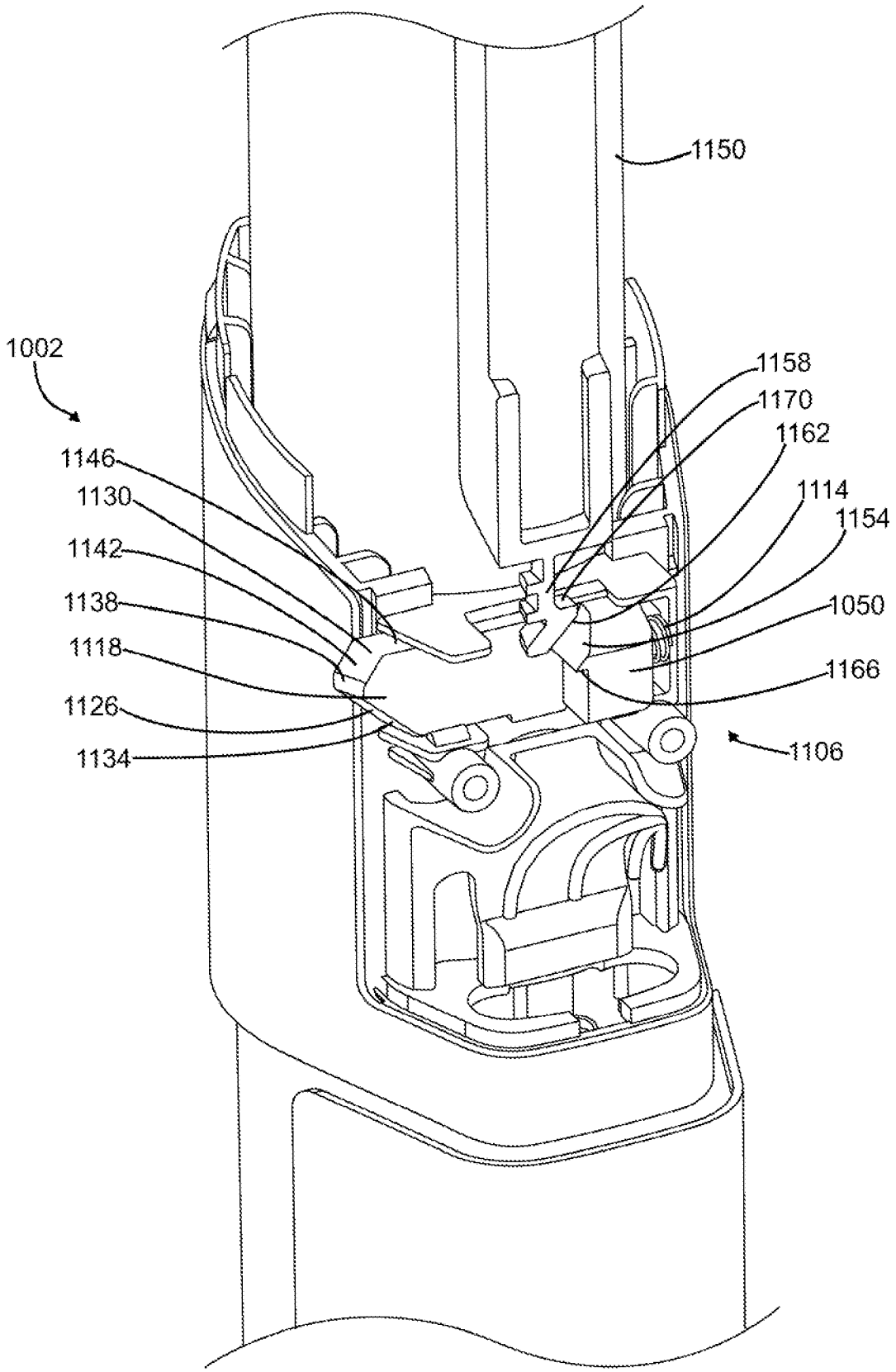
FIGS. 23*a*-23*d* are partial rear perspective views of the wand of FIG. 11 with an outer wall removed.

As exemplified, plunger 1050 is positioned in a slot 1110 for translation between an extended position (shown), and a retracted position. A resilient member, such as spring 1114 (FIG. 23*a*) may act upon plunger 1050 to bias plunger 1050 toward the extended or locked position. In the extended position, an end portion 1118 of plunger 1050 protrudes from slot 1110 through an opening 1122 in outer wall 1022. In the retracted position, end portion 1118 of plunger 1050 is at least partially withdrawn back into slot 1110.

Preferably, wand lock 1106 is configured to automatically lock wand 180 to upper portion 104, upon insertion of wand 180 into upper portion 104. For example, the locking member of wand lock 1106 may automatically engage upper portion 104 upon the insertion of upstream portion 1002 into downstream portion 1006, thereby securing wand 180 to upper portion 104. In some cases, the locking member may translate laterally (i.e. substantially perpendicularly to the airflow path) to releasably engage the upper portion 104. As exemplified, plunger 1050 may automatically translate (or "extend") laterally outwardly through opening 1054 in downstream portion 1006 upon the insertion of upstream portion 1002 into downstream portion 1006, without requiring further user action.

In the example shown, end portion 1118 of plunger 1050 includes a lower side 1126 and an opposite upper side 1130. Lower side 1126 includes a sloped face 1134. First, plunger 1050 may be in the extended position while upstream portion 1002 is withdrawn from downstream portion 1006. In the extended position, end portion 1118 including sloped face 1134 of lower side 1126 may protrude through opening 1122. When inserting upstream portion 1002 into downstream portion 1006, sloped face 1134 of lower side 1126 may make contact with downstream end 1010 at opening 1014 during insertion. For example, there may be less space between outer and inner walls 1022 and 1018 than the distance by which end portion 1118 protrudes through opening 1122 in the extended position. Downstream end 1010 may cam along sloped face 1134 forcing plunger 1050 to retract against the bias of spring 1114 until tip 1138 of plunger 1050 meets inner walls 1018. Upon further insertion, plunger 1050 may align with opening 1054 and translate laterally under the bias of spring 1114 through opening 1054.

When plunger 1050 is in the extended position and extending through opening 1054, wand 180 may not be withdrawn from upper portion 104 without first at least partially retracting plunger 1050. As exemplified, plunger 1050 includes an upper side 1130. Upper side 1130 is shown including a sloped outboard face 1142 bordered by tip 1138, and an unsloped (or less sloped) inboard face 1146 inboard of outboard face 1142. Preferably, at least a portion of inboard face 1146 projects through opening 1054 in the extended position. In this case, inboard face 1146 may contact an upper wall of opening 1054 if upstream portion 1002 is attempted to be withdrawn from downstream portion 1006 without first retracting plunger 1050. In turn, the slope of inboard face 1146 (or lack thereof) may be insufficient for the upper wall of opening 1054 to cam along inboard face 1146 to withdraw plunger 1050. Accordingly, upstream portion 1002 cannot be withdrawn from downstream portion 1006; wand lock 1106 is in the locked (or "engaged") position.

Wand lock 1106 may be unlocked by a mechanical, electrical, or electromechanical device in response to a user action. For example, wand lock 1106 may include a wand release actuator which operates to unlock wand lock 1106. When wand lock 1106 is in the unlocked position, wand 180 may be freely removable from upper portion 104.

As exemplified, upper portion 104 may terminate well below waist height. For example, upper portion may be 12-14 inches tall. An advantage of a shorter upper member is that it facilitates the insertion of wand 180 into upper portion 104. In order to avoid a user having to bend over to release wand 180 while enabling wand 180 to be locked to upper portion 104, an actuator 1058 may be provided at a height which may be actuated by a user while standing upright. An actuator, such as button 1058, may be drivingly connected to lock 1106 by a longitudinally extending member, such as shaft 1150. The actuator and shaft, as well as the linking member, may be provided as part of, and removable with, wand 180. Accordingly, by incorporating the lock and actuator into wand 180, upper portion 104 may be shorter.

For example, in the embodiment of FIG. 22, wand lock 1106 includes a longitudinally extending transmission member that drivingly connects the wand release actuator and the locking member. For example, the transmission member may be translatable downwardly to move the wand lock 1106 into the unlocked position. Moving the transmission member downwardly may cause the locking member to move laterally to a disengaged position, and set the wand lock 1106 in the unlocked position.

Figure 23B:
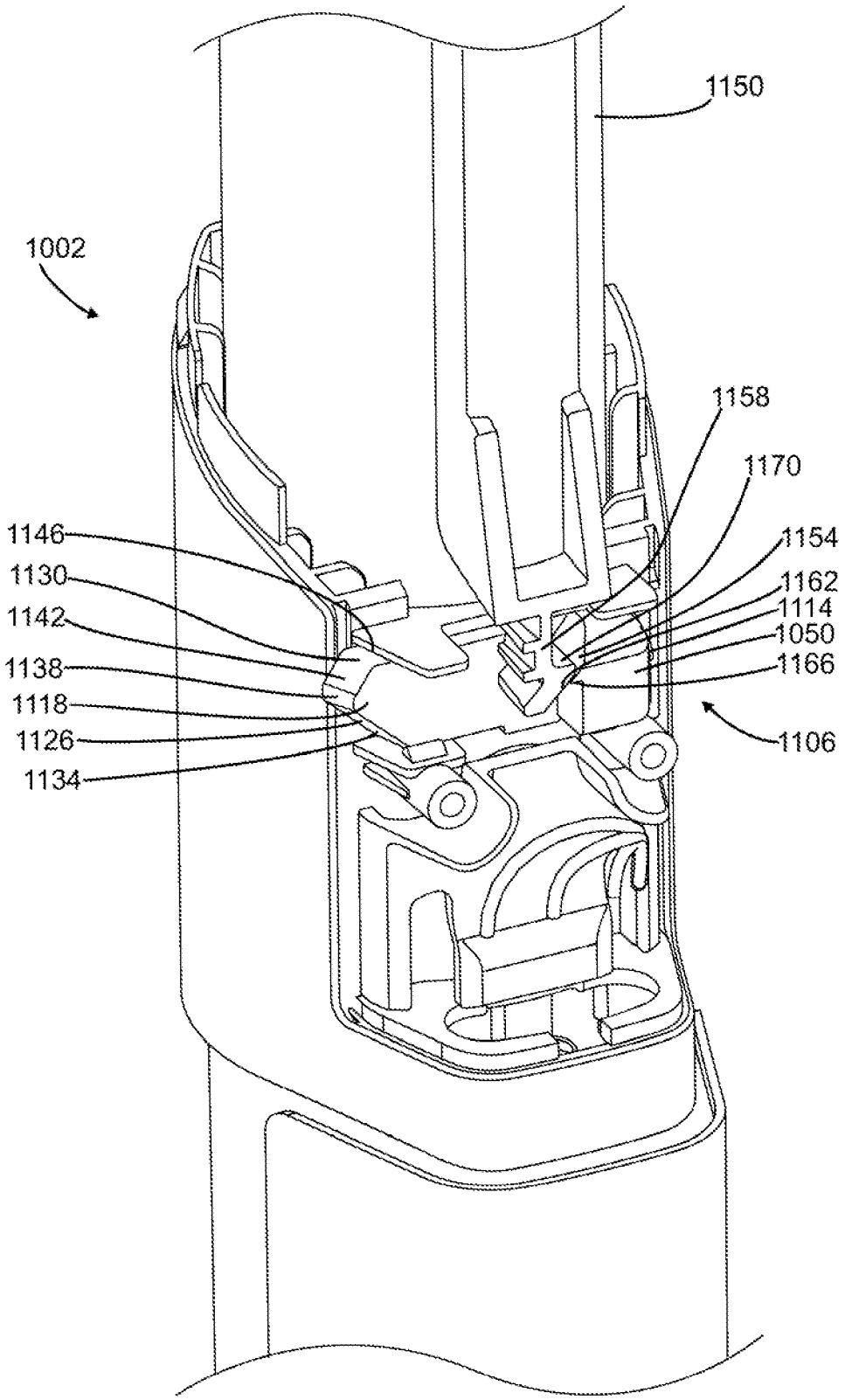

In the example shown, a button 1058 is mounted to wand 180 that drives a shaft 1150 to translate toward plunger 1050. A biasing member, such as spring 1152 may bias shaft 1150 upwardly into a retracted position. Shaft 1150 may interact with plunger 1050 to move plunger 1050 into a retracted position, and thereby permit the upper wall of opening 1054 to clear at least inboard face 1146 (i.e. to engage with sloped outboard face 1142 instead, or to clear plunger 1050 altogether). As exemplified, plunger 1050 includes an upwardly-facing face 1154, and shaft 1150 includes a lower portion 1158 including a downwardly-facing face 1162. Faces 1154 and 1162 may be positioned to meet when shaft 1150 is translated downwardly toward plunger 1050 (as shown in FIG. 23*b* when button is partially pressed to move the lock to the unlocked position). Faces 1154 and 1162 may be shaped to provide a caming action that retracts plunger 1050 against the bias of spring 1114 as shaft 1150 is further translated toward plunger 1050. In the example shown, each of faces 1154 and 1162 are correspondingly sloped. As shaft 1150 is translated downwardly, face 1158 of shaft 1150 cams along face 1154 of plunger 1050 causing plunger 1050 to retract to the retracted position. In the retracted position, the upstream portion 1002 may be withdrawn from downstream portion 1006; the wand lock is unlocked (or "disengaged"). The upper wall of opening 1054 may be able to clear at least inboard face 1146 which was preventing the withdrawal in the locked condition.

Figure 23C:
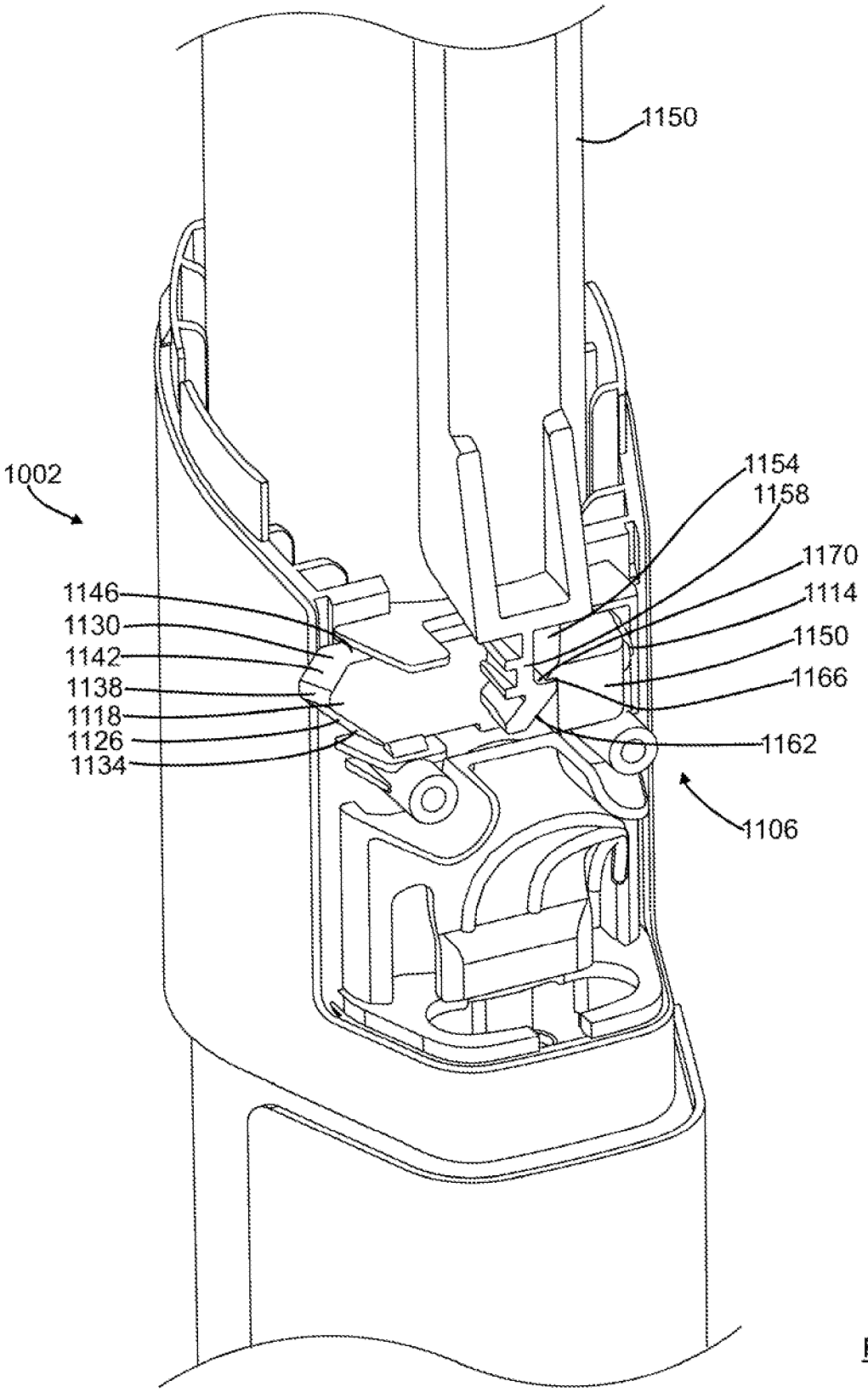

Preferably, wand lock 1106 may remain in the unlocked (or "disengaged") position after button 1058 is released. This may permit a user to use the same hand to activate button 1058 (unlocking wand 180) and to subsequently remove wand 180 from upper portion 104. In the example shown, shaft 1150 may be biased (e.g. by a resilient element such as spring 1152) upwardly. When plunger 1050 is in the retracted position, shaft 1150 may obstruct plunger 1050 from extending under the bias of spring 1114, and plunger 1050 may obstruct shaft 1150 from retracting upwardly. As exemplified, plunger 1050 includes a lip 1166 below face 1154, and shaft 1150 includes a lip 1170 above face 1162. Further, lower face 1162 may move past upper face 1154 during downward translation of shaft 1150. When this occurs, plunger 1050 translates laterally outwardly a short distance moving lips 1166 and 1170 into contact. The contact between lips 1166 and 1170 prevents shaft 1150 from withdrawing upwardly. Further, the position of lower portion 1158 in front of plunger 1050 obstructs plunger 1050 (as shown in FIG. 23*c*) from further translation toward the extended position. Accordingly, the lock is maintained in the unlocked position.

Figure 23D:
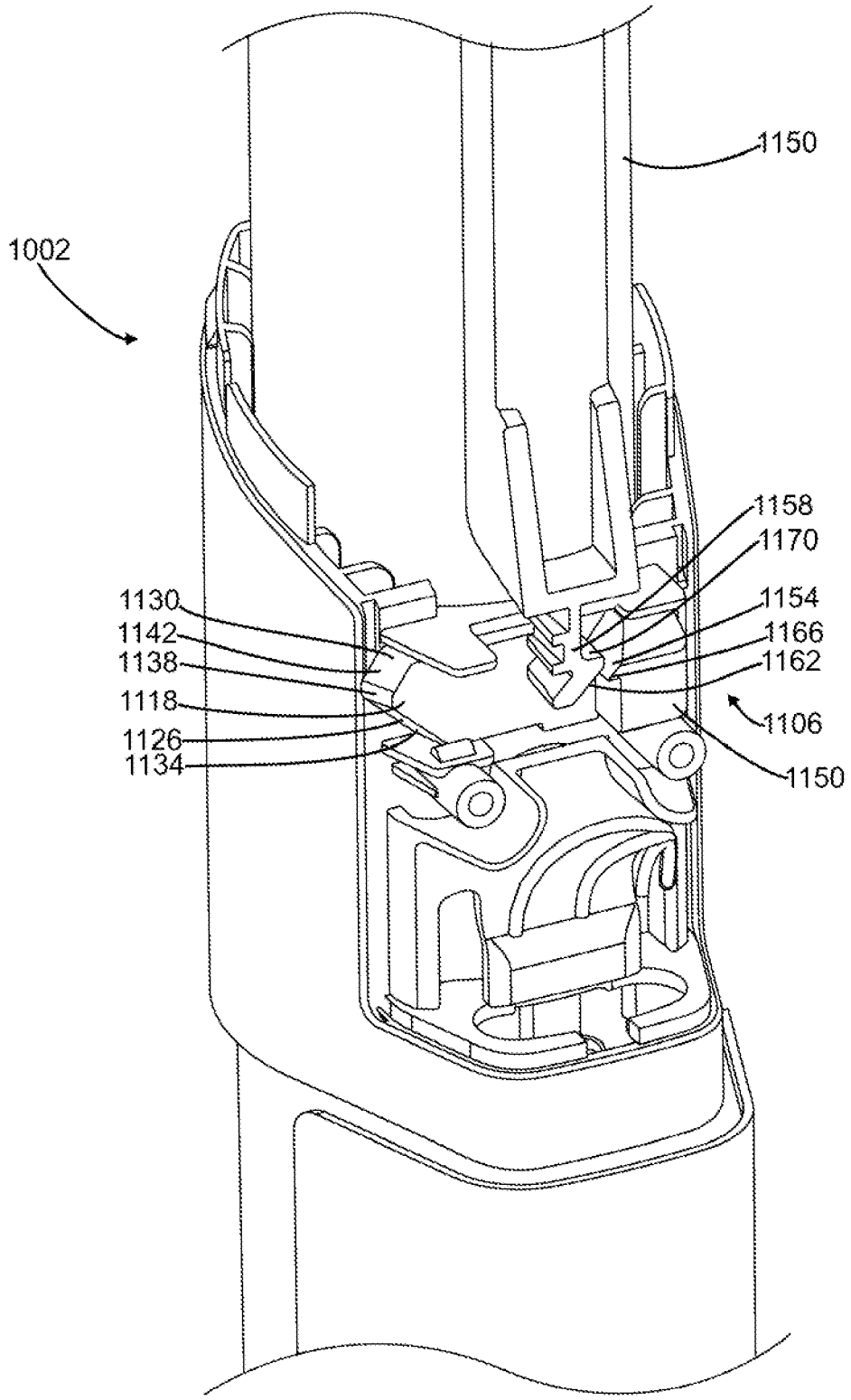

Preferably, wand lock 1106 may be freed from maintaining the unlocked position upon removing and/or reinserting wand 180 into upper portion 104. For example, shaft 1150 and plunger 1050 may be disentangled upon the withdrawal or reinsertion of upstream portion 1002 out of or into downstream portion 1006. As exemplified, sloped outboard face 1142 and a portion of sloped lower face 1134 of plunger 1050 may protrude outwardly through opening 1122 in upstream portion 1002, when plunger 1050 is in the retracted position. This may permit the upper wall of opening 1054 to cam sloped outboard face 1142 during withdrawal of upstream portion 1002 from downstream portion 1006 to further retract plunger 1050. This moves lip 1166 of plunger 1050 out of contact with lip 1170 of shaft 1150 (as shown in FIG. 23*d*), allowing shaft 1150 to retract upwardly. After plunger 1050 clears the downstream end 1010 of upper portion 104, plunger 1050 may extend under the bias of spring 1114 to the extended position.

Wand lock 1106 may also be maintained in the unlocked position while wand 180 is removed from upper portion 104. For example, button 1058 may be depressed to retract plunger 1050 and entangle shaft 1150 with plunger 1050 while wand 180 is removed from upper portion 104. In this case, reinserting wand 180 into upper portion 104 may release wand lock from the unlocked position. As exemplified, a portion of sloped lower face 1134 of plunger 1050 may protrude outwardly through opening 1122 in upstream portion 1002, when plunger 1050 is in the retracted position. This may permit the downstream end 1010 at opening 1014 to cam sloped lower face 1134 during insertion of upstream portion 1002 into downstream portion 1006 to further retract plunger 1050. This moves lip 1166 of plunger 1050 out of contact with lip 1170 of shaft 1150 (as shown in FIG. 23*d*), allowing shaft 1150 to retract upwardly. Once plunger 1050 aligns with opening 1054 in downstream portion 1006, plunger 1050 may translate laterally outwardly under the bias of spring 1114 to the extended position.

Wand Lock Release Actuator

The following is a description of the wand lock release actuator that may be used by itself in any surface cleaning apparatus or in any combination or sub-combination with any other feature or features disclosed herein.

In some embodiments, the locking mechanism (e.g. wand lock 1106) that prevents wand 180 from being separated from upper portion 104 after they are connected, may be released by a wand lock release actuator. The actuator may have a mechanical, electrical, or electromechanical connection to the wand lock. Preferably, the actuator may be positioned remotely from upper portion 104 at a position above upper portion 104 toward handle 160 (FIG. 5). For example, the actuator may be positioned above upper portion 104 on wand 180 or on handle 160. In some cases, the actuator may be positioned between a user's knee height and chest height, and more preferably between a user's thigh height and waist height. This may reduce or eliminate the need for a user to bend over to activate the actuator to release the wand lock and separate the wand 180 from the upper portion 104 (e.g. to use the surface cleaning apparatus 100 in an above-floor cleaning mode).

Referring to FIGS. 11 and 22, as exemplified, a button 1058 may be positioned at approximately a midpoint along the length of wand 180. Button 1058 is an example of a lock release actuator. This may generally correspond to a height of a user's thighs. As shown, button 1058 may be substantially parallel with an upper end 1066 of surface cleaning unit 112. Button 1058 is drivingly connected to the plunger 1050 by shaft 1150.

The lock release actuator may be connected to wand 180, and removable from upper portion 104 and surface cleaning unit 102 when wand 180 is separated from upper portion 104 and surface cleaning unit 102 (e.g. for use in an above-floor cleaning mode). Similarly, a longitudinally extending transmission member drivingly connecting the lock release actuator to the locking member of wand lock 1106 may be mounted to wand 180 and removable from upper portion 104 and surface cleaning unit 102 when wand 180 is separated from upper portion 104 and surface cleaning unit 102. For example, wand lock 1106 in its entirety may be mounted to wand 180 and removable from upper portion 104 and surface cleaning unit 102 when wand 180 is separated from upper portion 104 and surface cleaning unit 102. This may advantageously allow surface cleaning apparatus 100 to be easily reconfigured into different modes of operation. For example, when surface cleaning unit 112 is unmounted from (removed from) upper portion 104, the wand lock 1106 may remain with wand 180 to allow wand 180 to remain releasably connected to upper portion 104.

In the example shown, wand lock 1106 including button 1058, shaft 1150, and plunger 1050 are all connected to wand 180 independent of surface cleaning unit 112 and upper portion 104, and remain so connected after surface cleaning unit 112 and upper portion 104 are separated from wand 180.

Surface Cleaning Unit Mounting Structure

The following is a description of the surface cleaning unit mounting structure that may be used by itself in any surface cleaning apparatus or in any combination or sub-combination with any other feature or features disclosed herein.

Reference is now made to FIG. 5. Surface cleaning unit 112 may be removably mountable to one or more of upper portion 104 and wand 180. Preferably, surface cleaning unit 112 may be mounted to upper portion 104 independent of wand 180, such that surface cleaning unit 112 may be mounted and dismounted from upper portion 104 without adjusting the position of wand 180 or removing wand 180. Accordingly, for example, wand 180 may remain in upper portion 104 while surface cleaning unit 112 is mounted to or removed from upper portion 104.

Alternately, or in addition, when surface cleaning unit 112 is mounted to upper portion 104, upper portion 104 may stabilize surface cleaning unit 112 (e.g. surface cleaning unit 112 may remain in a fixed position on upper portion 104 as upper portion 104 is manipulated to maneuver surface cleaning head 108). For example, upper portion 104 may inhibit translational movement of surface cleaning unit 112 along upper axis 164 (FIG. 1) toward surface cleaning head 108, and/or may inhibit rotational movement of surface cleaning unit 112 around upper axis 164.

Accordingly, surface cleaning unit 112 may be mounted on the exterior of upper portion 112 by two mounting members wherein the mounting members are provided a two longitudinally (e.g., along axis 164) spaced apart locations wherein at least one of the two mounting members provides lateral stability as upper portion 104 is manipulated to maneuver surface cleaning head 108. It will be appreciated that more than two mounting members may be provided.

Surface cleaning unit 112 may be slidably receivable on one or both of the mounting members. For example, surface cleaning unit 112 may have one or more recess to receive one of the mounting members therein. Accordingly, if one of the mounting members comprises a pair of laterally extending portions (e.g., left and right laterally extending wings that extend outwardly from opposed sides of the upper portion, or a mounting member provided on the front or rear of the exterior of the upper portion which has left and right laterally extending wings), then the surface cleaning unit 112 may have one or two groves in which the laterally extending position may be received.

One of the mounting members may have a sufficient height such that surface cleaning unit remains in a fixed position if wand 180 is removed and/or surface cleaning unit 112 is unlocked for removal from upper portion. For example, if the mounting member comprises laterally extending portions that are received in a recess, groove or the like then the engagement between abutting surfaces of the laterally extending portions and the recess, groove or the likes may dimensionally stabilize surface cleaning unit 112 in position in the unlocked position and with the wand removed.

Referring to FIGS. 15-18 and 29-33, surface cleaning unit 112 and upper portion 104 may include one or more mounting elements or members for connecting surface cleaning unit 112 to upper portion 104. For example, the mounting elements may include outwardly projecting mounting members or wings and corresponding mounting recesses for receiving those mounting members.

As exemplified, upper portion 104 includes outwardly projecting wings 1174*a* and 1174*b* . Wings 1174 are examples of mounting members. As shown, wings 1174 may extend laterally from a front side 1178 of upper portion 104. Although upper portion 104 is shown including two mounting members, in alternative embodiments, upper portion 104 may include any suitable number of mounting members. For example, upper portion 104 may include between one wing 1174 and ten wings 1174, which may extend in any number of directions. Further, wings 1174 may each be discrete elements, or they may be integrally formed as are 1174*a* and 1174*b* in the example shown.

As exemplified, surface cleaning unit 112 includes recesses 1182a and 1182b. Each recess 1182 may include an opening 1186 in a bottom surface 1190 of surface cleaning unit 112. Recesses 1182 may be sized and positioned to receive wings 1174. For example, surface cleaning unit 112 may be positioned above upper portion 104 and lowered to slide wings 1174 into recesses 1182. Thereafter, surface cleaning unit 112 may be separated from upper portion 104 by moving surface cleaning unit 112 vertically away from upper portion 104 to remove wings 1174 from recesses 1182.

Although surface cleaning unit 112 is shown including two recesses 1182, in alternative embodiments, surface cleaning unit 112 may include any suitable number of recesses for receiving some or all of the mounting members of upper portion 104. Further, the arrangement of recesses and protruding mounting members may be reversed. Each of surface cleaning apparatus 112 and upper portion 104 may include one or more recesses and mounting members sized and positioned to mate with one another.

Optionally, openings 1186 to recesses 1182 may be shaped to make it easier for a user to insert wings 1174 into recesses 1182. In some cases, mating recesses 1182 over wings 1174 may include lowering surface cleaning unit 112 onto upper portion 104. The openings 1186 to recesses 1182 on the bottom surface 1190 of surface cleaning unit 112 may be well below a user's eye-level and obscured from view. This may make aligning openings 1186 with recesses 1182 more difficult.

As exemplified, each recess 1182 may be flared in a lower portion 1194 of the recess 1182 to provide an enlarged opening 1186. Enlarged openings 1186 may make aligning openings 1186 over wings 1174 less difficult. Once wings 1174 enter the enlarged openings 1186, surface cleaning unit 112 may self-align as surface cleaning unit 112 is lowered further and wings 1174 enter the narrower upper portions 1198 of recesses 1182.

In the example shown, at least upper portion 1198 of each recess 1182 has a sectional profile that closely corresponds to the sectional profile of respective mating wings 1174. This may provide a tight interface between recesses 1182 and wings 1174 for stabilizing surface cleaning unit 112 on upper portion 104.

The fit between wings 1174 and recesses 1182 may stabilize surface cleaning unit 112 from rotating in all directions. This may prevent surface cleaning unit 112 from tipping over, e.g. when upper portion 104 is manipulated to maneuver surface cleaning head 108. Further, wings 1174 may support surface cleaning unit 112 from translating toward surface cleaning head 108. For example, one or more of recesses 1182 may include an end wall 1202 bordering upper portion 1198. Wings 1174 may insert far enough into recesses 1182 that an upper surface 1204 of at least one of wings 1174 contacts an end wall 1202. This contact may inhibit further translation of surface cleaning unit 112 toward surface cleaning head 108. Accordingly, for example, if wand 180 is removed and/or surface cleaning unit 112 is unlocked for removal from upper portion, then surface cleaning unit 112 may remain in position on upper portion 104.

In alternative embodiments, different mounting element (s) inhibit movement of surface cleaning unit 112 toward surface cleaning head 108. In this case, recesses 1182 may be open ended (i.e. without end walls 1202), wings 1174 may not reach an end wall 1202, or both. Instead the different mounting element(s) may inhibit movement of surface cleaning unit 112 toward surface cleaning head 108.

Figure 15:
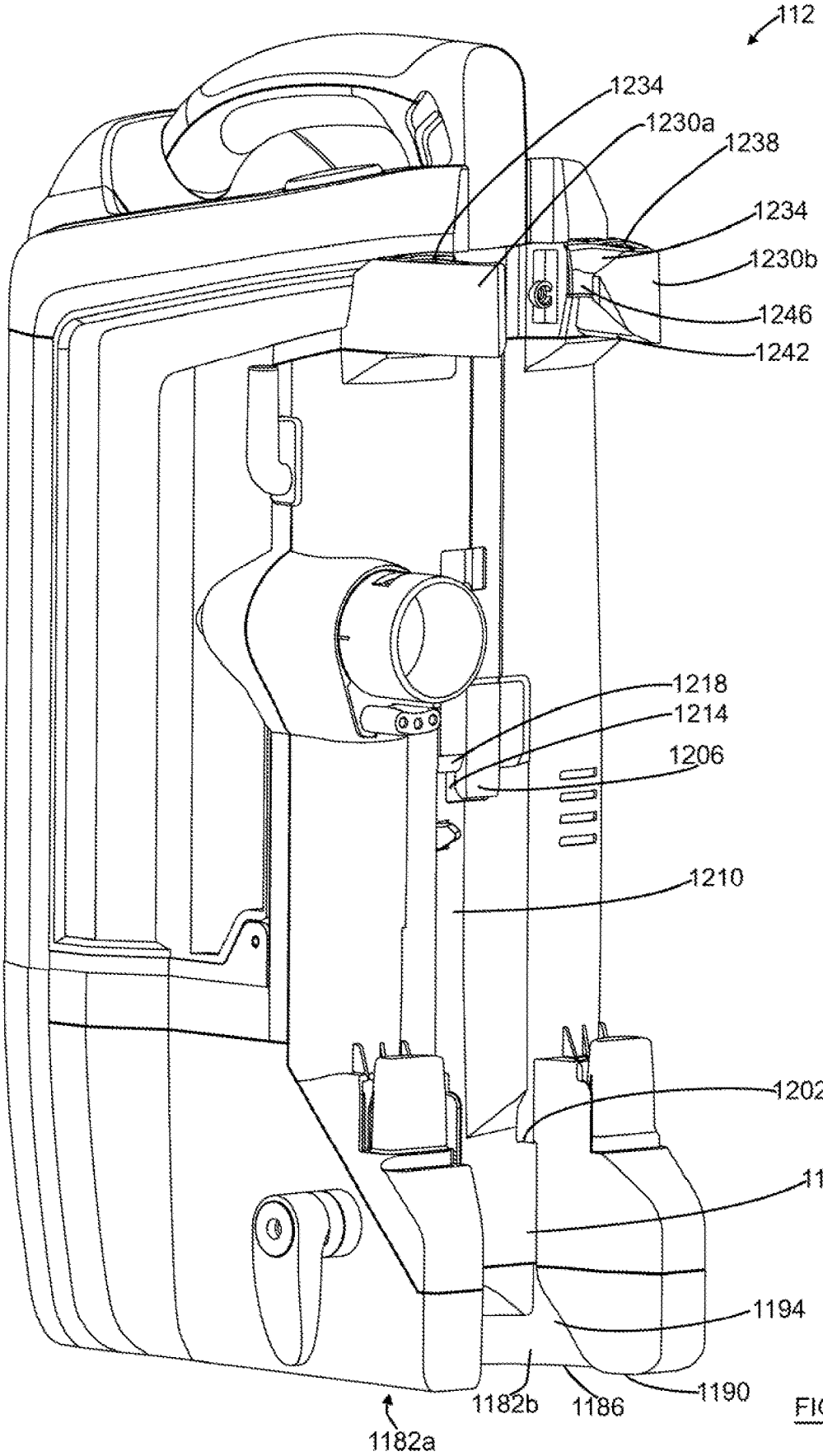
FIG. 15 is a rear perspective view of the portable surface cleaning unit.
Figure 16:
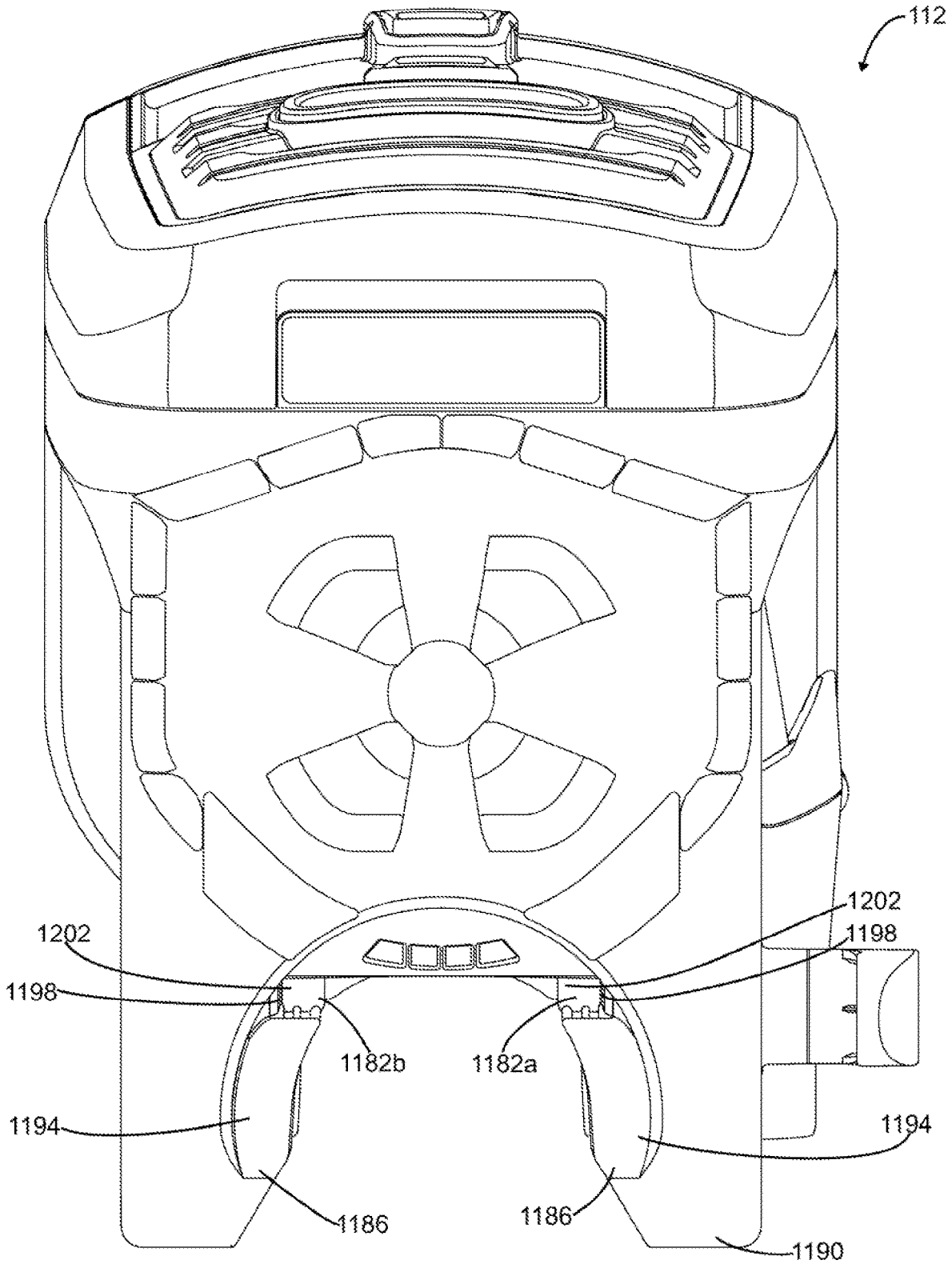
FIG. 16 is a bottom plan view of the surface cleaning unit of FIG. 15.
Figure 17:
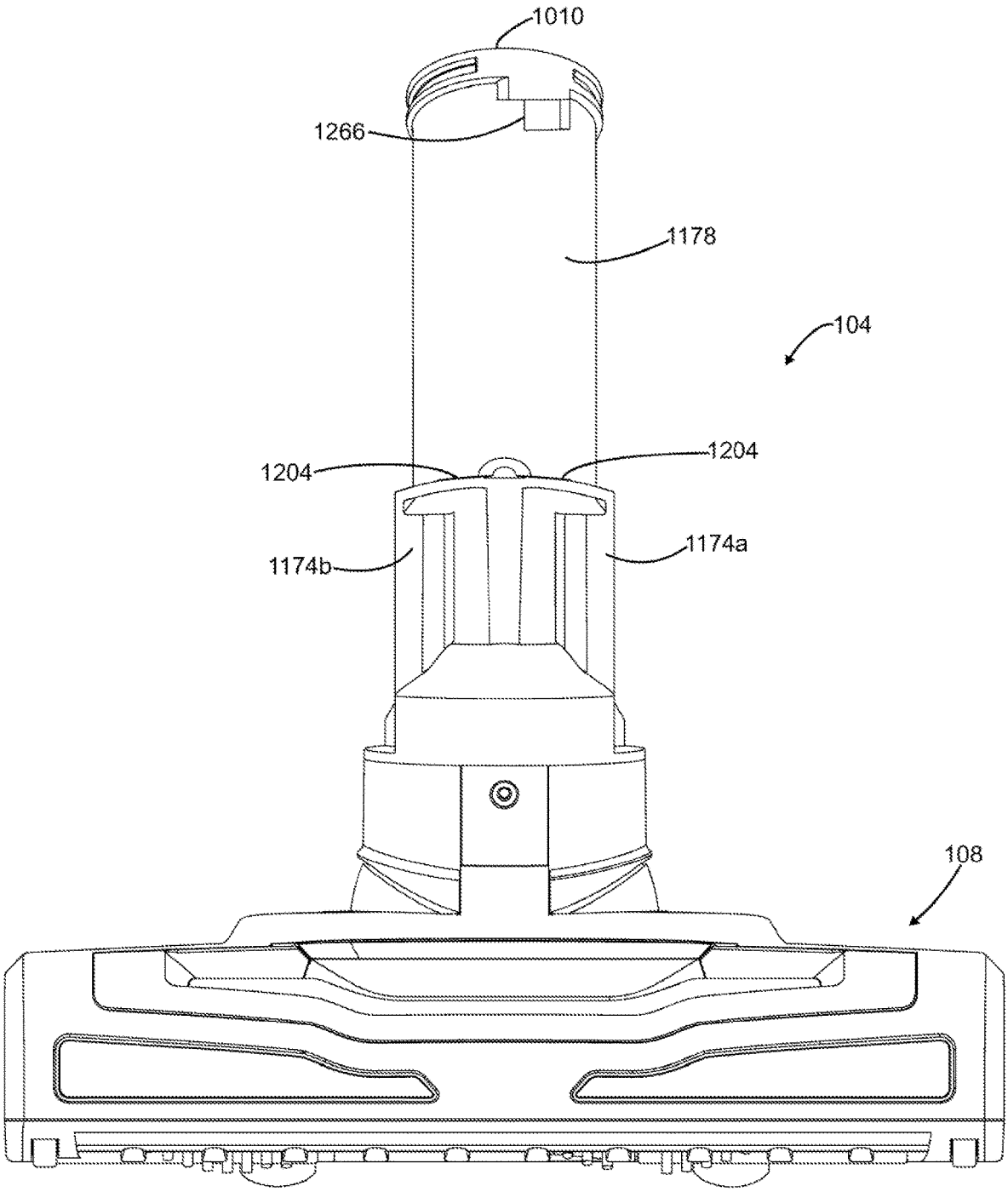
FIG. 17 is a front elevation view of the upper portion and the surface cleaning head of FIG. 11.
Figure 20:
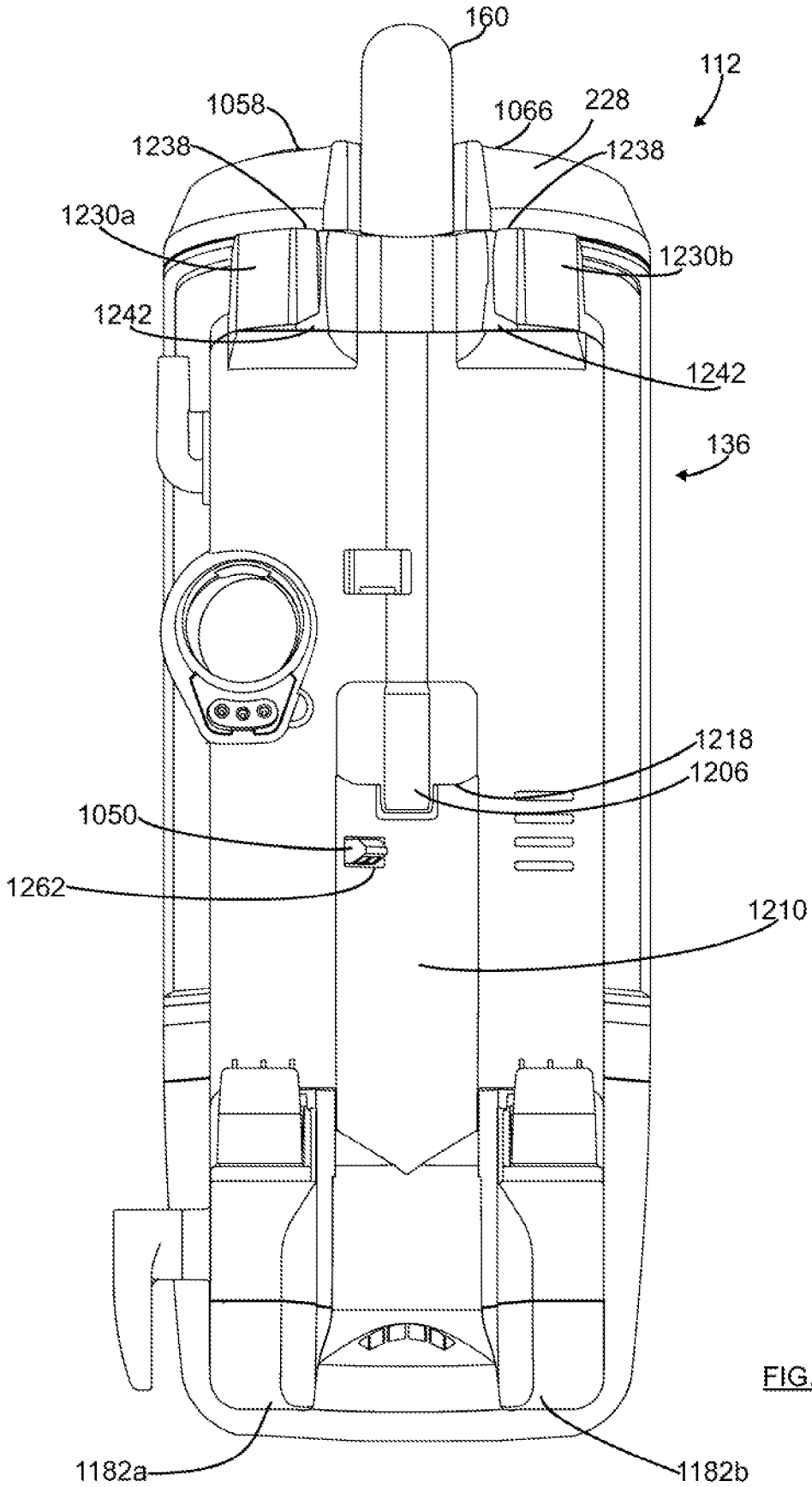
FIG. 20 is a rear elevation view of the surface cleaning unit of FIG. 15.

Reference is now made to FIGS. 15, 17, and 20. In addition to, or instead of wings 1174 and recesses 1182, surface cleaning unit 112 may include a different mounting member that engages downstream end 1010 of upper portion 104. As exemplified, surface cleaning unit 112 includes a clip 1206. Clip 1206 is an example of a mounting member. Clip 1206 may extend downwardly in spaced apart relation from a rear surface 1210 of surface cleaning unit 112 forming a slot 1214 for receiving a portion of downstream end 1010 of upper portion 104.

In use, surface cleaning unit 112 may be lowered onto upper portion 104 such that a front side 1178 of downstream portion 1006 enters slot 1214, and clip 1206 enters upper portion 104. Clip 1206 may grasp front side 1178 of upper portion 104 to inhibit surface cleaning unit 112 from rotating forwardly, over surface cleaning head 108, or rearwardly. In some cases, upper portion 104 may abut upper end 1218 of slot 1214 such that the weight of surface cleaning unit 112 may be supported on downstream end 1010 of upper portion 104. Clip 1206 may be disconnected from upper portion 104 by raising surface cleaning unit 112 vertically away from upper portion 104. Accordingly, upper portion 104 provides a support on which the surface cleaning unit 112 (clip 1206) seats when mounted to upper portion 104.

Figure 18:
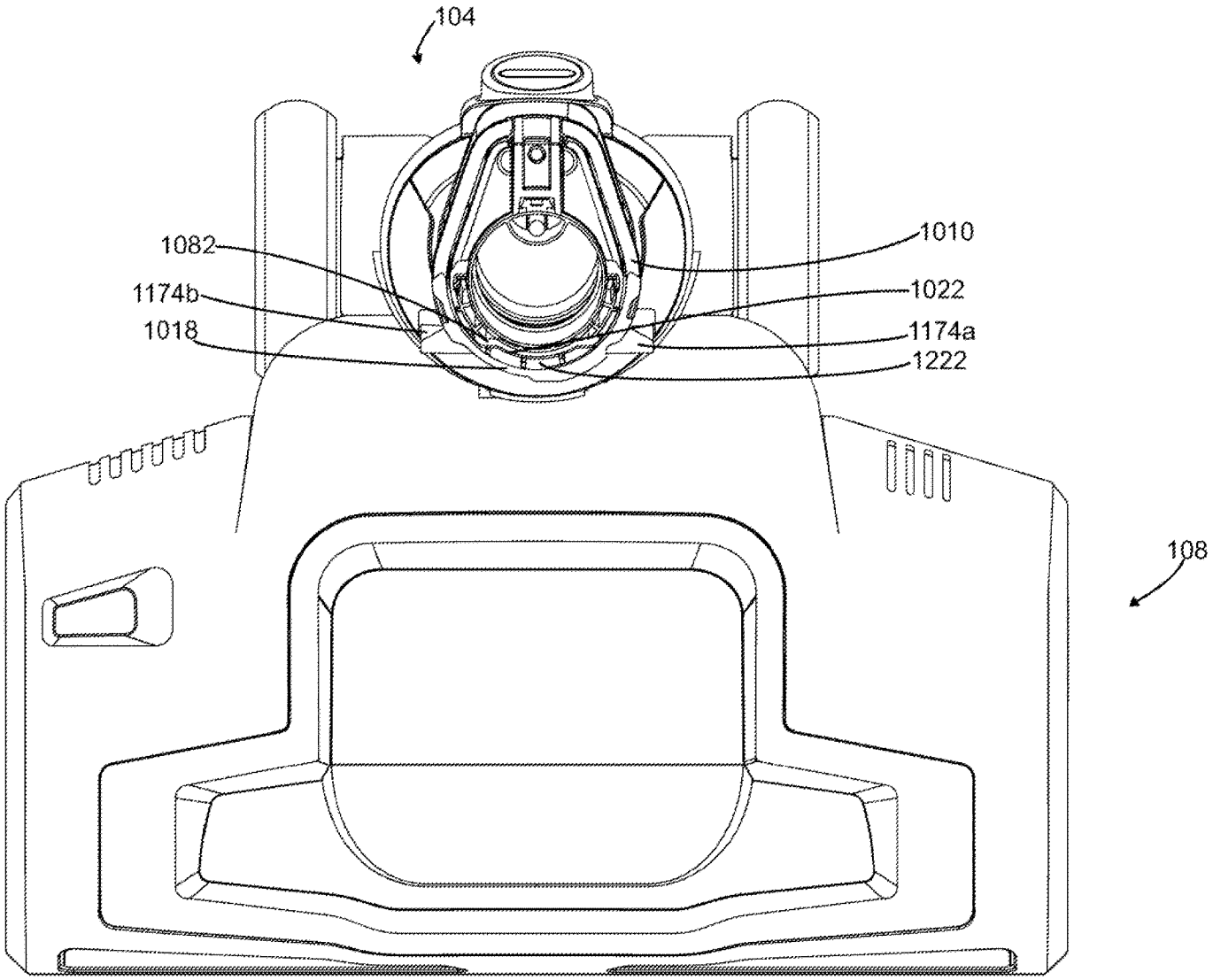
FIG. 18 is a cross-sectional view taken alone line 18-18 in FIG. 11.
Figure 19:
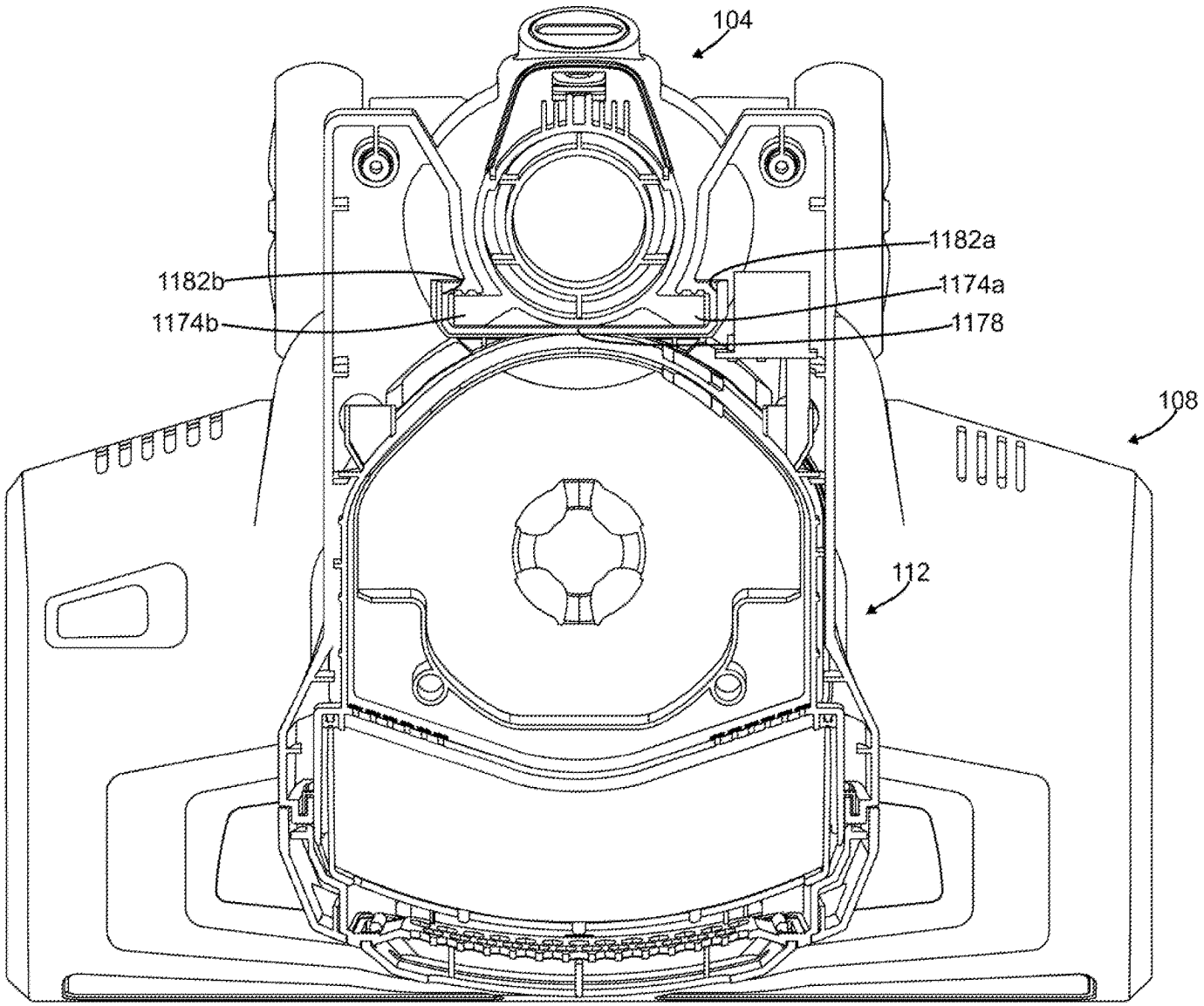
FIG. 19 is a cross-sectional view taken alone line 19-19 in FIG. 4.

As shown in FIG. 18, a clearance 1222 may be provided between inner wall 1018 of upper portion 104 and outer wall 1022 of wand 180, toward the front side 1178 of upper portion 104, when wand 180 is inserted into upper portion 104. Clearance 1222 may provide space for clip 1206 to be received in upper portion 104 simultaneously with wand 180. Further, either of clip 1206 or wand 180 may be removed from upper portion 104 while the other remains inserted in upper portion 104. This may make reconfiguring surface cleaning apparatus 100 into different cleaning modes quick and easy.

Reference is now made to FIGS. 11, 13, 15, and 20. Alternatively, or in addition to wings 1174, recesses 1182, and clip 1206, wand 180 may include mounting members for supporting surface cleaning unit 112 and or dynamically stabilizing or assisting in dynamically stabilizing surface cleaning unit 112 on upper portion 1104. Accordingly, for example, the mounting members of wand 180 enhance stability of surface cleaning unit 112 when both wand 180 and surface cleaning unit 112 are connected to upper portion 104. For example, mounting members of wand 180 may inhibit the rotation and/or the translation forward of surface cleaning unit 112, e.g. when upper portion 104 and/or wand 180 are manipulated to maneuver surface cleaning head 108.

As exemplified, wand 180 may include wings 1226*a* and 1226*b*. Wings 1226 are examples of mounting members. Further, surface cleaning unit 112 may include arms 1230*a* and 1230*b* for at least partially surrounding wings 1226. As shown, each arm 1230 may define a slot 1234 for receiving a wing 1226. Preferably, slots 1234 are open ended. This may permit wings 1226 to be received from above or below slots 1234. For example, if surface cleaning unit 112 is connected to upper portion 104, then wings 1226 may enter and exit slots 1234 through the open upper end 1238 of slots 1234, as wand 180 is lowered into upper portion 104 or raised away from upper portion 104. Further, if wand 180 is connected to upper portion 104, then wings 1226 may enter and exit through slots 1234 through the open bottom end 1242 of slots 1234, as surface cleaning unit 112 is lowered onto upper portion 104 or raised away from upper portion 104.

Slots 1234 may be shaped to make aligning wings 1226 with slots 1234 easier. As exemplified, each end 1238 and 1242 of slots 1234 may be flared to provide a widened opening for easier alignment with wings 1226. Further, each slot 1234 may include a narrow region 1246 between upper and lower ends 1238 and 1242. Preferably, narrow region 1246 may make contact with wings 1226 when wings 1226 are received in slots 1234. As exemplified, each of wings 1226 includes a front surface 1250 that faces forward toward surface cleaning unit 112 (when surface cleaning unit 112 and wand 180 are connected to upper portion 104), and an opposite rear face 1254. In use, when wings 1226 are received in slots 1234, slots 1234 may contact at least a portion of rear faces 1254 of wings 1226. This may permit arms 1230 to inhibiting surface cleaning unit 112 from tilting forwardly over surface cleaning head 108.

Alternatively, or in addition to providing support for surface cleaning unit 112, the interaction between wings 1226 and arms 1230 may help to support wand 180 in an upright position. Wand 180 may be releasably securable to upper portion 104. For example, a wand lock may be releasably engaged to secure wand 180 to upper portion 104. However, in some embodiments, after the wand lock is disengaged, upper portion 104 may not provide good support to maintain wand 180 in position. For example, wand 180 may tip over after the wand lock is disengaged if no further support is provided. This may be exacerbated where the wand lock remains disengaged after a user ceases interaction with a wand lock release actuator. In this case, when a user activates the wand lock release actuator, the user may release control of wand 180, such that wand 180 may fall over if no further support is provided to keep wand 180 in position. Such further support may be provided by arms 1230 which may receive wings 1226 to support wand 180 in an upright position, e.g. when wand lock is unlocked. This may provide a user with time to develop a proper grip on wand 180 after unlocking the wand lock.

In operation, a user may position surface cleaning unit 112 adjacent upper portion 104 and above upper wings 1226 and above lower wings 1174. Slots 1234 may be generally aligned with upper wings 1226 and recesses 1182 may be generally aligned with lower wings 1174. This is the position shown in FIG. 31. Surface cleaning unit 112 may then be lowered. As surface cleaning unit 112 is lowered, arms 1230 extend to surround upper wings 1226 and lower wings 1174 commence to be received in recesses 1182. This is the position shown in FIG. 32. Continual lowering of surface cleaning unit to the mounted position shown in FIG. 33 results in surface cleaning unit being seated on lower wings 1174, clip 1206 being received in upper portion 104 and arms 1230 of the surface cleaning unit surrounding upper wings 1226 of the wand 180.

Another example is provided in the embodiment of FIGS. 25 and 27. As shown, upper portion 104 may include mounting members 1174, formed as wings, which are sized and positioned to be received in recesses of mounting member 1502 provided on a rear surface 1210 of surface cleaning unit 112. Alternatively, or in addition, upper portion 104 may include a second mounting member 1504 sized and positioned to receive wheel 1506 which is supported on surface 1210. In use, surface cleaning unit 112 may be positioned with mounting member 1502 and wheels 1506 aligned above mounting members 1174 and 1504, and the lowered, so that mounting member 1502 slidingly engages mounting member 1174 and wheel 1506 seats on mounting member 1504.

Surface Cleaning Unit Locking Mechanism

The following is a description of the surface cleaning unit locking mechanism that may be used by itself in any surface cleaning apparatus or in any combination or sub-combination with any other feature or features disclosed herein.

Preferably, once surface cleaning unit 112 is connected to upper portion 104, surface cleaning unit 112 remains connected to upper portion 104 until surface cleaning unit 112 is selectively disconnected from upper portion 104. The connection between surface cleaning unit 112 and upper portion 104 may be maintained by one or more retentive elements of a locking mechanism, which may be selectively disengaged. When the locking mechanism is engaged, surface cleaning unit 112 may not be separable from upper portion 104 unless the locking mechanism is unlocked. This may prevent the upper portion 104 from disconnecting from upper portion 104, e.g. while upper portion 104 is used to maneuver surface cleaning head 108 or if surface cleaning apparatus 100 is carried by grasping surface cleaning unit 112.

As discussed previously, upper portion 104 may terminate well below waist height. An advantage of a shorter upper member is that it facilitates the insertion of wand 180 into upper portion 104. In order to avoid a user having to bend over to release surface cleaning unit 112 while enabling surface cleaning unit 112to be locked to upper portion 104, an actuator may be provided at a height which may be actuated by a user while standing upright. The actuator may be drivingly connected to lock by a longitudinally extending member, such as shaft. The actuator and shaft, as well as any linking member, may be provided as part of, and removable with, surface cleaning unit 112. Accordingly, by incorporating the lock and actuator into surface cleaning unit 112, upper portion 104 may be shorter.

Reference is made to FIGS. 17, 20, and 21*a-d*, where like part numbers refer to like parts in the other figures. As exemplified, surface cleaning unit 112 may include a locking mechanism 1258 that is substantially similar to wand lock 1106 describe above. Accordingly, the description below of locking mechanism 1258 is abbreviated so as not to unnecessarily repeat details and variants already described above.

Figure 21A:
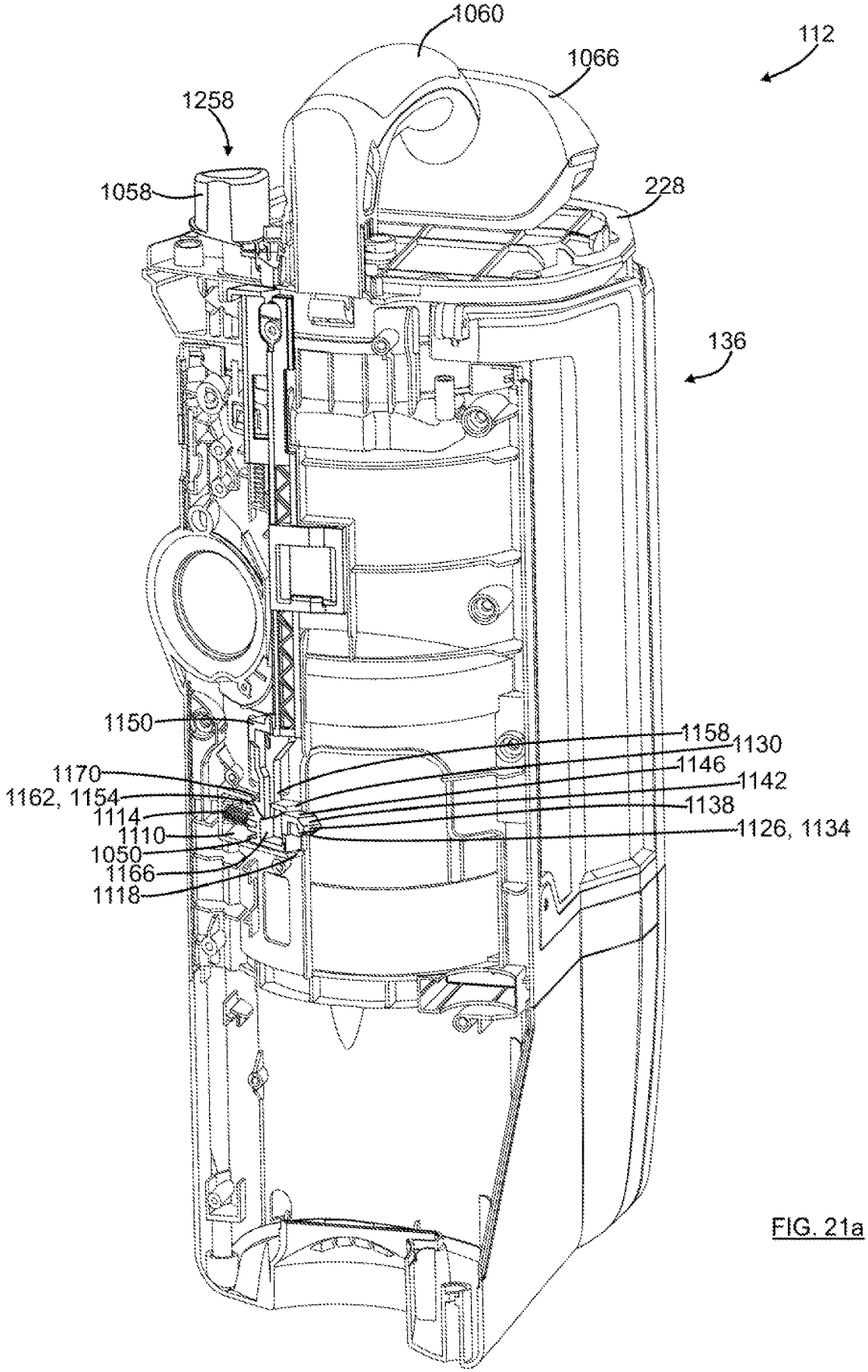
FIGS. 21*a*-21*d* are rear perspective views of the surface cleaning unit of FIG. 15 with a rear wall removed and the locking mechanism in different positions.
Figure 21B:
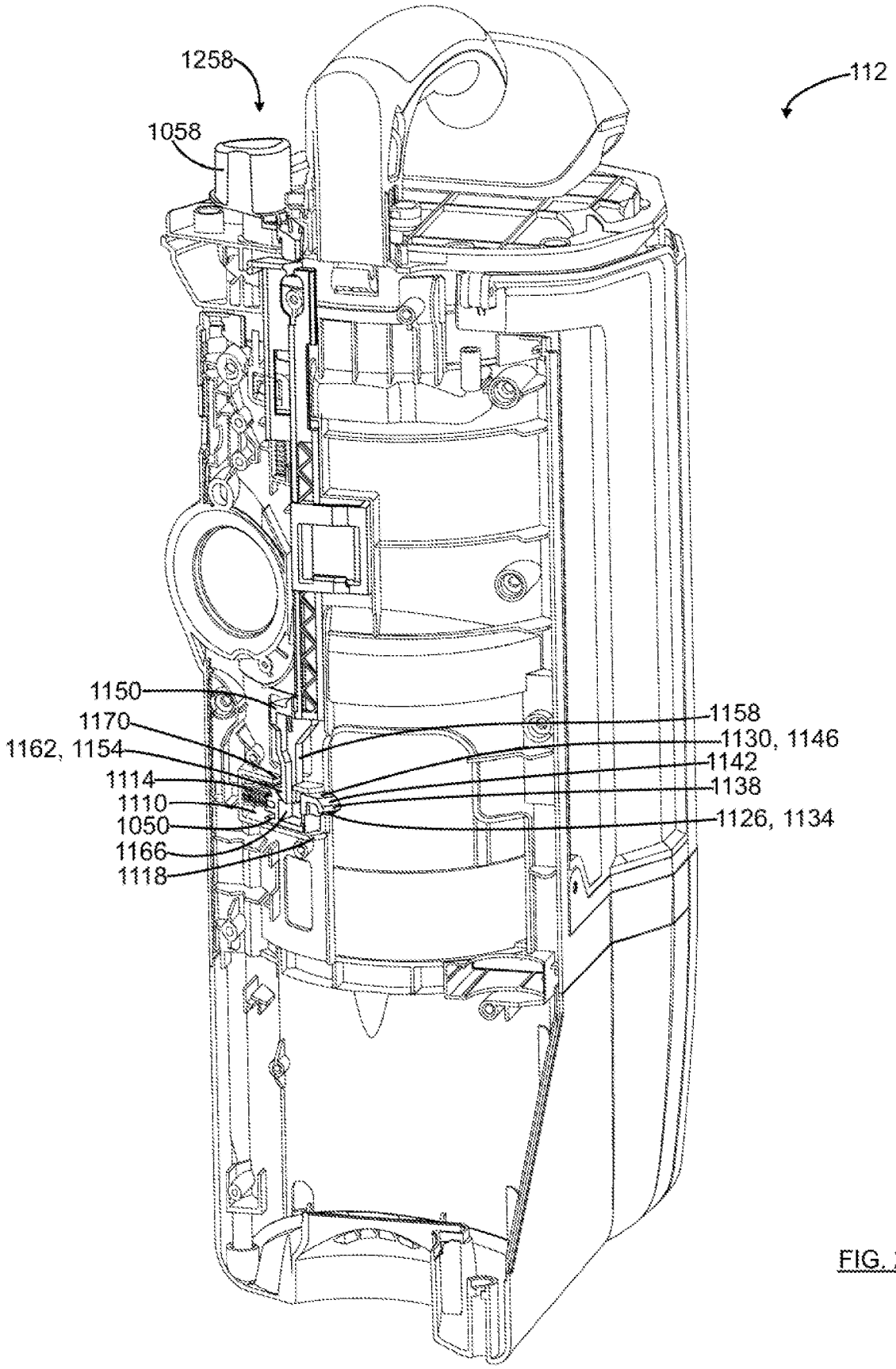
Figure 21C:
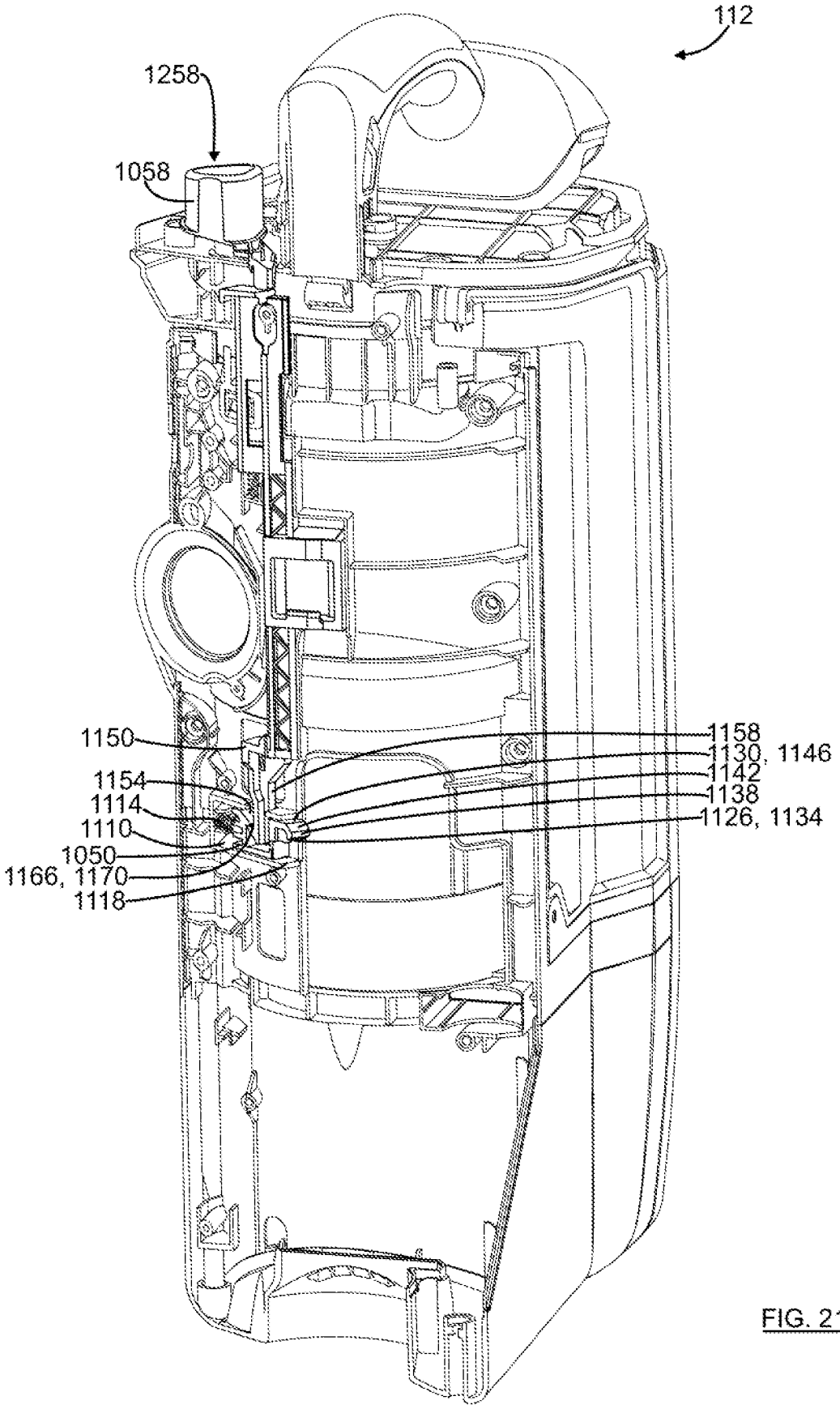
Figure 21D:
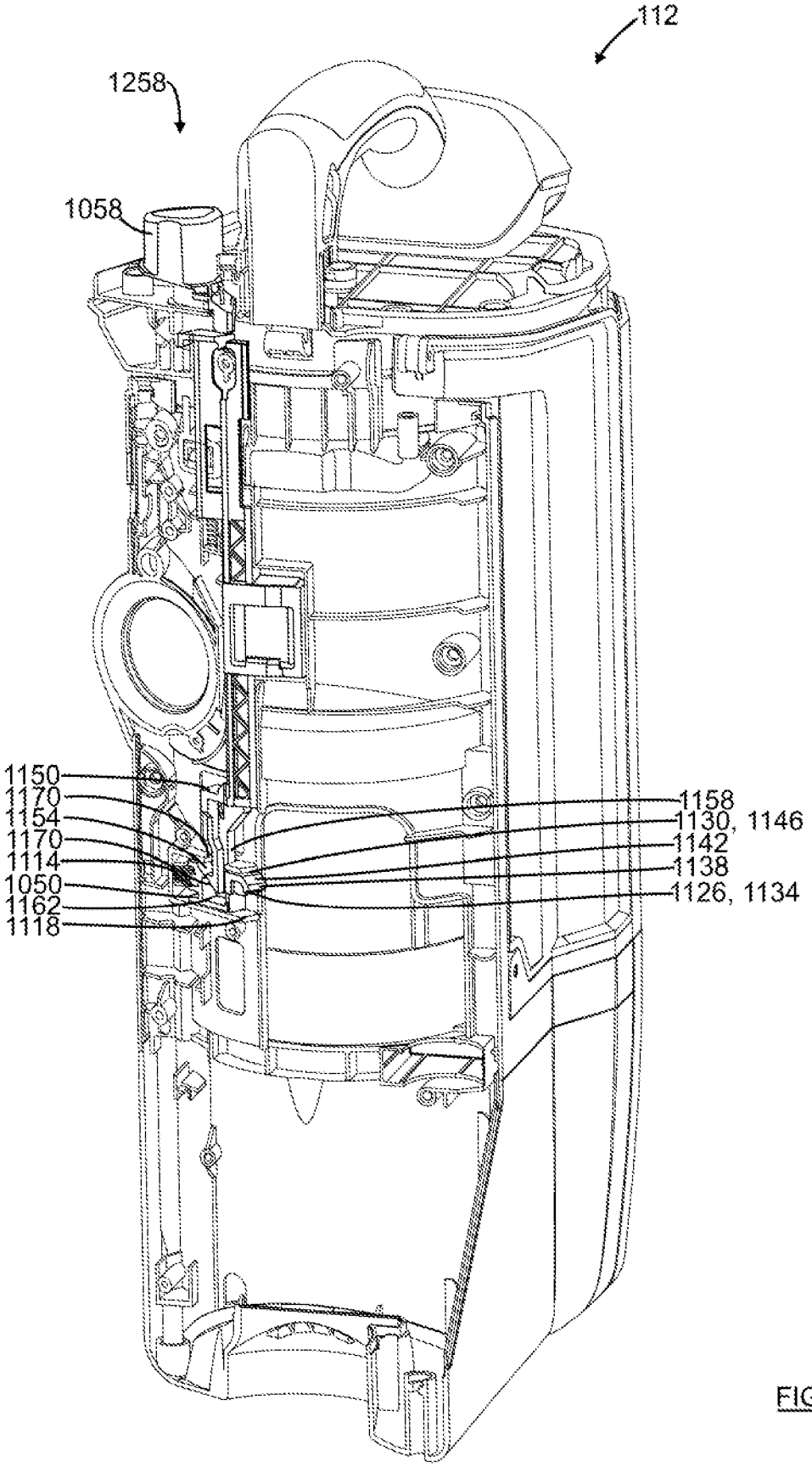

In the example shown, locking mechanism 1258 may include an unlock actuator 1058 drivingly connected to a locking member 1050 by a longitudinally extending transmission member 1150. Locking member 1050 may translate laterally outwardly to engage with upper portion 104, placing locking mechanism 1258 into a locked position (FIG. 21*a*). Vertical translation of longitudinally extending transmission member 1150 toward locking member 1050 (e.g. by interaction with unlock actuator 1058) may urge locking member 1050 to translate laterally inwardly (FIG. 21*b*) to disengage with upper portion 104, placing locking mechanism 1258 in an unlocked position (FIG. 21*c*). Once in the unlocked position, locking mechanism 1258 may remain unlocked until the surface cleaning unit 112 is withdrawn from upper portion 104 or reengaged with the upper portion 104. The act of withdrawing or reengaging surface cleaning unit 112 with upper portion 104 may release locking mechanism 1258 from the unlocked position (FIG. 21*d*), allowing locking mechanism 1258 to move to the locked position when appropriate.

As exemplified, locking mechanism 1258 may be wholly connected to surface cleaning unit 112. When surface cleaning unit 112 is removed from upper portion 104, so too may locking mechanism 1258, which may remain connected to surface cleaning unit 112. In the example shown, locking mechanism 1258 is positioned behind rear surface 1210 of surface cleaning unit 112. Locking member 1050 of locking mechanism 1258 is exemplified as a plunger which is extendable through an opening 1262 in rear surface 1210 of surface cleaning unit 112. Locking member 1050 of locking mechanism 1258 may engage with a front side 1178 of upper portion 104. As exemplified, front side 1178 includes an opening 1266. Opening 1266 may be sized and positioned to receive locking member 1050 when locking mechanism 1258 is in the locked position.

Lock release actuator 1058 may be positioned in any suitable location. Preferably, lock release actuator 1058 is positioned proximate upper end 1066 of surface cleaning apparatus 112. This may permit a user to activate lock release actuator 1058 (e.g. depressing a button actuator) with little or no bending over. Further, lock release actuator 1058 is preferably positioned proximate handle 160. In some embodiments, this may permit a user to simultaneously grasp handle 160 and activate lock release actuator 1058. In the example shown, lock release actuator 1058 is positioned on openable lid 228 of cyclone bin assembly 136. As shown in FIG. 23, lock release actuator 1058 may extend through an opening 1270 in an inner surface of lid 216 for interacting with transmission member 1150. When lid 216 is in an open position, as shown in FIG. 23, lock release actuator 1058 may disengage (e.g. separate from) transmission member 1150. When lid 216 is in a closed position, lock release actuator 1058 may re-engage (e.g. reestablish contact with) transmission member 1150 for driving the translation of transmission member 1150.

Preferably, locking mechanism 1258 inhibits vertical translation of surface cleaning unit 112 away from upper portion 104 (e.g. in the downstream direction) when locking mechanism 1258 is in the locked condition. However, in some embodiments, locking mechanism 1258 may not inhibit forward rotation (i.e. rotation over surface cleaning head 108) of locking mechanism 1258, which in some circumstances may remove locking member 1050 from opening 1266 defeating locking mechanism 1258. Therefore, surface cleaning apparatus 100 may include additional retentive elements for at least inhibiting forward rotation of surface cleaning unit 112 when connected to upper portion 104. For example, one or both of surface cleaning unit 112 and upper portion 104 may include one or more mounting members, such as wings 1174 and/or clip 1206, for mounting surface cleaning unit 112 to upper portion 104 and inhibiting at least forward rotation of surface cleaning unit 112.

Alternate Attachments

The following is a description of alternate tools, such as cleaning tool, powered cleaning tools and power tools, such as a sander, a drill, a saw or a steam mop module, that may be attached, e.g., to the inlet end of wand 180 or the inlet end of handle 160, and which may be used by itself in any surface cleaning apparatus or in any combination or sub-combination with any other feature or features disclosed herein.

In another example of the above floor cleaning mode that is exemplified in FIG. 7, the surface cleaning unit 112 can remain mounted on the upper portion 104 and the wand 180 can be detached from the upper portion 104 to provide an extended wand for above floor cleaning. Optionally, additional accessory tools may be coupled to the upstream end 192 of wand 180, including for example), a cleaning brush 1512 (see FIG. 28*a*),optionally an electrically powered brush or an air driven turbo brush, and any other type of accessory including a power tool such as a sander 1526 (see FIG. 28*b*).

Figure 28A:
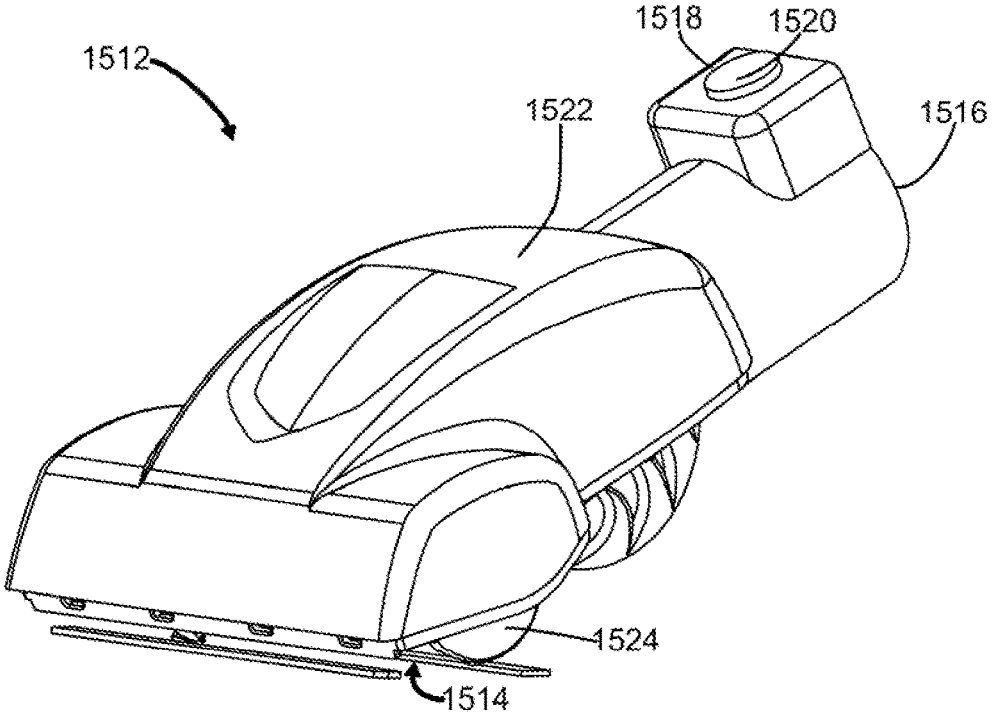
FIG. 28*a* is a front perspective view of an auxiliary cleaning tool that may be connected to the inlet end of the above floor cleaning wand.

FIG. 28*a* shows an exemplary power brush tool 1512 that may be connected to an upstream end 192 of wand 180, or to an upstream end 200 of handle 160. As shown, power brush tool 1512 includes a dirty air inlet 1514 and a downstream air outlet 1516. Upstream end 192 or 200 of wand 180 or handle 160 may be connected to downstream air outlet 1516 in any suitable fashion. For example, power brush tool 1512 may include a tool lock 1518 for securing power brush 1512 to wand 180 or handle 160. Tool lock 1518 may further include a release actuator 1520 (e.g. button, switch, or lever) that may be activated to allow power brush 1512 to be freely removed from wand 180 or handle 160.

Power brush tool 1512 may include a brush drive (not shown) in a drive housing 1522. The brush drive may be drivingly connected to a rotatably mounted brush 1524 for rotating brush 1524. Brush 1524 may be positioned proximate dirty air inlet 1514 for making contact with a cleaning surface to dislodge dirt thereon and direct dirt into dirty air inlet 1514. Power brush tool 1512 may include an electrical engagement member (not shown) for connection with wand 180 or handle 160 to receive electricity to power the brush drive. Alternatively, or in addition, power brush tool 1512 may include an alternative source of power, such as one or more batteries.

Figure 28B:
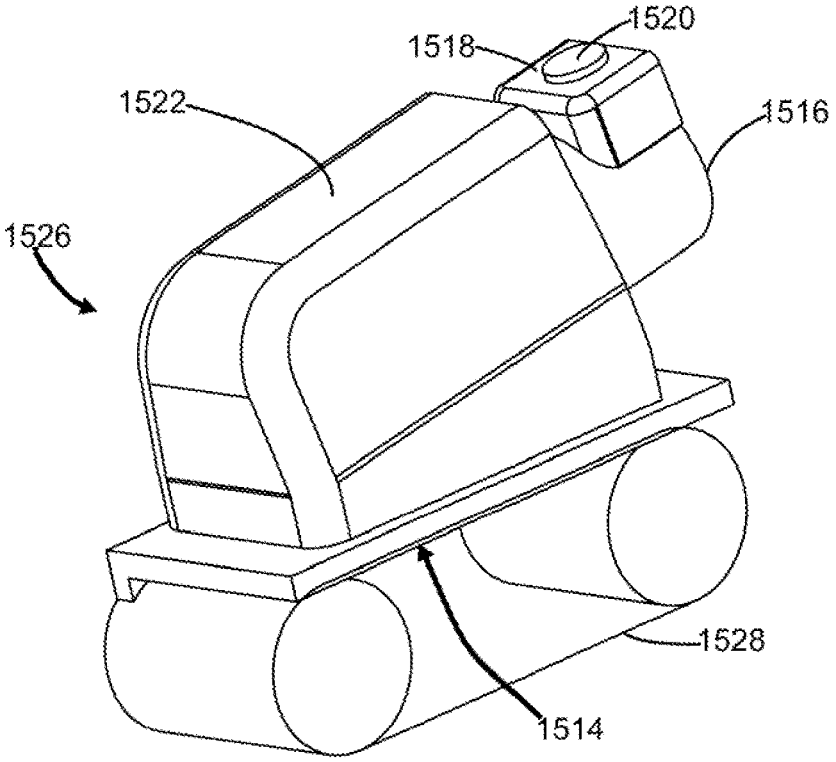
FIG. 28*b* is a front perspective view of a power tool that may be connected to the inlet end of the above floor cleaning wand.
Figure 29:
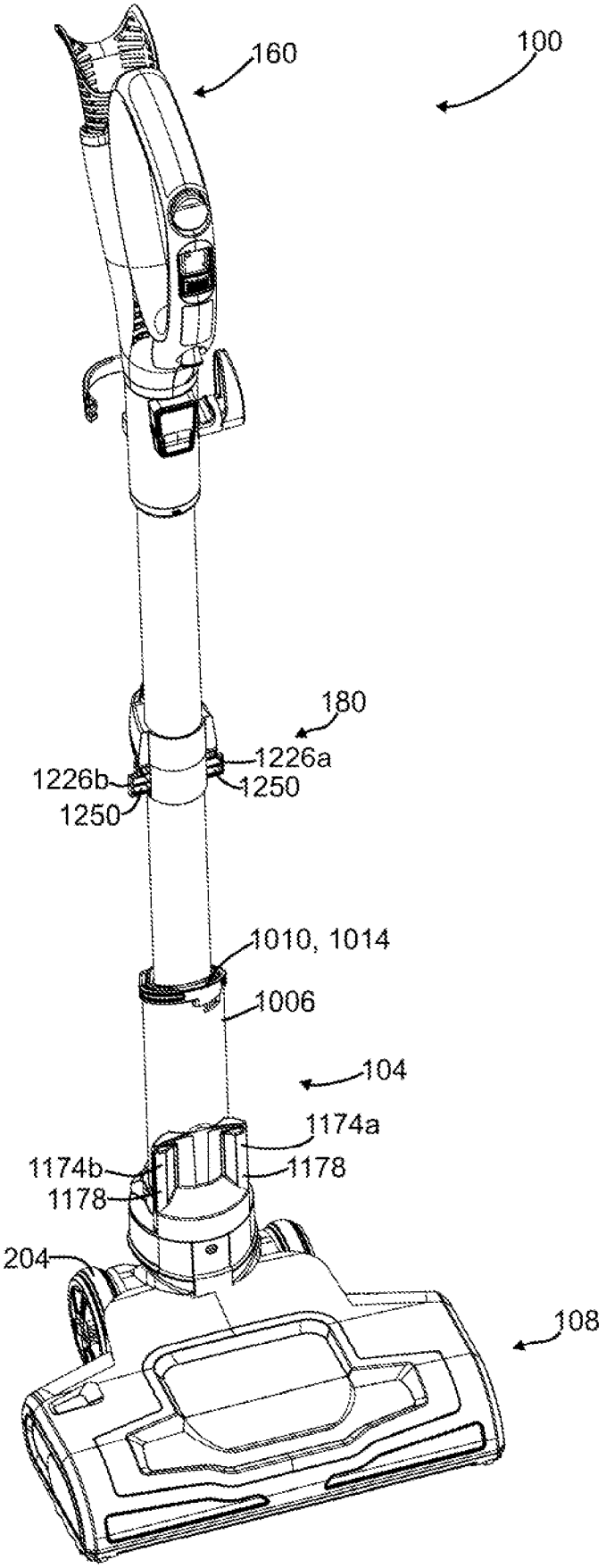
FIG. 29 is a front perspective view for the surface cleaning apparatus of FIG. 1 with the surface cleaning unit and the hose removed.
Figure 30:
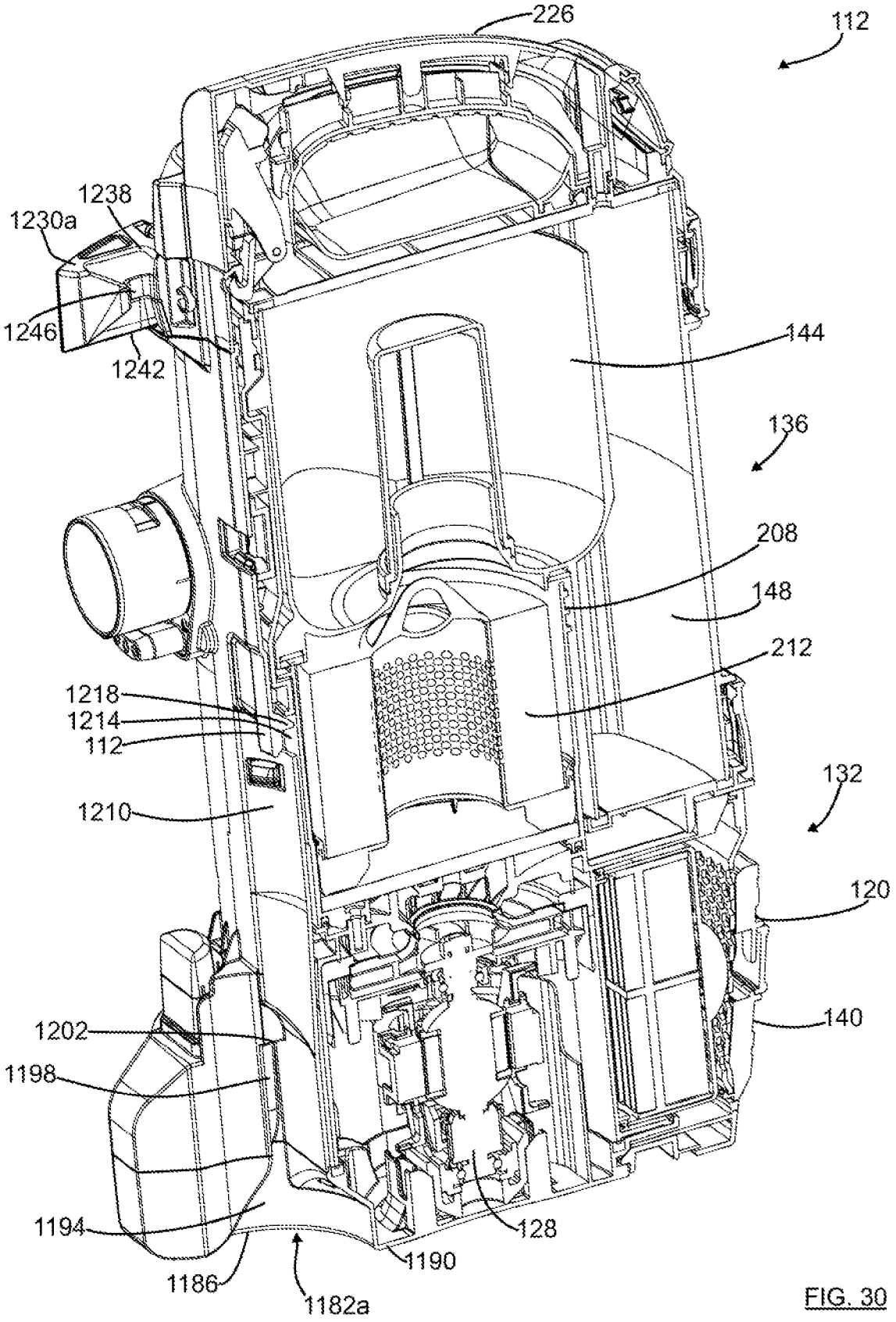
FIG. 30 is a partial cross-sectional view in perspective taken along line 4-4 in FIG. 1.
Figure 31:
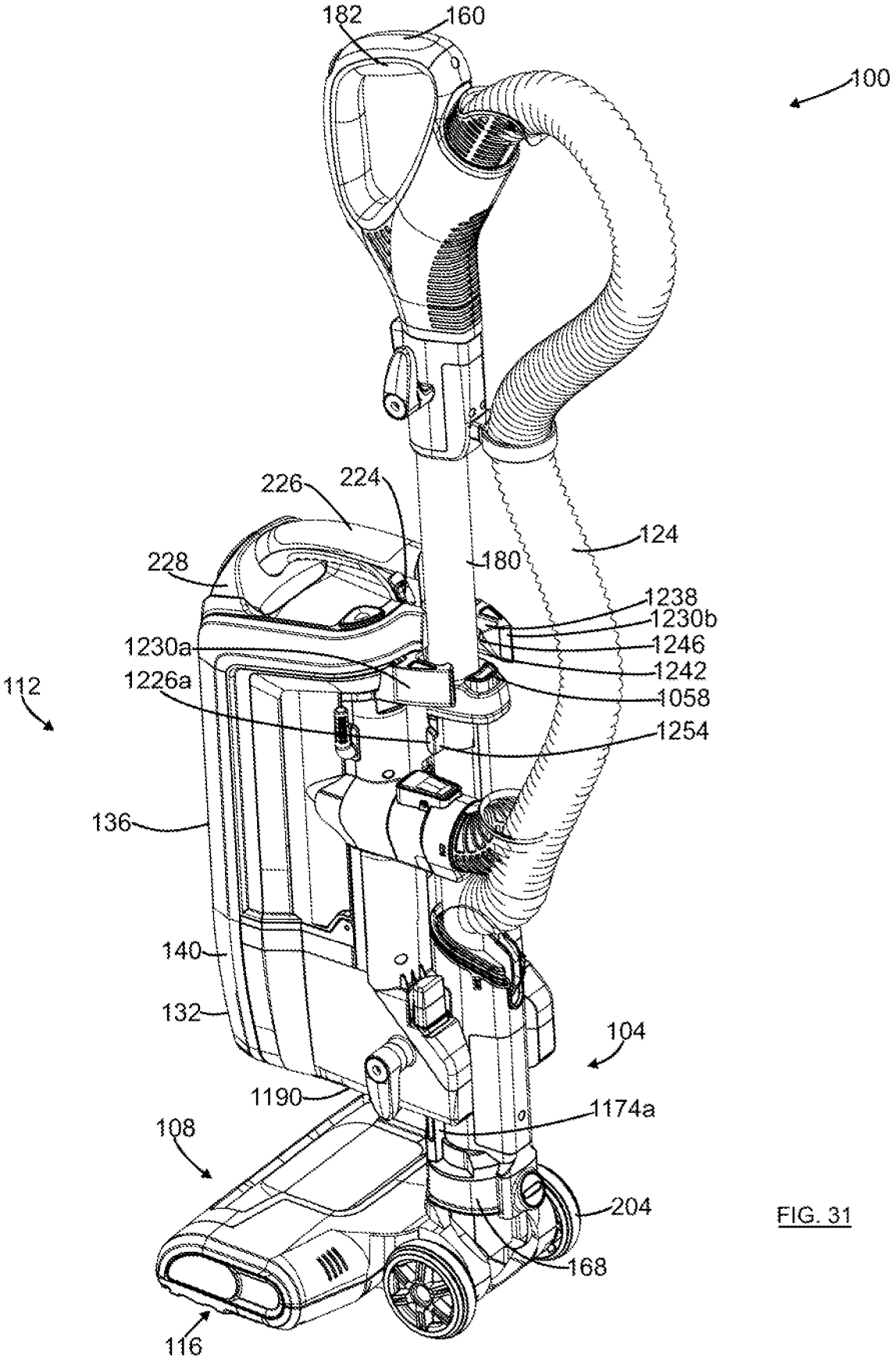
FIGS. 31-33 are front perspective view of the surface cleaning unit being mounted on the upper portion.
Figure 32:
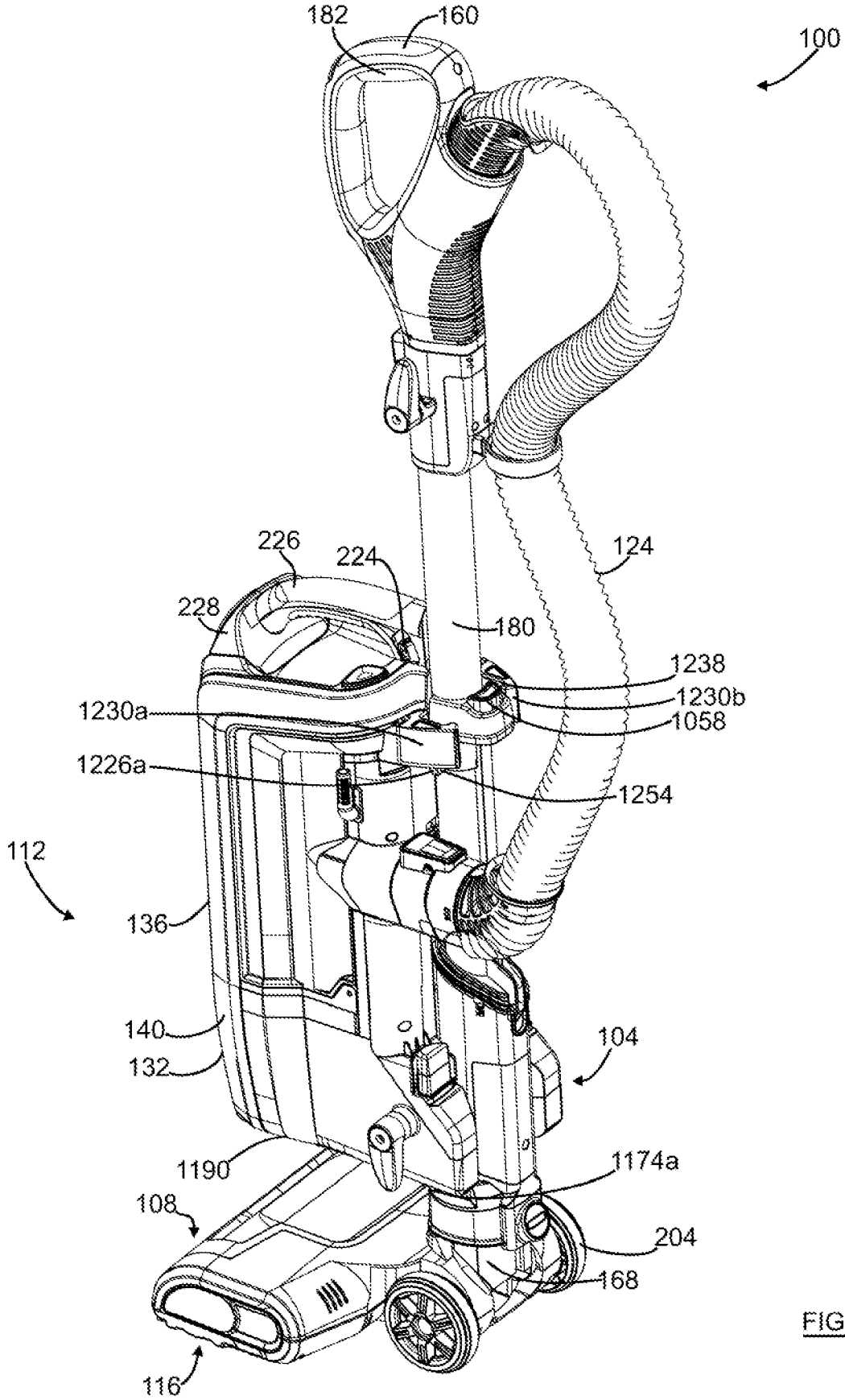
Figure 33:
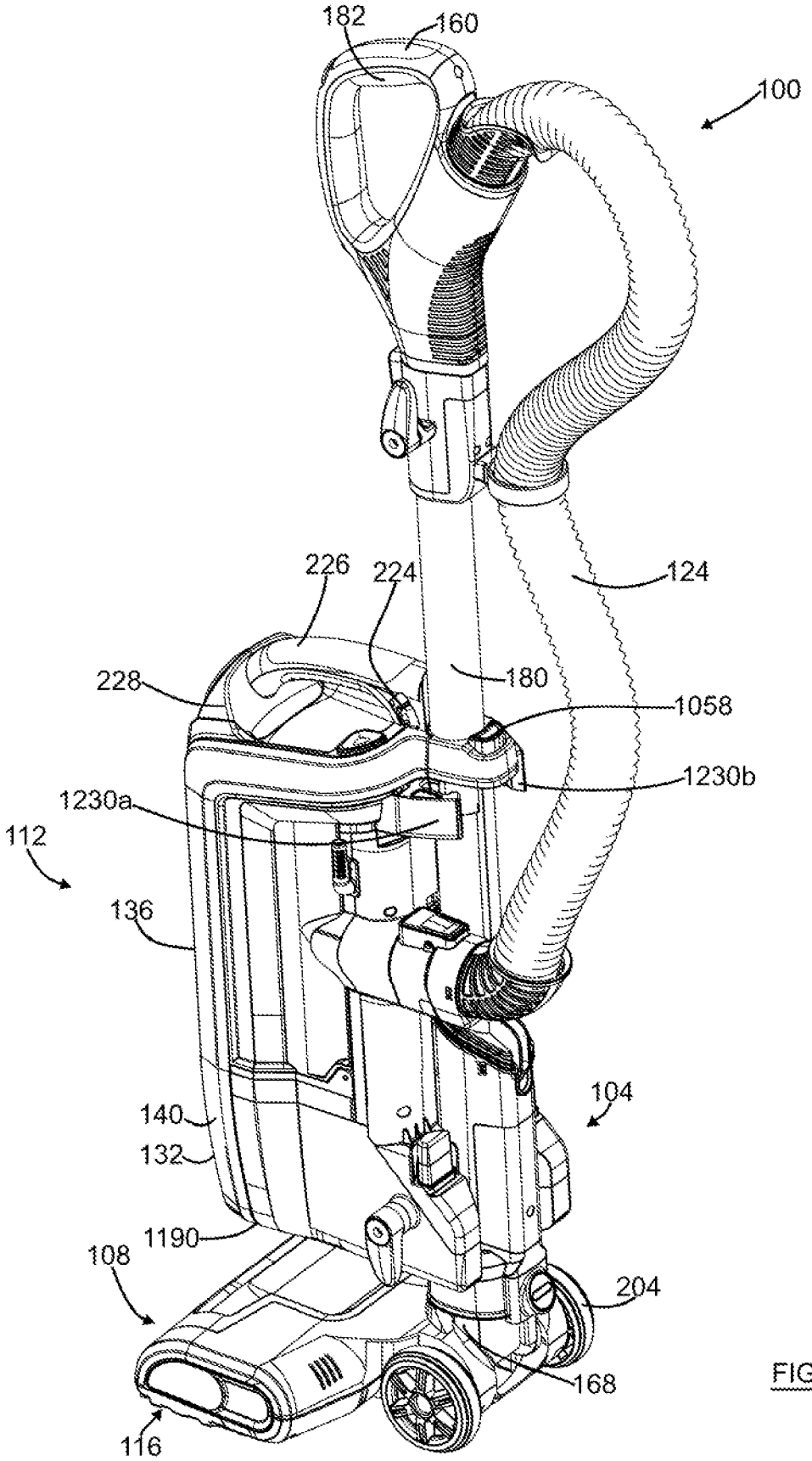
Figure 34:
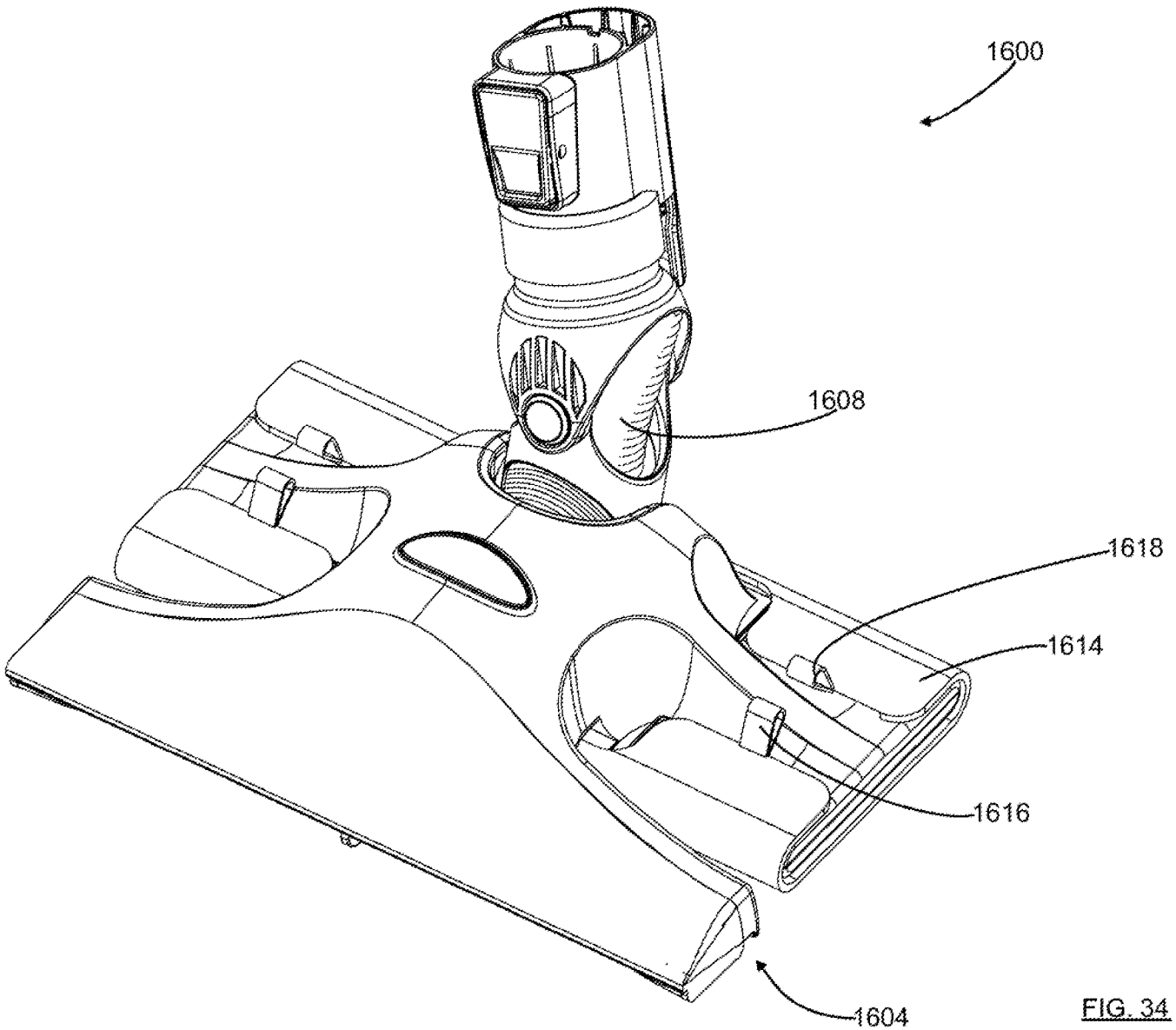
FIG. 34 is a front perspective view of an alternate floor cleaning tool which includes a suction inlet and a hard floor cleaning cloth.
Figure 35:
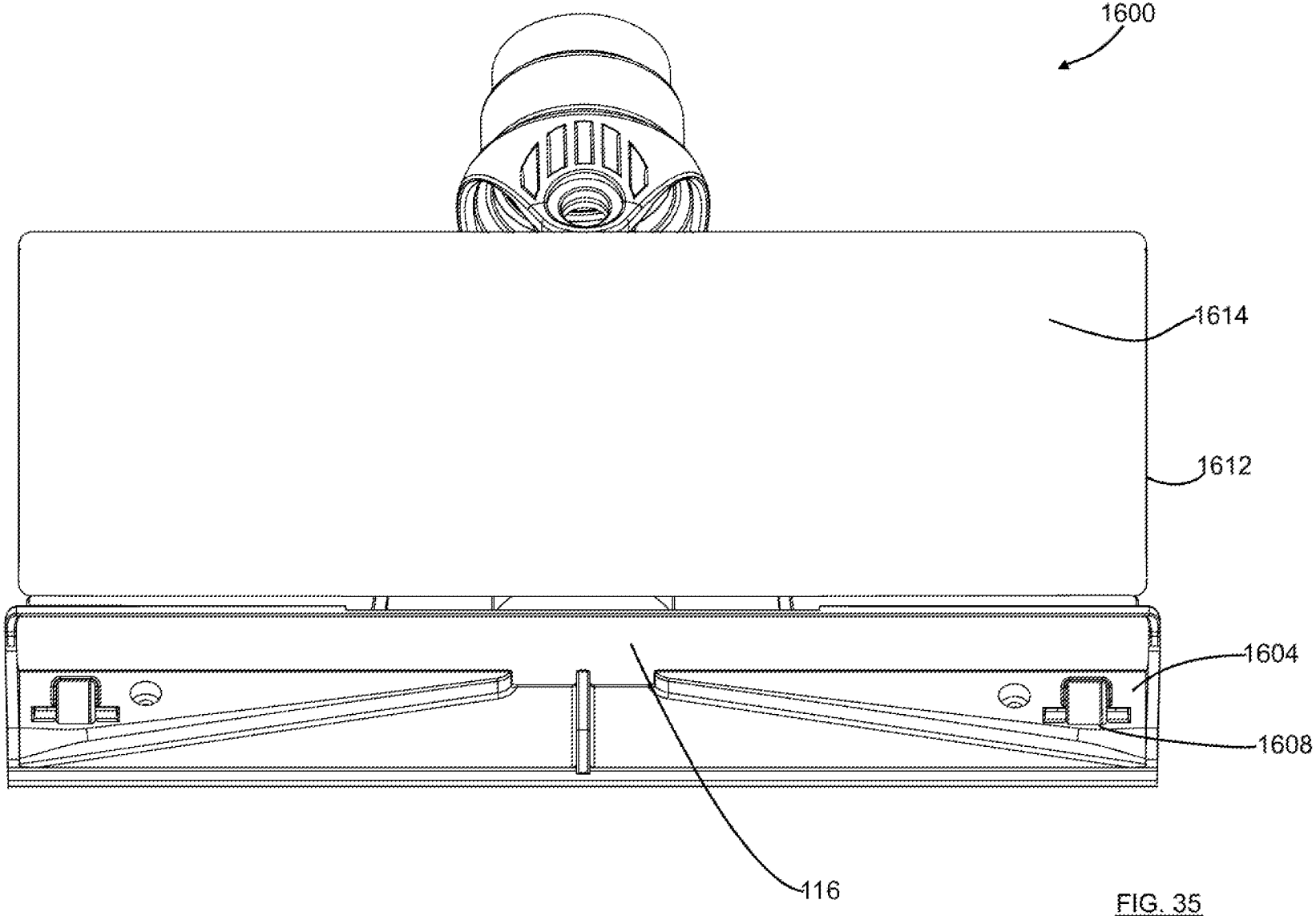
FIG. 35 is a bottom plan view of the alternate floor cleaning tool of FIG. 34.
Figure 36:
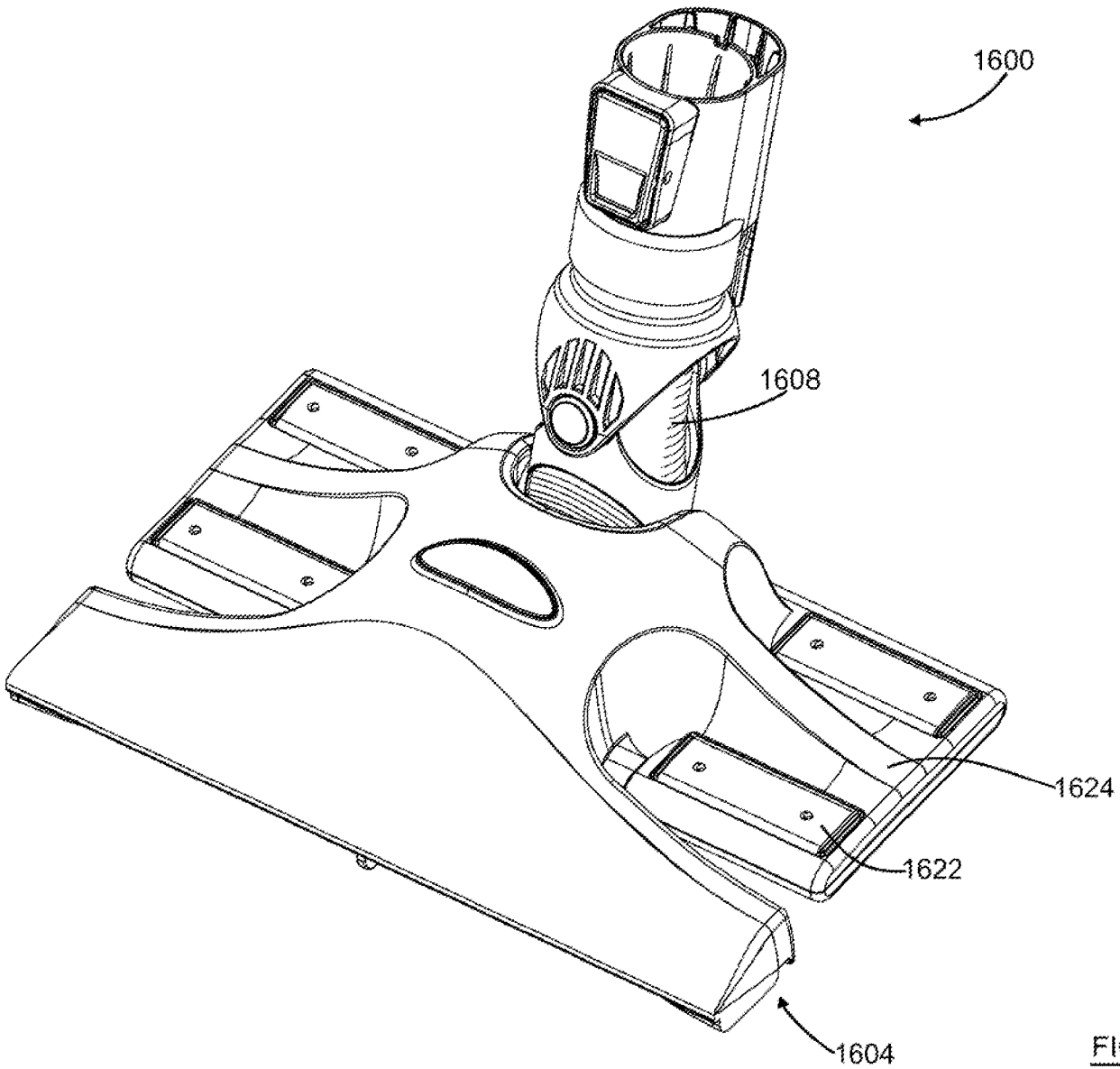
FIG. 36 is a front perspective view of the alternate floor cleaning tool of FIG. 34 with the hard floor cleaning cloth removed.
Figure 37:
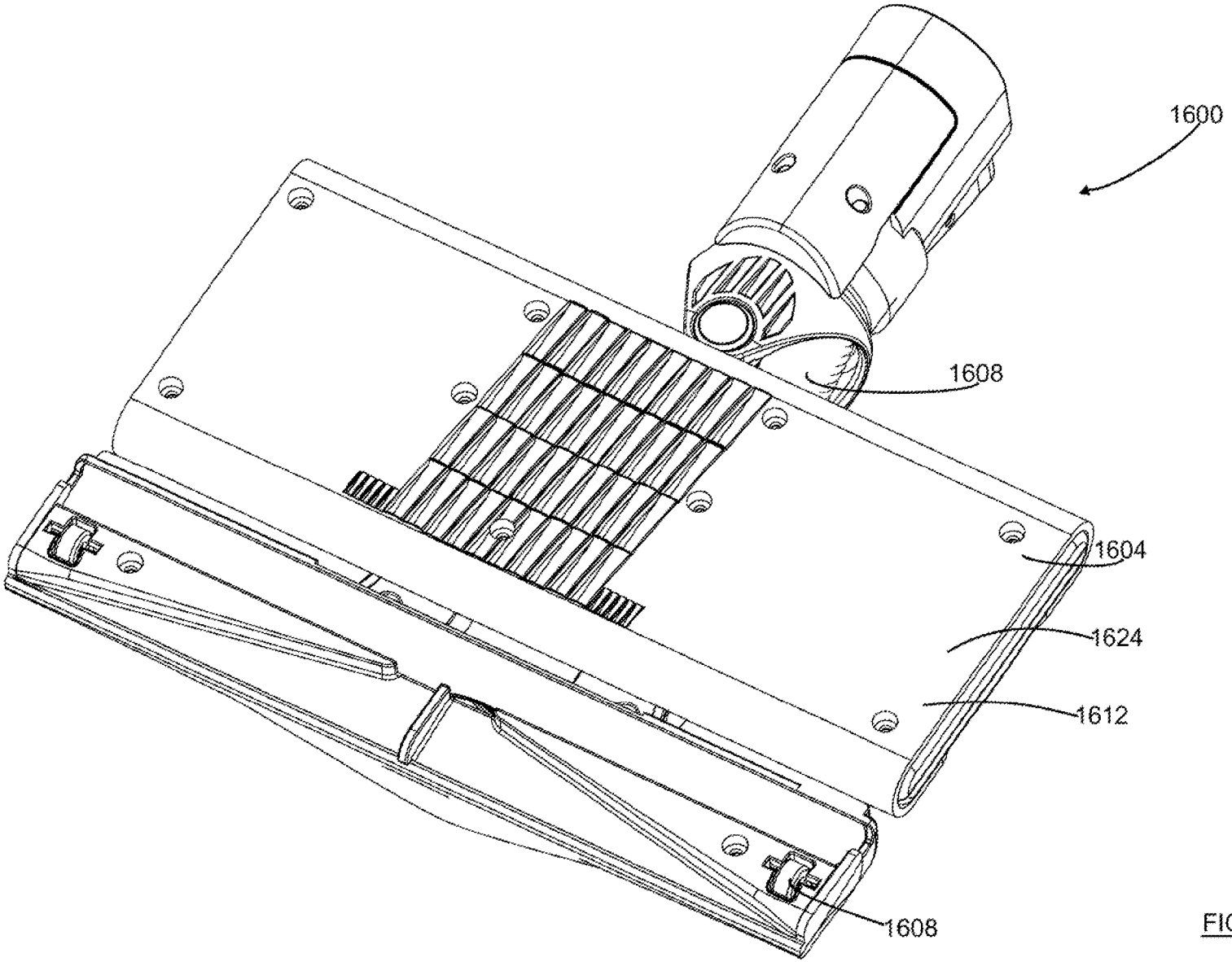
FIG. 37 is a bottom perspective view of the alternate floor cleaning tool of FIG. 34 with the hard floor cleaning cloth removed; and, FIG. 38 is a perspective view of the cleaning surface of the hard floor cleaning cloth.
Figure 38:
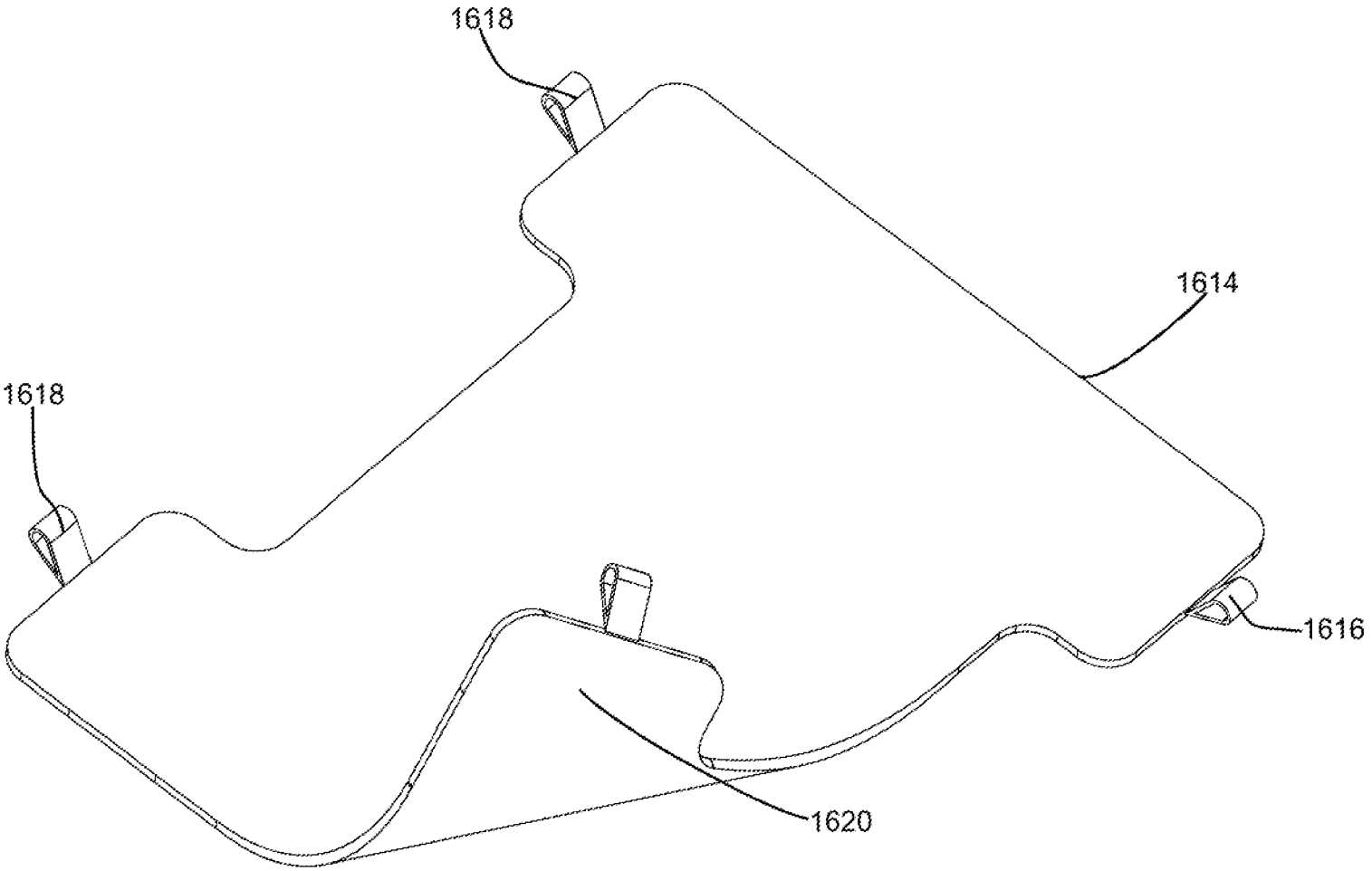

FIG. 28*b* shows an exemplary power sander tool 1526 that may be connected to an upstream end 192 of wand 180 or to an upstream end 200 of handle 160. Like parts numbers refer to like parts in other figures. As shown, power sanding tool 1526 may include a belt drive in a drive housing 1522. The belt drive may be drivingly connected to a rotatably mounted sanding belt 1528 for rotating belt 1528. Belt 1528 may be positioned proximate dirty air inlet 1514 for sanding a working surface. Power sander tool 1526 may include an electrical engagement member (not shown) for connection with wand 180 or handle 160 to receive electricity to power the brush drive. Alternatively, or in addition, power sander tool 1526 may include an alternative source of power, such as one or more batteries.

Reference is now made to FIGS. 34-38, which show another example of a surface cleaning head that may be connected to upper portion 104, to an upstream end 192 of wand 180 or to an upstream end 200 of handle 160. In the example shown, surface cleaning head 1600 includes a lower surface 1604 having a dirty air inlet 116 in air flow communication with an up flow conduit 1608. As shown, lower surface 1604 may include a forward portion 1608 and a rearward portion 1612. Forward portion 1608 may be provided with dirty air inlet 116. A cleaning member, that may be a discrete cleaning sheet 1614 may be mounted, and preferably removably mounted, preferably rearward of dirty air inlet 116.

Cleaning sheet 1614 may be any cleaning sheet known in the art, such as an electrostatic cleaning sheet, and may be disposable or reuseable (e.g., washable). Cleaning sheet may be useable by itself or with a liquid applied to the floor.

Cleaning sheet 1614 may be securable to cleaning head 1600 by any means known in the art, such as mechanical engagement members (e.g., hook and loop fasteners) an adhesive and the like. As exemplified, sheet 1614 and cleaning head 1600 may be provided with engagement members such as hook and loop fasteners (e.g., sheet 1614 may be provided with hook fasteners 1620 and the upper surface of sheet mounting portion 1624 of cleaning head 1600 may be provided with loop fasteners 1622 that are engageable with hook fasteners 1620 Alternately or in addition, sheet 1614 may be provided with tabs 1616 and 1618, which may be securable to each other be, e.g., mechanical engagement members (e.g., such as by hook and loop fasteners). For example, tab 1616 may be provided with hook fasteners and tabs 1618 may be provided with loop fasteners engageable with the hook fasteners of tab 1616. Tabs 1616 and 1618 may be wrapped around sheet mounting portion 1624 and secured together so as to secure, or assist in securing cleaning sheet 1614 to cleaning 1600.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A reconfigurable upright surface cleaning apparatus comprising:

(a) a surface cleaning head having a front end, a dirty air inlet and a rear end, the surface cleaning head is moveable across a surface in a forward direction in which the rear end follows the front end;

(b) a support structure moveably mounted to the surface cleaning head, the support structure comprising a lower portion having a lower longitudinal axis and an upper portion having an upper longitudinal axis, the lower portion having a lower end moveably coupled to the surface cleaning head and an upper end rotatably coupled to the upper portion about a rotational axis that is generally transverse to the forward direction, wherein, the support structure is reconfigurable between a first configuration in which the lower portion and the upper portion extend in a common direction and an operating position in which the lower portion is rotated rearward with respect to the surface cleaning head and the upper portion is rotated in the forward direction with respect to the lower portion;

(c) a hand vacuum cleaner comprising a suction motor and an air treatment member, the hand vacuum cleaner is removably mounted to a mounting portion of the support structure; and, (d) an air flow path extending from the dirty air inlet of the surface cleaning head to an outlet port of the support structure, the air flow path comprising the lower portion and a first flexible hose that is downstream of the lower portion, wherein, when the hand vacuum cleaner is mounted to the mounting portion, a total weight of the hand vacuum cleaner is transferred to the support structure by the mounting portion whereby the support structure supports the total weight of the hand vacuum cleaner, and wherein the mounting portion comprises the outlet port of the support structure whereby mounting the hand vacuum cleaner to the mounting portion of the support structure connects the hand vacuum cleaner in air flow communication with the surface cleaning head.

2. The reconfigurable upright surface cleaning apparatus of claim 1 wherein, in a storage position, the lower portion extends vertically from the surface cleaning head, the hand vacuum cleaner is mounted to the support structure, and the hand vacuum cleaner is positioned overlying the surface cleaning head.

3. The upright surface cleaning apparatus of claim 2 wherein, in the storage position, the hand vacuum cleaner is positioned below the rotational axis.

4. The reconfigurable upright surface cleaning apparatus of claim 2 wherein the hand vacuum cleaner is removable from the support structure while the reconfigurable upright surface cleaning apparatus is in the storage position.

5. The reconfigurable upright surface cleaning apparatus of claim 1 wherein the upper portion is pivotally mounted to the lower portion.

6. The reconfigurable upright surface cleaning apparatus of claim 1 wherein the air flow path extending from the dirty air inlet of the surface cleaning head to the hand vacuum cleaner further comprises a second flexible hose.

7. The reconfigurable upright surface cleaning apparatus of claim 1 further comprising a releasable lock located at a juncture of the upper and lower portions.

8. The reconfigurable upright surface cleaning apparatus of claim 1 further comprising an actuator operatively connected to the lock, the actuator is positioned on the upper portion.

9. The reconfigurable upright surface cleaning apparatus of claim 1 wherein the hand vacuum cleaner is useable in a first surface cleaning configuration wherein the hand vacuum cleaner is mounted on the support structure and a second surface cleaning configuration wherein the hand vacuum cleaner is removed from air flow communication with the surface cleaning head and useable as a portable surface cleaning apparatus.

10. A reconfigurable upright surface cleaning apparatus comprising:

(a) a surface cleaning head having a front end, a dirty air inlet and a rear end, the surface cleaning head is moveable across a surface in a forward direction in which the rear end follows the front end;

(b) a support structure moveably mounted to the surface cleaning head, the support structure comprising a lower portion having a lower longitudinal axis and an upper portion having an upper longitudinal axis, the lower portion having a lower end moveably coupled to the surface cleaning head and an upper end rotatably coupled to the upper portion about a rotational axis that is generally transverse to the forward direction, wherein, the support structure is reconfigurable between a first configuration in which the lower portion and the upper portion extend in a common direction and an operating position in which the lower portion is rotated rearward with respect to the surface cleaning head and the upper portion is rotated in the forward direction with respect to the lower portion;

(c) a hand vacuum cleaner comprising a suction motor, an air treatment member and a mount, the mount is removably connectable to the support structure, wherein the mount comprises a hand vacuum cleaner air inlet; and, (d) an air flow path extending from the dirty air inlet of the surface cleaning head to the hand vacuum cleaner, wherein, when the mount is connected to the support structure, the hand vacuum cleaner is downwardly vertically slideable connectable to the support structure whereby the hand vacuum cleaner is supported by the mount, and wherein, when the upright surface cleaning apparatus is in a storage position, the lower portion extends vertically from the surface cleaning head, the hand vacuum cleaner is mounted to the support structure, and the hand vacuum cleaner is positioned overlying the surface cleaning head.

11. The reconfigurable upright surface cleaning apparatus of claim 10 wherein, the air flow path between the surface cleaning head and the hand vacuum cleaner comprises a cleaning wand and a flexible hose.

12. The upright surface cleaning apparatus of claim 10 wherein, in the storage position, the hand vacuum cleaner is positioned below the rotational axis.

13. The reconfigurable upright surface cleaning apparatus of claim 10 wherein the hand vacuum cleaner is removable from the support structure while the reconfigurable upright surface cleaning apparatus is in the storage position.

14. The reconfigurable upright surface cleaning apparatus of claim 10 further comprising a releasable lock located at a juncture of the upper and lower portions.

15. The reconfigurable upright surface cleaning apparatus of claim 14 further comprising an actuator operatively connected to the lock, the actuator is positioned on the upper portion.

16. The reconfigurable upright surface cleaning apparatus of claim 10 wherein, when the surface cleaning head is positioned on a floor with the upright surface cleaning apparatus is in the storage position and the upper portion fully rotated in the forward direction with respect to the lower portion, the air treatment member is positioned above the suction motor.

17. The reconfigurable upright surface cleaning apparatus of claim 1 wherein air enters a hand vacuum cleaner air inlet in a flow direction, and wherein a plane that extends in the flow direction and which extends through the outlet port of the support structure intersects the mounting portion.

18. The reconfigurable upright surface cleaning apparatus of claim 17 wherein the plane intersects mounting members of the mounting portion.

19. The reconfigurable upright surface cleaning apparatus of claim 10 wherein air enters the hand vacuum cleaner air inlet in a flow direction, and wherein a plane that extends in the flow direction and which extends through an outlet port of the support structure intersects the mounting portion.

20. The reconfigurable upright surface cleaning apparatus of claim 19 wherein the plane intersects mounting members of the mounting portion.

* * * * *